US011371770B2

(12) United States Patent
Park et al.

(10) Patent No.: US 11,371,770 B2
(45) Date of Patent: Jun. 28, 2022

(54) REFRIGERATOR HAVING DRAWER

(71) Applicant: LG ELECTRONICS INC., Seoul (KR)

(72) Inventors: CheolSoon Park, Seoul (KR); EuDdeum Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 422 days.

(21) Appl. No.: 16/582,518

(22) Filed: Sep. 25, 2019

(65) Prior Publication Data

US 2021/0010743 A1 Jan. 14, 2021

(30) Foreign Application Priority Data

Jul. 12, 2019 (KR) ..... 10-2019-0084446

(51) Int. Cl.
*F25D 25/00* (2006.01)
*F25D 11/00* (2006.01)
*F25D 25/02* (2006.01)

(52) U.S. Cl.
CPC ..... *F25D 25/005* (2013.01); *F25D 11/00* (2013.01); *F25D 25/025* (2013.01)

(58) Field of Classification Search
CPC ..... F25D 25/005; F25D 25/025; F25D 11/00; F25D 11/02; F25D 23/02; A47B 88/941; A47B 2088/901; A47B 2210/157
See application file for complete search history.

(56) References Cited

U.S. PATENT DOCUMENTS

| | | | |
|---|---|---|---|
| 658,999 | A | 10/1900 | Scannell |
| 1,067,404 | A | 7/1913 | Callaghan |
| 2,072,244 | A | 3/1937 | Coursen |
| 2,679,658 | A | 6/1954 | McCormick |
| 2,731,318 | A | 1/1956 | Hoff |
| 4,545,628 | A | 10/1985 | Richey |

(Continued)

FOREIGN PATENT DOCUMENTS

| | | |
|---|---|---|
| CN | 100417900 | 9/2008 |
| CN | 101981397 | 2/2011 |

(Continued)

OTHER PUBLICATIONS

U.S. Appl. No. 16/583,726, filed Sep. 26, 2019.

(Continued)

*Primary Examiner* — Emmanuel E Duke
(74) *Attorney, Agent, or Firm* — KED & Associates, LLP

(57) ABSTRACT

The present disclosure relates to a refrigerator having a drawer. The refrigerator includes: a cabinet and the drawer provided with a front panel and a storage body, the front panel being moved forward and rearward so that an open front portion of the storage chamber is opened and closed and the storage body being provided in rear of the front panel and received in the storage chamber. The refrigerator including a side cover module provided with an inside cover and an outside cover, the inside cover being provided at an inside surface of the storage body and protecting the inside surface of the storage body, and the outside cover being provided at an outside surface of the storage body and protecting the outside surface of the storage body.

20 Claims, 54 Drawing Sheets

(56) References Cited

U.S. PATENT DOCUMENTS

| | | | | |
|---|---|---|---|---|
| 5,253,488 | A | 10/1993 | Kim et al. | |
| 6,044,606 | A | 4/2000 | Hamar | |
| 6,109,774 | A | 8/2000 | Holmes et al. | |
| 6,371,584 | B1 | 4/2002 | Alreck | |
| 6,722,749 | B1 | 4/2004 | Pagac | |
| 7,600,829 | B2 | 10/2009 | Oh et al. | |
| 7,600,830 | B2 | 10/2009 | Oh et al. | |
| 7,600,833 | B2 | 10/2009 | Oh et al. | |
| 7,690,586 | B2 | 4/2010 | Kang | |
| 8,282,177 | B1 | 10/2012 | Rotter | |
| 8,360,539 | B2 | 1/2013 | Brown et al. | |
| 8,376,481 | B2 | 2/2013 | Lee | |
| 8,497,644 | B2 | 7/2013 | Eom et al. | |
| 8,668,289 | B2 | 3/2014 | Lee et al. | |
| 8,794,722 | B2 | 8/2014 | Nuss et al. | |
| 8,844,110 | B2 | 9/2014 | Rotter | |
| 8,864,249 | B2 | 10/2014 | Nam et al. | |
| 9,107,494 | B2 | 8/2015 | Scheuring et al. | |
| 9,377,238 | B2 | 6/2016 | Hall et al. | |
| 9,523,533 | B2 | 12/2016 | Nam et al. | |
| 9,982,937 | B2 | 5/2018 | Tierney et al. | |
| 10,234,195 | B2 | 3/2019 | Yasaka et al. | |
| 10,465,970 | B1 | 11/2019 | Kang et al. | |
| 10,598,428 | B2 | 3/2020 | Kim | |
| 10,690,401 | B2 | 6/2020 | Yang et al. | |
| 10,712,083 | B1 | 7/2020 | Choi | |
| 10,767,920 | B1 | 9/2020 | Choi | |
| 10,786,080 | B1 | 9/2020 | Stravitz et al. | |
| 10,876,788 | B2 | 12/2020 | Choi | |
| 10,932,568 | B2 | 3/2021 | Subrahmanya et al. | |
| 10,939,758 | B2 | 3/2021 | Kim | |
| 11,033,104 | B2 | 6/2021 | Kim | |
| 11,047,619 | B2 | 6/2021 | Choi | |
| 11,131,500 | B2 | 9/2021 | Kim | |
| 2003/0201700 | A1 | 10/2003 | Cho | |
| 2004/0031705 | A1 | 2/2004 | DeTemple, II et al. | |
| 2004/0046488 | A1 | 3/2004 | Hogan | |
| 2004/0056573 | A1 | 3/2004 | Chae | |
| 2006/0042306 | A1 | 3/2006 | Choi et al. | |
| 2006/0087207 | A1 | 4/2006 | Oh et al. | |
| 2006/0087208 | A1 | 4/2006 | Oh et al. | |
| 2006/0207283 | A1 | 9/2006 | Kim et al. | |
| 2006/0248916 | A1 | 11/2006 | Kim et al. | |
| 2006/0250062 | A1 | 11/2006 | Janda et al. | |
| 2007/0262686 | A1 | 11/2007 | Ji | |
| 2008/0018215 | A1 | 1/2008 | Carden et al. | |
| 2009/0045713 | A1 | 2/2009 | Kunkle et al. | |
| 2009/0160298 | A1 | 6/2009 | Chen et al. | |
| 2009/0167131 | A1 | 7/2009 | Oh et al. | |
| 2009/0277210 | A1 | 11/2009 | Eveland et al. | |
| 2010/0192621 | A1 | 8/2010 | Kim | |
| 2010/0236279 | A1 | 9/2010 | Eom et al. | |
| 2010/0239795 | A1 | 9/2010 | Gat | |
| 2010/0283365 | A1 | 11/2010 | Chen | |
| 2011/0005264 | A1 | 1/2011 | Lee et al. | |
| 2011/0006656 | A1 | 1/2011 | Nam et al. | |
| 2011/0050065 | A1 | 3/2011 | Lee et al. | |
| 2011/0050066 | A1 | 3/2011 | Lee et al. | |
| 2011/0146333 | A1 | 6/2011 | Koo et al. | |
| 2011/0162402 | A1 | 7/2011 | Park | |
| 2011/0181163 | A1 | 7/2011 | Han et al. | |
| 2011/0210655 | A1 | 9/2011 | Brown et al. | |
| 2012/0091872 | A1 | 4/2012 | Matthes et al. | |
| 2012/0125035 | A1 | 5/2012 | Chellappan et al. | |
| 2012/0306338 | A1 | 12/2012 | Nagahata et al. | |
| 2013/0055543 | A1 | 3/2013 | Rotter | |
| 2013/0129267 | A1 | 5/2013 | Chen | |
| 2013/0145972 | A1 | 6/2013 | Knox et al. | |
| 2013/0264928 | A1 | 10/2013 | Hong et al. | |
| 2013/0270986 | A1 | 10/2013 | Min et al. | |
| 2013/0270987 | A1* | 10/2013 | Kelly | A47B 88/483 312/331 |
| 2013/0270989 | A1* | 10/2013 | Park | F25D 23/00 74/89.17 |
| 2014/0191646 | A1 | 7/2014 | Nuss et al. | |
| 2014/0265783 | A1 | 9/2014 | Hauer et al. | |
| 2014/0265797 | A1 | 9/2014 | Scheuring et al. | |
| 2014/0265806 | A1 | 9/2014 | Hall et al. | |
| 2014/0319990 | A1 | 10/2014 | Gephart et al. | |
| 2015/0059398 | A1 | 3/2015 | Yoo et al. | |
| 2015/0059399 | A1 | 3/2015 | Hwang et al. | |
| 2015/0069899 | A1 | 3/2015 | Han et al. | |
| 2015/0184918 | A1 | 7/2015 | Klingshirn et al. | |
| 2016/0146533 | A1 | 5/2016 | Jung | |
| 2016/0153704 | A1 | 6/2016 | Burke et al. | |
| 2016/0178274 | A1 | 6/2016 | Shin | |
| 2016/0265816 | A1 | 9/2016 | Gillette et al. | |
| 2016/0305705 | A1 | 10/2016 | Dubina et al. | |
| 2016/0320118 | A1 | 11/2016 | Millett | |
| 2016/0370063 | A1 | 12/2016 | Yang | |
| 2017/0024946 | A1 | 1/2017 | Hashemi et al. | |
| 2017/0051967 | A1 | 2/2017 | Tierney et al. | |
| 2017/0122651 | A1* | 5/2017 | Cizik | F25D 17/06 |
| 2017/0227279 | A1 | 8/2017 | Yang et al. | |
| 2017/0336129 | A1 | 11/2017 | Cunningham | |
| 2017/0362864 | A1 | 12/2017 | Fazi et al. | |
| 2018/0128540 | A1 | 5/2018 | Yasaka et al. | |
| 2018/0283771 | A1 | 10/2018 | Shin et al. | |
| 2018/0291669 | A1 | 10/2018 | Kim et al. | |
| 2018/0356148 | A1* | 12/2018 | Fei | F25D 25/005 |
| 2019/0219324 | A1 | 7/2019 | Kang | |
| 2019/0242640 | A1 | 8/2019 | Minoru et al. | |
| 2019/0292831 | A1 | 9/2019 | Choi | |
| 2019/0293341 | A1 | 9/2019 | Yeom | |
| 2019/0323763 | A1 | 10/2019 | Kang | |
| 2019/0346199 | A1 | 11/2019 | Choi | |
| 2019/0390895 | A1 | 12/2019 | Choi | |
| 2020/0011593 | A1 | 1/2020 | Ji | |
| 2020/0069056 | A1 | 3/2020 | Kim | |
| 2020/0072533 | A1 | 3/2020 | Cho | |
| 2020/0072540 | A1 | 3/2020 | Kim | |
| 2020/0072542 | A1 | 3/2020 | Kim | |
| 2021/0003337 | A1 | 1/2021 | Voltarelli et al. | |
| 2021/0259416 | A1 | 8/2021 | Kim | |

FOREIGN PATENT DOCUMENTS

| | | |
|---|---|---|
| CN | 102226626 | 10/2011 |
| CN | 202254607 | 5/2012 |
| CN | 204902419 | 12/2015 |
| CN | 107388718 | 11/2017 |
| CN | 109028726 | 12/2018 |
| CN | 208640001 | 3/2019 |
| CN | 109690213 | 4/2019 |
| CN | 208736030 | 4/2019 |
| CN | 109838961 | 6/2019 |
| CN | 109990557 | 7/2019 |
| CN | 110873500 | 3/2020 |
| DE | 29620152 | 4/1997 |
| DE | 10-2005-016418 | 11/2005 |
| EP | 1 724 540 | 11/2006 |
| EP | 2 299 215 | 3/2011 |
| EP | 2 752 632 | 7/2014 |
| EP | 3 023 721 | 5/2016 |
| EP | 3 505 854 | 7/2019 |
| EP | 3 546 862 | 10/2019 |
| EP | 3 617 630 | 3/2020 |
| GB | 2108564 | 5/1983 |
| JP | H 04-138337 | 12/1992 |
| JP | H 07-275049 | 10/1995 |
| JP | H 08-303944 | 11/1996 |
| JP | 2001-280824 | 10/2001 |
| JP | 2002-264943 | 9/2002 |
| KR | 10-2006-0025806 | 3/2006 |
| KR | 10-2006-0027592 | 3/2006 |
| KR | 10-2006-0053420 | 5/2006 |
| KR | 10-2007-0075671 | 7/2007 |
| KR | 10-2008-0101335 | 11/2008 |
| KR | 10-2009-0027111 | 3/2009 |
| KR | 10-2009-0027112 | 3/2009 |
| KR | 10-2009-0102576 | 9/2009 |
| KR | 10-2009-0102577 | 9/2009 |
| KR | 10-0921380 | 10/2009 |
| KR | 10-2009-0114265 | 11/2009 |

(56) References Cited

FOREIGN PATENT DOCUMENTS

| | | |
|---|---|---|
| KR | 10-2010-0012544 | 2/2010 |
| KR | 10-0946784 | 3/2010 |
| KR | 10-2010-0078916 | 7/2010 |
| KR | 10-2011-0015331 | 2/2011 |
| KR | 20-0460442 | 6/2012 |
| KR | 10-2013-0071919 | 7/2013 |
| KR | 10-2014-0037474 | 3/2014 |
| KR | 10-2018-0138083 | 12/2018 |
| KR | 10-2018-0138085 | 12/2018 |
| KR | 10-2019-0081331 | 7/2019 |
| WO | 92/14522 | 9/1992 |
| WO | WO 03/016661 | 2/2003 |
| WO | WO 2018/051963 | 3/2018 |
| WO | WO 2019/242234 | 12/2019 |

OTHER PUBLICATIONS

U.S. Appl. No. 16/582,647, filed Sep. 25, 2019.
U.S. Appl. No. 16/582,518, filed Sep. 25, 2019.
U.S. Appl. No. 16/582,605, filed Sep. 25, 2019.
U.S. Appl. No. 16/582,756, filed Sep. 25, 2019.
U.S. Appl. No. 16/582,668, filed Sep. 25, 2019.
U.S. Appl. No. 16/582,755, filed Sep. 25, 2019.
U.S. Appl. No. 16/585,284, filed Sep. 27, 2019.
U.S. Appl. No. 16/585,301, filed Sep. 27, 2019.
U.S. Appl. No. 16/585,816, filed Sep. 27, 2019.
United States Office Action dated Jan. 31, 2022 issued in co-pending related U.S. Appl. No. 16/582,756.
United States Office Action dated Feb. 2, 2022 issued in co-pending related U.S. Appl. No. 16/582,605.
European Search Report dated Mar. 12, 2020 issued in Application No. 19199586.9.
European Search Report dated Mar. 17, 2020 issued in Application No. 19199553.9.
European Search Report dated Mar. 20, 2020 issued in Application No. 19199569.5.
European Search Report dated Mar. 30, 2020 issued in Application No. 19199556.2.
European Search Report dated Apr. 3, 2020 issued in Application No. 19199625.5.
European Search Report dated Apr. 6, 2020 issued in Application No. 19199587.7.
European Search Report dated Apr. 6, 2020 issued in Application No. 19199629.7.
European Search Report dated Apr. 7, 2020 issued in Application No. 19199607.3.
European Office Action dated Sep. 30, 2020 issued in EP Application No. 19199556.2.
U.S. Appl. No. 16/582,712, filed Sep. 25, 2019.
U.S. Appl. No. 16/582,810, filed Sep. 25, 2019.
U.S. Appl. No. 16/582,831, filed Sep. 25, 2019.
United States Office Action dated Mar. 4, 2020 issued in U.S. Appl. No. 16/582,712.
United States Office Action dated Mar. 9, 2020 issued in U.S. Appl. No. 16/582,810.
European Office Action dated Sep. 1, 2021 issued in EP Application No. 19199607.3.
United States Office Action dated Nov. 19, 2020 issued in co-pending related U.S. Appl. No. 16/582,831.
European Search Report dated Mar. 23, 2020 issued in EP Application No. 19199602.4.
European Search Report dated Aug. 14, 2020 issued in EP Application No. 19199647.9.
European Communication dated Feb. 8, 2021 issued in EP Application No. 19199627.1.
Chinese Office Action dated Sep. 3, 2021 issued in CN Application No. 201910905106.9.
European Search Report dated Apr. 1, 2020 issued in EP Application No. 19199637.0.
Chinese Office Action dated Aug. 20, 2021 issued in CN Application No. 201910857469.X.
Chinese Office Action dated Aug. 25, 2021 issued in CN Application No. 201910911807.3.
Chinese Office Action dated Sep. 2, 2021 issued in CN Application No. 201910871084.9.
Chinese Office Action dated Sep. 17, 2021 issued in CN Application No. 201910905094.X.
United States Office Action dated Oct. 6, 2021 issued in co-pending related U.S. Appl. No. 16/583,726.
United States Office Action dated Oct. 6, 2021 issued in co-pending related U.S. Appl. No. 16/582,647.
United States Office Action dated Oct. 6, 2021 issued in co-pending related U.S. Appl. No. 16/582,668.
Chinese Office Action dated Aug. 24, 2021 issued in CN Application No. 201910911796.9.
Chinese Office Action dated Sep. 8, 2021 issued in CN Application No. 201910857458.1.
Chinese Office Action dated Sep. 14, 2021 issued in CN Application No. 201910905166.0.
United States Office Action dated Oct. 15, 2021 issued in co-pending related U.S. Appl. No. 16/582,755.
United States Notice of Allowance dated Feb. 23, 2022 issued in co-pending related U.S. Appl. No. 16/585,284.
GE (Refrigerator Freezer Door Pops Open, http://products.geapplicances.com/appliance/gea-support-search-content?contentId=16979) (Year: 2015).
United States Office Action dated Apr. 11, 2022 issued in co-pending related U.S. Appl. No. 16/585,301.

* cited by examiner

REFRIGERATOR HAVING DRAWER

CROSS-REFERENCE TO RELATED APPLICATION

The present application claims priority to Korean Patent Application No. 10-2019-0084446, filed Jul. 12, 2019 in Korea, the entire contents of which are incorporated herein by reference.

BACKGROUND

1. Field

The present disclosure relates to a refrigerator having a drawer, more particularly, to a refrigerator having a drawer in which an outside cover being easily detachable is installed at opposite sides of a storage body.

2. Background

A refrigerator is a device for freezing or refrigerating food or the like by discharging cold air generated by a refrigeration cycle including a compressor, a condenser, an expansion valve, and an evaporator and lowering temperature in the refrigerator.

The refrigerator may include a freezer compartment for freezing food or drink and a refrigerating compartment for storing the food and drink at low temperature. A kimchi refrigerator for storing food and vegetables such as kimchi while keeping them fresh is also a refrigerator.

The refrigerator may be classified into various types depending on a door opening and closing method of a storage chamber in a cabinet, such as a swinging door-type refrigerator, a drawer-type refrigerator, and a hybrid-type refrigerator having both doors and drawers. The hybrid-type refrigerator has a structure in which a swinging door is provided in an upper portion of the cabinet and a drawer is provided in a lower portion thereof.

The drawer provided in the drawer refrigerator or the hybrid-type refrigerator may open, by a user's operation, from an inside space of the cabinet in a sliding manner. The drawer may close by being pushed into the inside space of the cabinet by user's pushing operation, thereby allowing an open front portion of the cabinet to be closed.

The drawer may include a front panel and a storage bin (or storage room), the front panel forming a front surface of the refrigerator and being moved forward and rearward, thereby allowing the inside space of the cabinet to be opened/closed and the storage bin being provided in rear of the front panel and received in the inside space of the cabinet. By pulling the front panel, the storage bin may be pushed out from the inside space of the cabinet, thus various foods can be stored in and taken out from the storage bin.

The drawer provided in the drawer refrigerator or the hybrid-type refrigerator is mainly provided in the lower portion of the cabinet. This is because, due to weight of storage items stored in the storage bin of the drawer, the drawer may be removed from the cabinet and may fall down when the drawer is opened.

However, when the drawer is provided in the lower portion of the cabinet, the user may bend over at the waist while keeping away from the front panel by an appropriate distance for opening of the drawer.

Korean Patent No. 10-0946784 and Korean Patent Application Publication No. 10-2009-0027111, the subject matters of which are incorporated herein by reference, may disclose an assembly structure of a storage bin (or storage room).

The assembly structure may be configured such that a side plate is assembled to a side drawer supporting frame on which the storage bin is mounted.

The assembly structure may be configured such that the side plate is fixed to the side drawer supporting frame by welding or screw fastening.

Accordingly, in order to disassemble the side plate of the storage bin, the side plate is separated by removing a welding portion of the side plate or by removing screws coupled thereto. Therefore, a long time may be required for disassembly and other parts may be damaged during disassembly of the side plate.

As the assembly and disassembly of the side plate are performed through complicated processes, work efficiency may be reduced and a large number of people may be required for assembly and disassembly.

As a separate protection member is not provided at an edge of the metal side plate, during assembly and disassembly of the side plate, other parts may have damage such as scratching and chipping.

BRIEF DESCRIPTION OF THE DRAWINGS

Arrangements and embodiments may be described in detail with reference to the following drawings in which like reference numerals refer to like elements, and wherein.

DETAILED DESCRIPTION

An exemplary embodiment with respect to a refrigerator of the present disclosure may be described in detail with reference to accompanying FIGS. 1 to 34.

Figure 1:
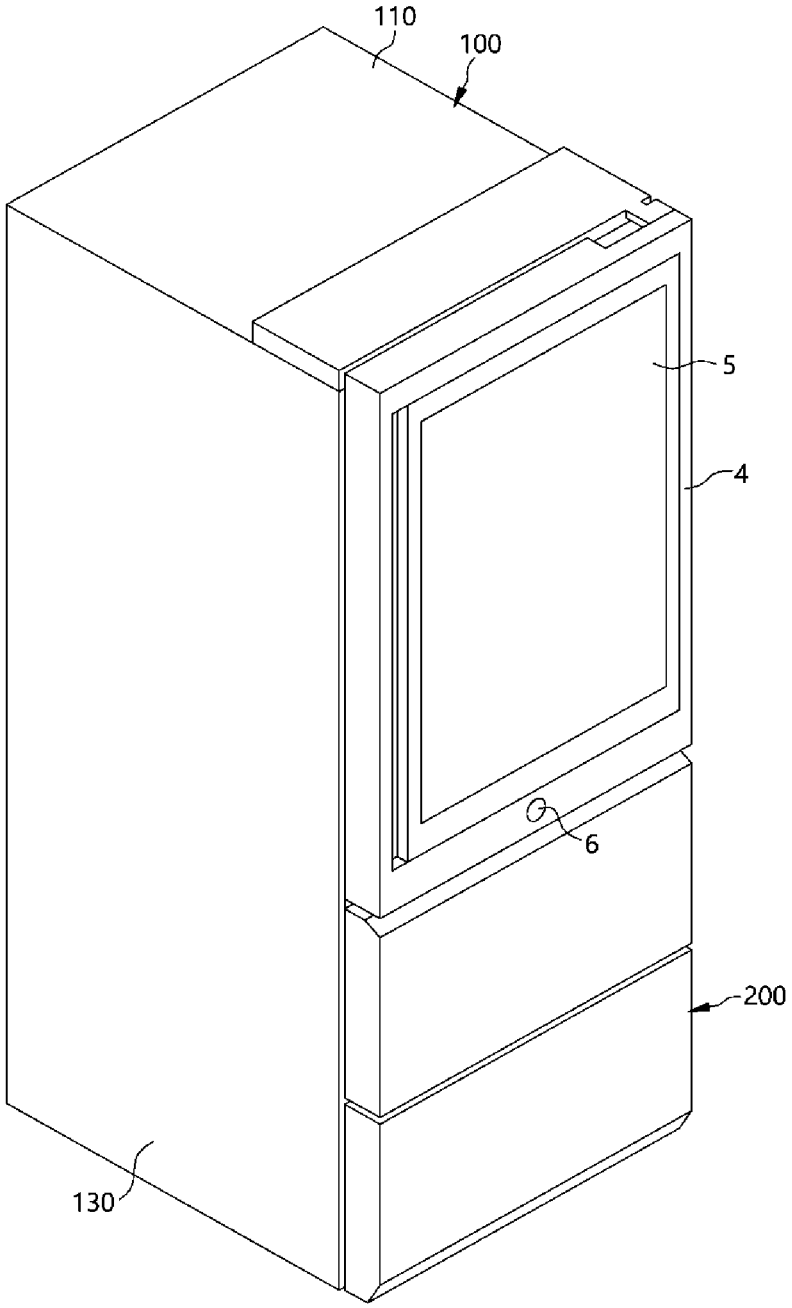
FIG. 1 is a perspective view showing a refrigerator having a drawer according to an embodiment of the present disclosure.
Figure 2:
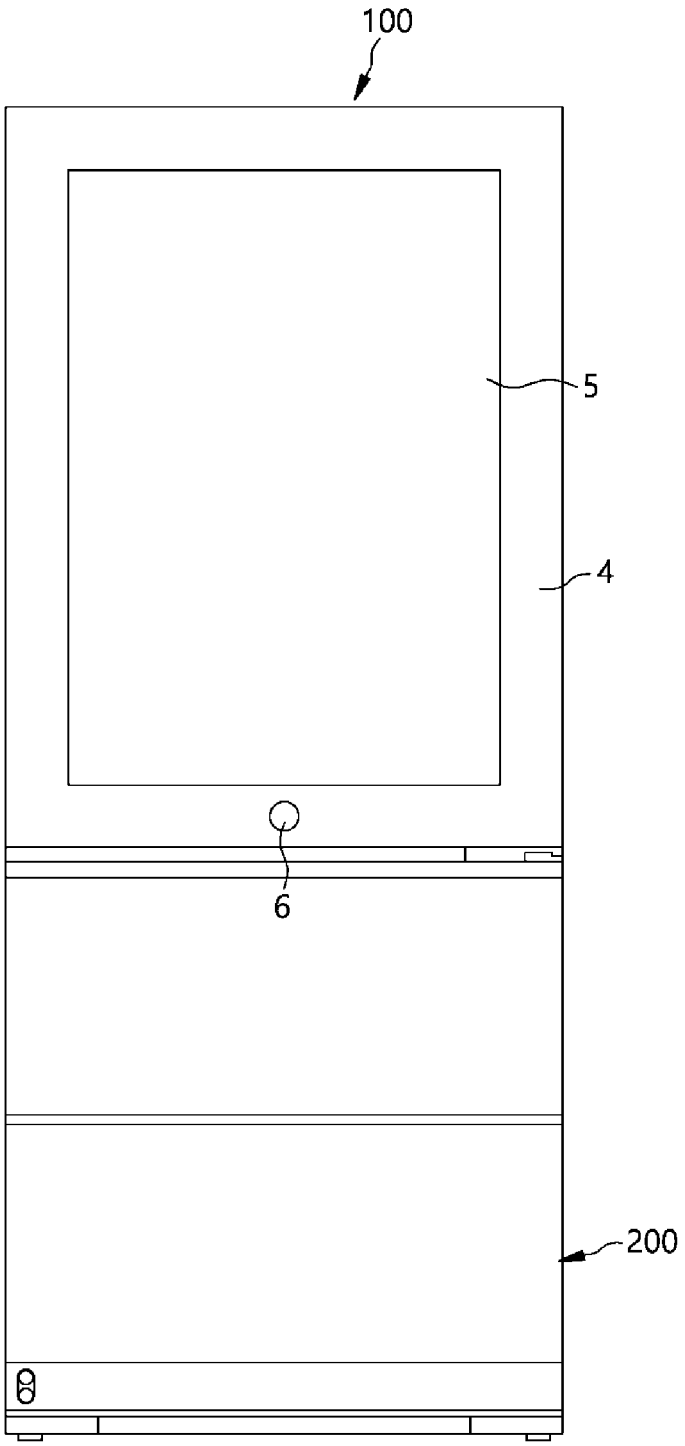
FIG. 2 is a front view showing the refrigerator having the drawer according to an embodiment of the present disclosure.
Figure 3:
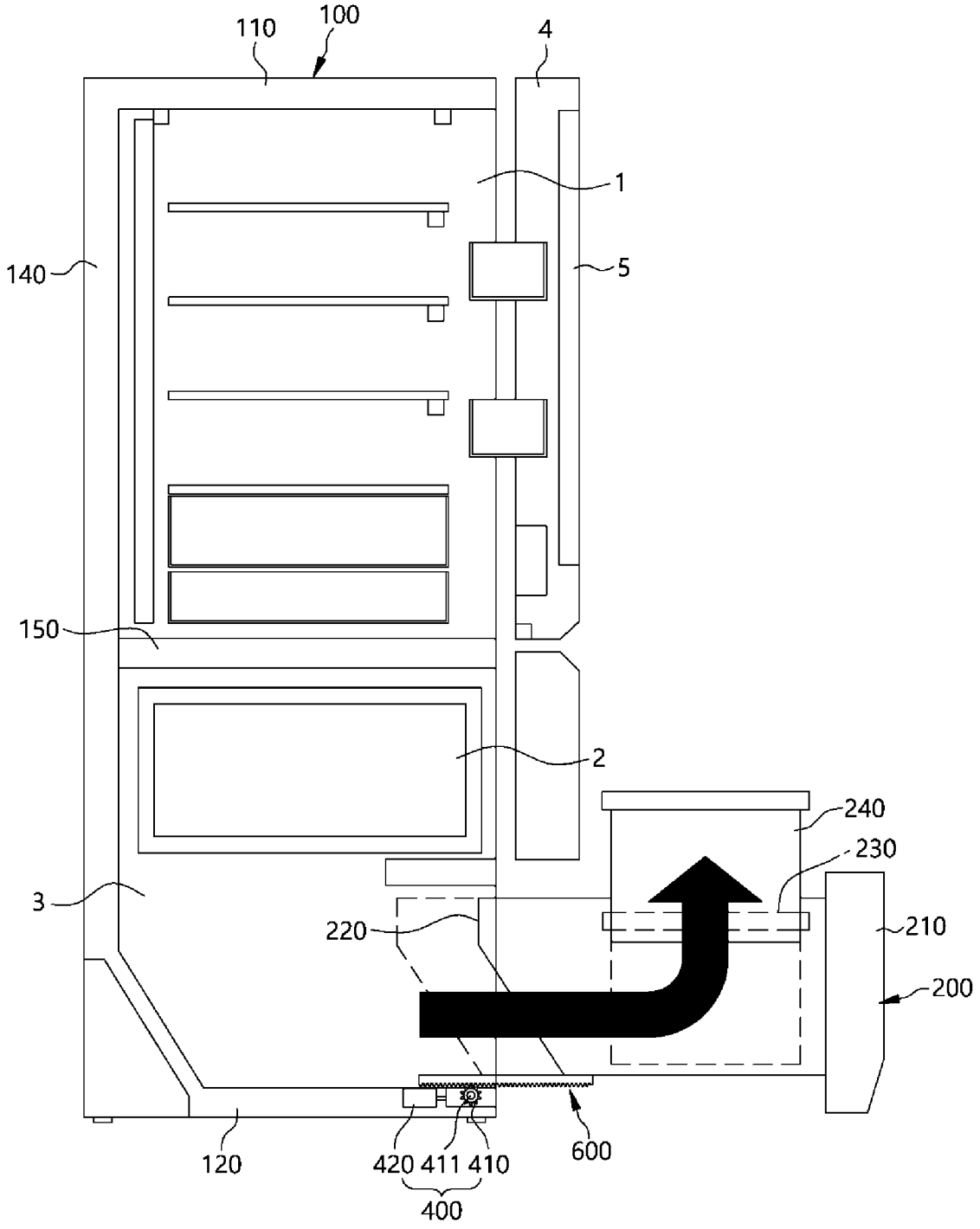
FIG. 3 is a side view showing the refrigerator having the drawer according to an embodiment of the present disclosure.

FIG. 1 is a perspective view showing a refrigerator provided with a shock absorption module according to an embodiment of the present disclosure. FIG. 2 is a front view showing the refrigerator provided with a drawer according to an embodiment of the present disclosure. FIG. 3 is a side view showing the refrigerator provided with the drawer according to an embodiment of the present disclosure.

As shown in the drawings, a refrigerator provided with the drawer according to an example embodiment of the present disclosure may include a cabinet 100, a drawer 200, a driving part 400 (or driving device), and rack gear assemblies 601 and 602. At least any one rack gear assembly of the rack gear assemblies 601 and 602 may be provided with an idle gear 630 (referring to FIG. 11), where the idle gear being engaged with gear teeth of a pinion 410 of the driving part and allowing the pinion 410 to idle.

The cabinet 100 may constitute an outer appearance of the refrigerator.

The cabinet 100 may include a roof 110 forming an upper side wall, a bottom 120 forming a lower side wall, two side walls 130 forming opposite side walls, and a rear wall 140 forming a rear side wall, and the cabinet may be configured as a box-shaped body which is opened forward. An inside space of the cabinet 100 may be used as a storage space.

A plurality of partition walls 150 may be provided inside the cabinet 100. The partition walls 150 may divide the storage space in the cabinet 100 into a plurality of spaces, so that the storage space is provided as a plurality of vertically partitioned storage chambers (1, 2, and 3).

In other implementations, the partition walls 150 may extend vertically to partition the storage space in the cabinet 100 into storage chambers that are horizontally positioned.

The refrigerator may be provided with three storage chambers partitioned up and down. An upper storage chamber 1 may be a refrigerator chamber, and a center storage chamber 2 and a lower storage chamber 3 may be a refrigerator chamber or a freezer chamber, or a separate space.

Each of storage chambers (1, 2, and 3) of the cabinet 100 is configured to be opened and closed by a door thereof. The upper storage chamber 1 is opened and closed by a swinging door 4, and the center storage chamber 2 and the lower storage chamber 3 are opened and closed by the drawer 200. The center storage chamber 2 may be configured to be opened and closed by the swinging door 4.

The swinging door 4 may be hingedly coupled to the cabinet 100 in a swinging manner, and the swinging door 4 may rotate to open or close an opening to the upper storage chamber 1.

A display part 5 (or display) may be provided on a front surface of the swinging door 4 for outputting information. A variety of different information such as an operational state of the refrigerator or temperatures of each storage chamber (1, 2, and 3) may be displayed on the display part 5.

The display part 5 may include at least one of LCD, LED, and so on.

The drawer 200 may open and close in a sliding manner. In the embodiment described below, the drawer 200 may be provided at the lower storage chamber 3 and may open in a drawer manner.

The drawer 200 may include the front panel 210 and a storage bin 220 (or storage room).

The front panel 210 may be pushed into the storage chamber so that the open front of the lower storage chamber 3 is closed and shielded, and the front panel 210 may have an installation space therein.

The front panel 210 may be formed such that a metal thin plate is folded into multiple stages so as to have each wall surface (upper surface, opposite side surfaces, front surface, and lower surface). The front panel 210 may be provided with an inner frame therein, the inner frame 211 being formed of resin for reducing a weight of the front panel and improving productivity thereof. The front panel 210 may be formed of a material having metal texture.

The storage bin 220 may be provided at a rear of the front panel 210 and may be received in the lower storage chamber 3.

The storage bin 220 may be formed in a box-shaped body that is open upwardly, and a front surface of the storage bin 220 may be fixed to a rear surface of the front panel 210 in a close contact state therewith. The storage bin 220 and the front panel 210 may be coupled to each other by hook or bolt fastening, screw fastening, gearing, fitting, and so on.

Guide rails 230 may be respectively provided on opposite outside walls of the storage bin 220 and on opposite inner side walls of the lower storage chamber 3 (referring to FIG. 3). The inner side walls of the lower storage chamber 3 may face the outer side walls of the storage bin 220. The guide rails of the storage bin 220 and the guide rails of the lower storage chamber 3 may engage with each other and support forward and rearward movement of the storage bin 220.

Although not shown, the guide rails 230 may be respectively provided on a lower surface of the storage bin 220 and a bottom surface in the lower storage chamber 3, and the guide rails may engage with each other, where the bottom surface in the lower storage chamber 3 face the lower surface of the storage bin 220. The guide rails 230 may also be configured to extend into multiple stages.

A separate container 240 may be provided in the storage bin 220. That is, a variety of food may be stored in the storage bin 220, but the container 240 is in the storage bin 220 so that the food may be stored in the container 240. The container 240 may be a kimchi container or a basket to open upwardly.

When the storage bin 220 is pushed out from the lower storage chamber 3, the container 240 may move upward from the storage bin 220.

In order to raise the container 240 in the storage bin 220 by a user, it may be necessary to form a gap in which fingers of the user are inserted between the storage bin 220 and the container 240, so a size of the container 240 should be reduced by a size of the gap. Accordingly, the container 240 may automatically separate from the storage bin 220 in order that the size of the container 240 is maximized. When the container 240 is automatically separated from the storage bin 220, the user can easily take out the container 240.

Figure 4:
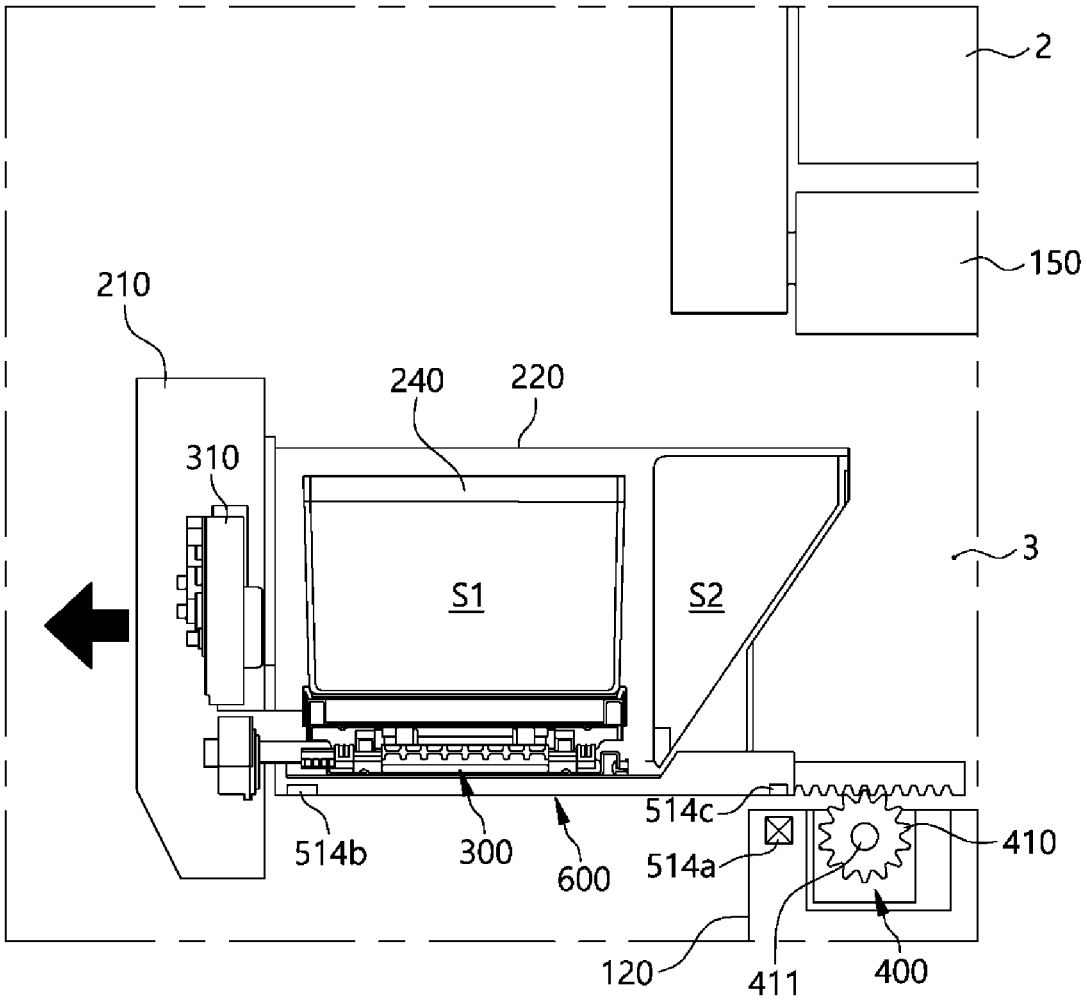
FIG. 4 is a view showing schematically a main part of the refrigerator having the drawer according to an embodiment of the present disclosure, wherein a drawer of the refrigerator is opened.
Figure 5:
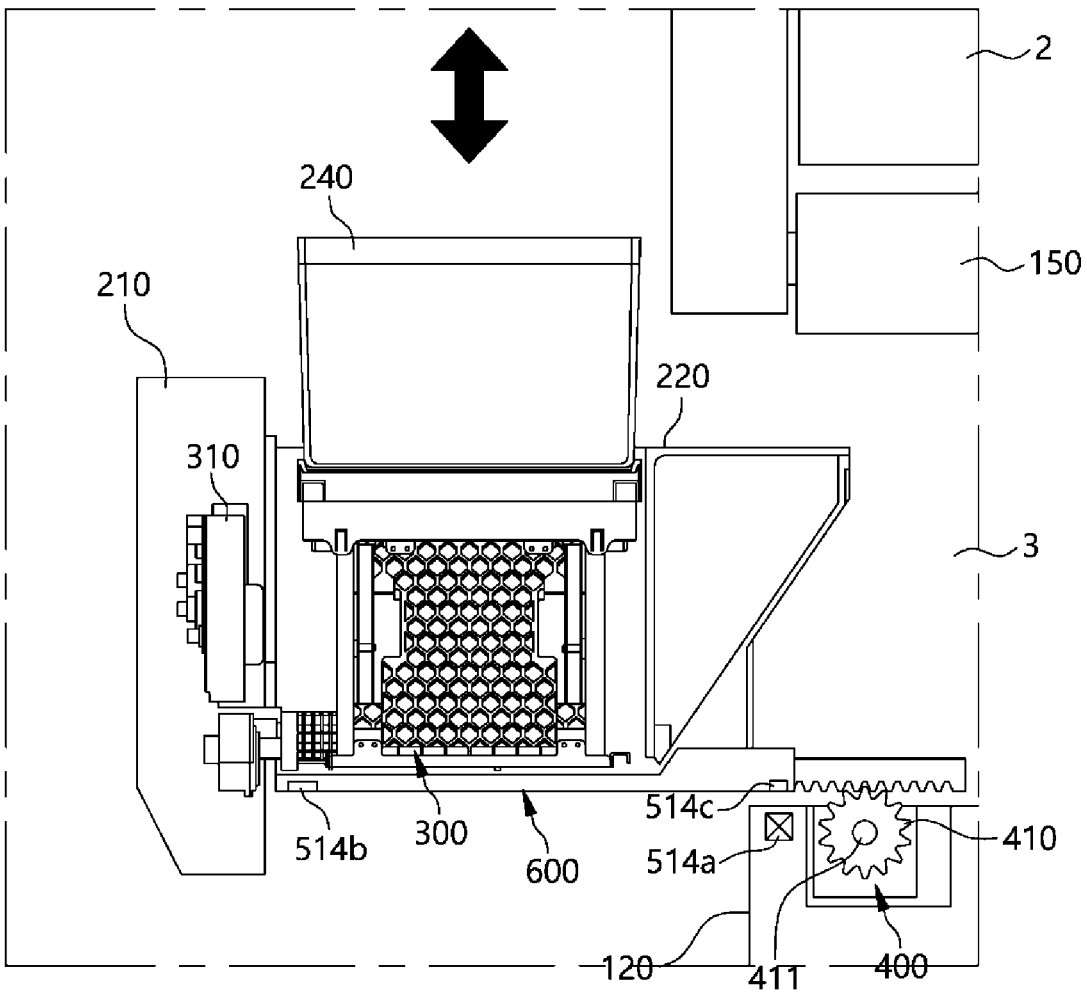
FIG. 5 is a view showing schematically a main part of the refrigerator having the drawer according to an embodiment of the present disclosure, wherein a container is raised upward when the drawer of the refrigerator is opened.

A raising/lowering module 300 (or lift module) may be provided in the storage bin 220 to automatically raise the container 240 (referring to FIGS. 4 and 5).

The raising/lowering module 300 may be embodied in various forms. For example, the raising/lowering module 300 may be formed in a scissors linkage structure, where the structure being minimized in height when the raising/lowering module is folded and maximized in height when the raising/lowering module is unfolded.

Electrical parts 310 (for example, drive motor, etc.) supplying a driving force for raising movement of the raising/lowering module 300 may be provided in the installation space in the front panel 210.

When the raising/lowering module 300 is operated before the storage bin 220 of the drawer 200 is fully pushed out, the container 240 or the cabinet 100 may be broke. Therefore, a control program may be programmed to operate the raising/lowering module only when the storage bin 220 is fully pushed out, the control program being programmed to control movement of the raising/lowering module 300.

The driving part 400 may provide a driving force for forward and rearward movement of the drawer 200.

The driving part 400 may be provided on the bottom 120 of the cabinet 100, and may include a pinion 410 and a driving motor 420.

Figure 9:
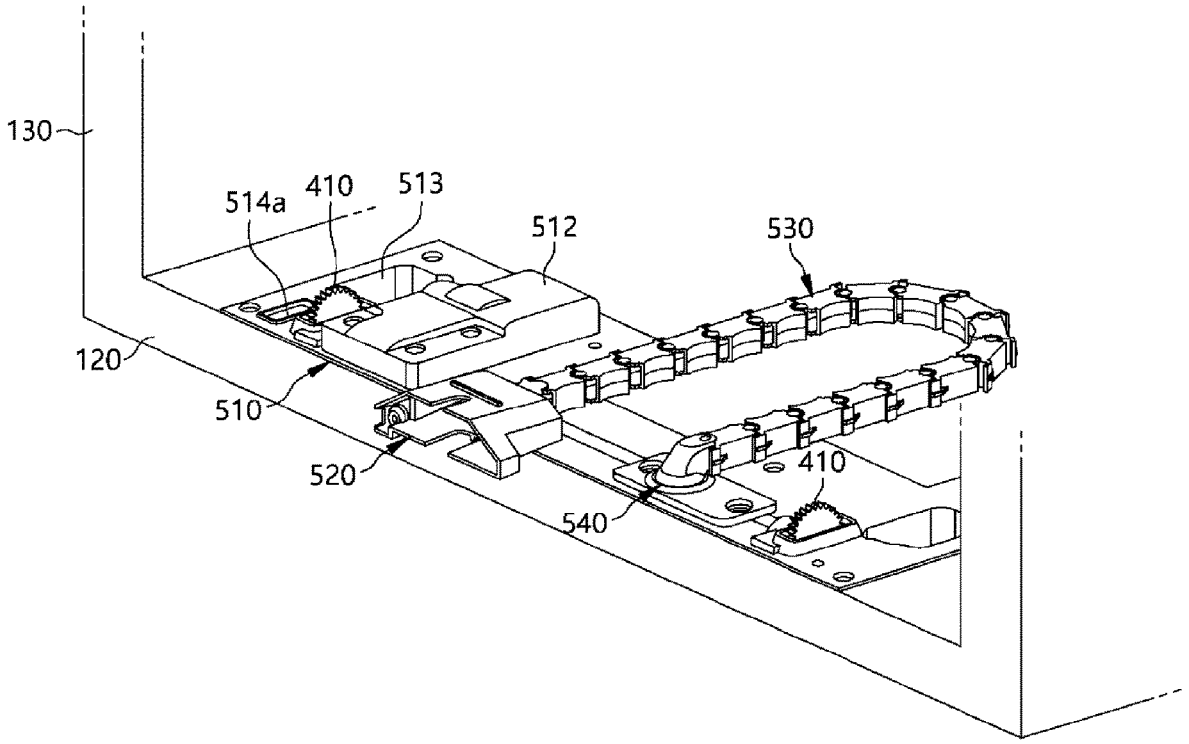
FIG. 9 is a perspective view showing an installation state of the cable guide module of the refrigerator having the drawer; the cable guide module according to an embodiment of the present disclosure being installed in a storage chamber.
Figure 10:
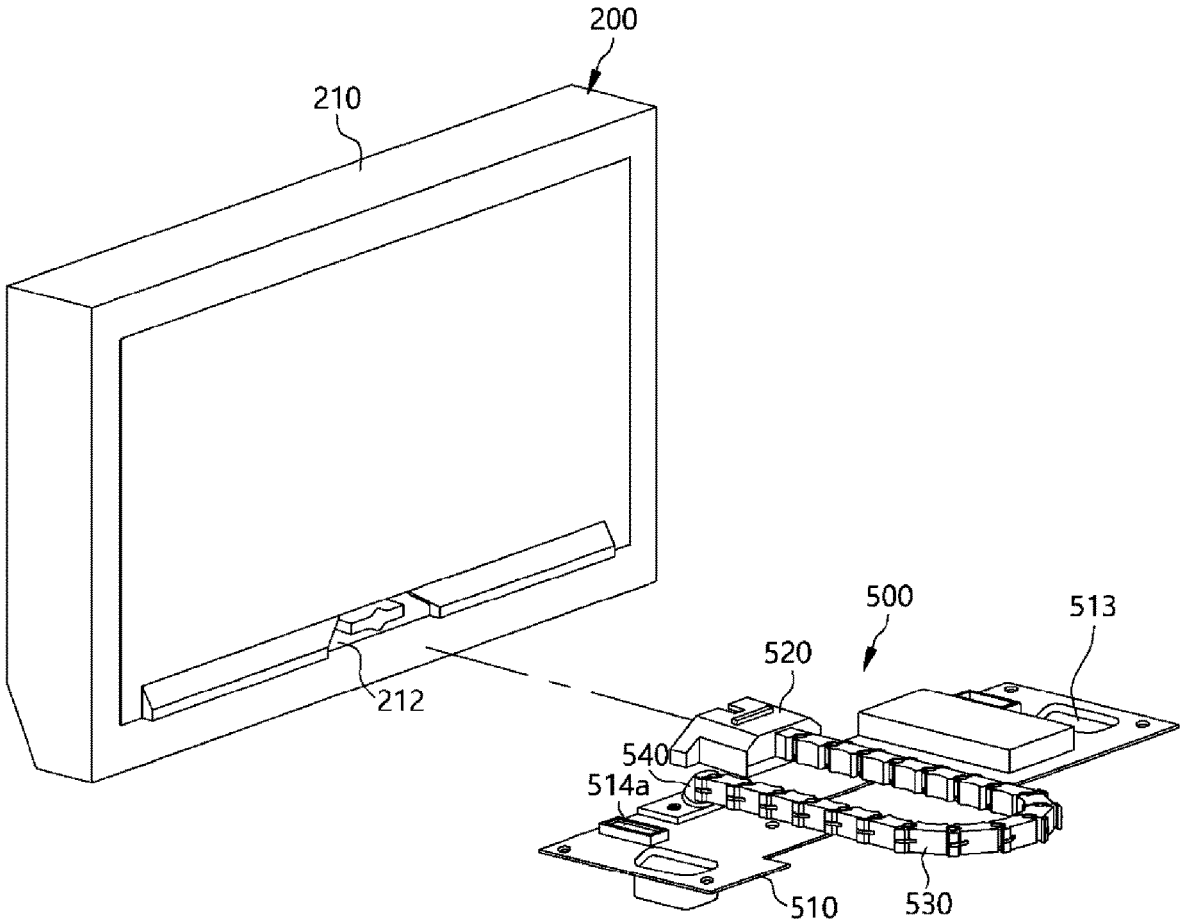
FIG. 10 is a perspective view showing the drawer taken at the rear side, wherein the cable guide module of the refrigerator having the drawer according to an embodiment of the present disclosure is connected to the drawer.

The pinion 410 may penetrate partially through the bottom surface (upper surface of the bottom) in the lower storage chamber 3 and may be exposed to the inside of the lower storage chamber 3 (referring to FIG. 9). The driving motor 420 may supply power to the pinion 410 while being fixed in the bottom 120 of the cabinet 100.

In an embodiment of the present disclosure, two pinions 410 may be respectively provided one by one on opposite sides of the bottom surface in the lower storage chamber 3. The two pinions 410 may be connected to each other by a power transmission shaft 411. The driving motor 420 may be connected to the power transmission shaft 411 by a belt, a chain, or a gear for supplying power thereto.

By the driving of the driving motor 420, the two pinions 410 may rotate at the same time with the same speed and direction.

A reduction gear may be provided in a connecting portion between the power transmission shaft 411 and the driving motor 420.

The two pinions 410 may be positioned at foremost sides of the bottom surface in the lower storage chamber 3. Thus, the drawer may open to a maximum.

The driving motor 420 may operate when proximity of the user is sensed, or may operate when a button 6 is manipulated by the user.

The button 6 may be a touch-type button provided on the display part 5 of the swinging door 4. The button 6 may also be a pressure-type button provided on a separate position from the display part 5.

Figure 6:
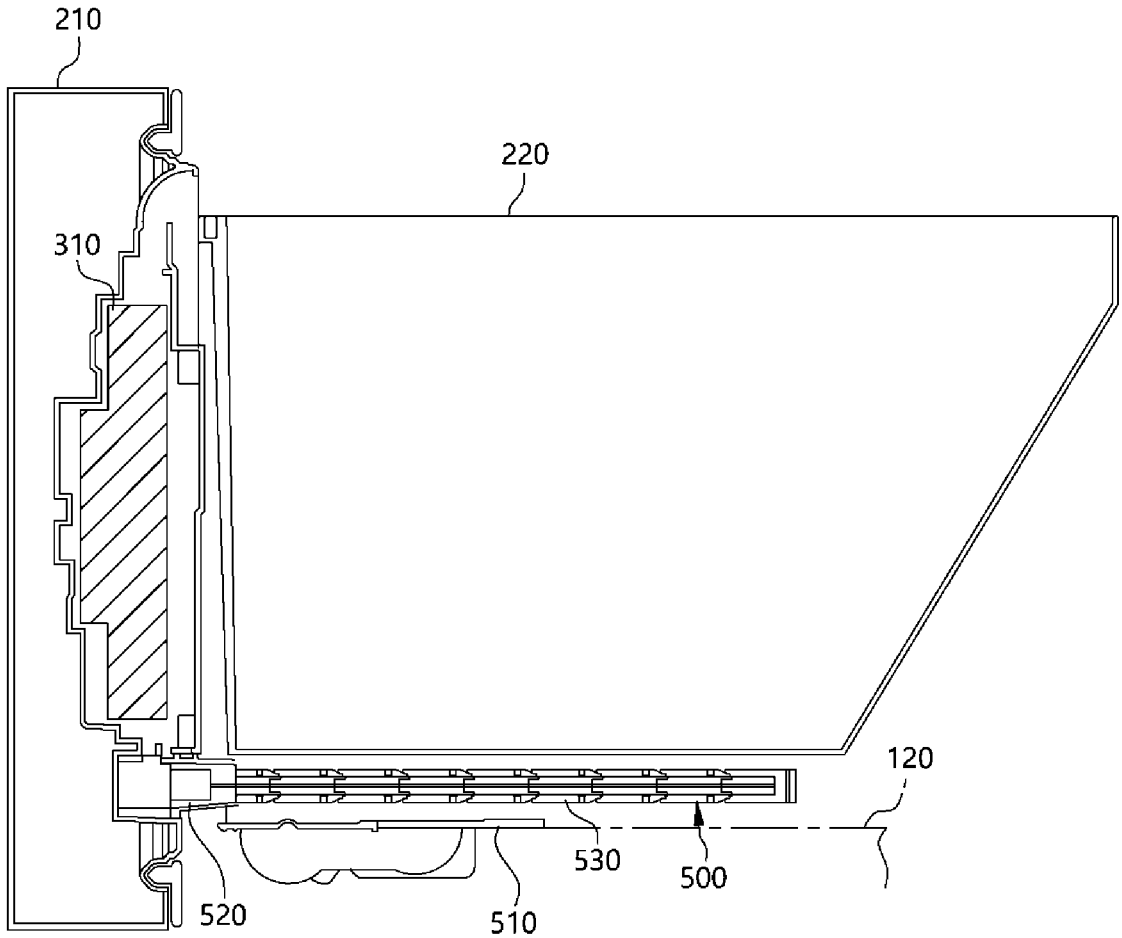
FIG. 6 is a side view showing the drawer of the refrigerator having the drawer according to an embodiment of the present disclosure, the drawer being equipped with a cable guide module.

A cable guide module 500 may be connected to the bottom surface (upper surface of the bottom) in the lower storage chamber 3 and to the front panel 210 (referring to FIG. 6).

The cable guide module 500 may protect a power line and cables (hereinafter referred to as cables), which are connected to the electrical parts in the front panel 210 among various power lines and cables connected along the inside of the bottom 120.

The cable guide module 500 is configured to guide the cables to move with forward and rearward movements of the drawer 200, and to prevent the cables from being damaged due to twisting and scraping.

The cable guide module 500 may include a cover plate 510, a guiding head 520, a plurality of connecting members 530 (or connection segments), a swinging connection member 540 (or swinging connection base), and a mounting plate 550, as shown in FIGS. 7 to 10.

The cable guide module 500 may be described in detail on a per component basis.

The cover plate 510 of the cable guide module 500 is a part coupled to the upper surface of the bottom 120.

A part of a front upper surface of the bottom 120 may be formed to be open, and the cover plate 510 may be coupled to the bottom 120 and cover the open part thereof.

Figure 7:
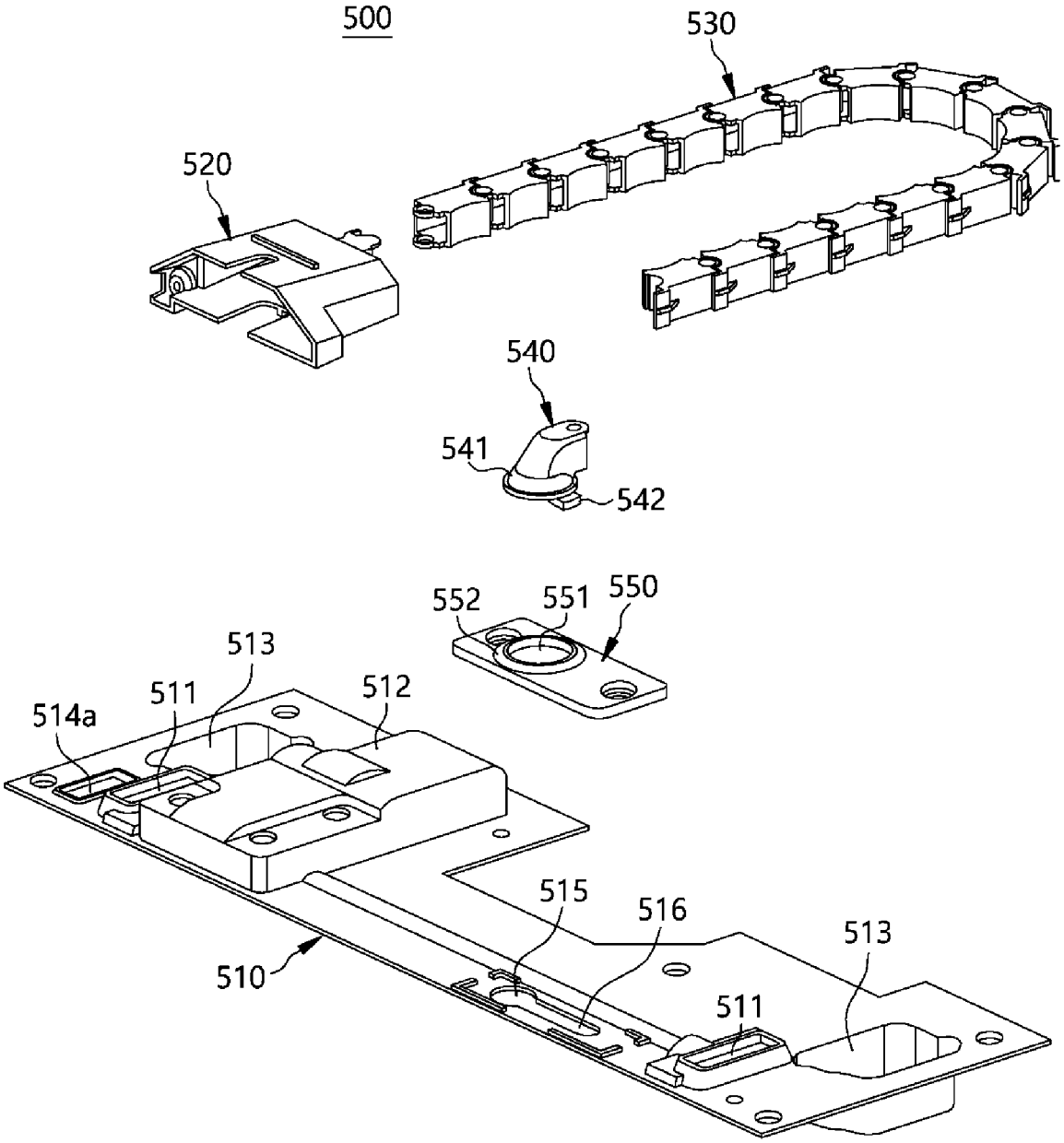
FIG. 7 is an exploded-perspective view showing the cable guide module of the refrigerator having the drawer according to an embodiment of the present disclosure.
Figure 8:
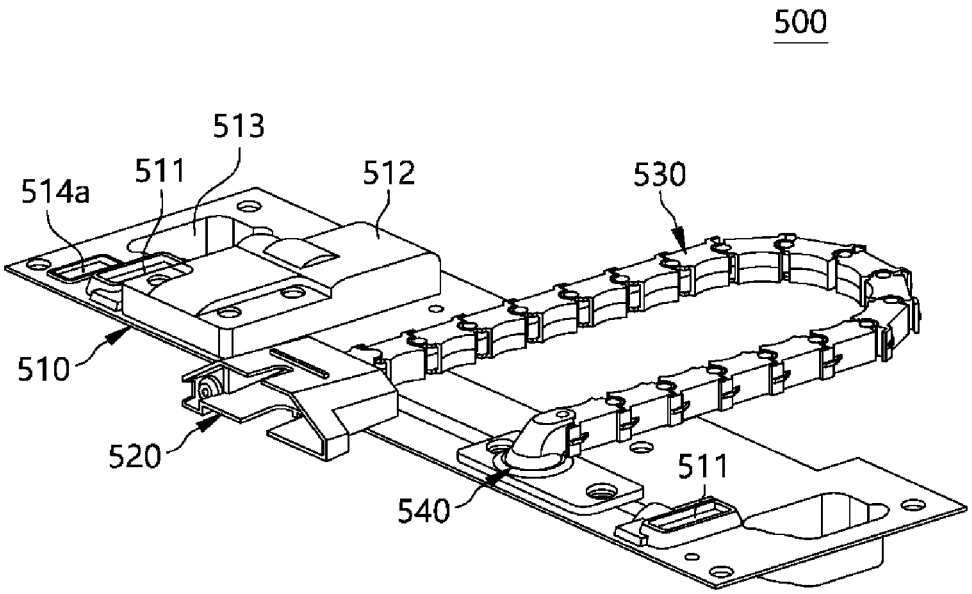
FIG. 8 is a perspective view showing a coupled state of the cable guide module of the refrigerator having the drawer according to an embodiment of the present disclosure.

Two pinion exposure holes 511 may be respectively provided on opposite sides of the cover plate 510 in a penetrating manner so that the pinions 410 of the driving part 400 are exposed (referring to FIGS. 7 and 8).

The cover plate 510 may be provided with a motor receiving part 512 that receives the driving motor 420 (included in the driving part 400) (referring to FIG. 7). The motor receiving part 512 may protrude from a part of the cover plate 510 that protrudes upward, or may be formed separately from the cover plate 510 and then is coupled to the cover plate 510. Although not shown, the motor receiving part 512 may be formed in different forms or manners.

Two protrusion passing holes 513 may be respectively formed through opposite sides in rear of the cover plate 510, and each protrusion passing holes 513 being for installation of a confining protrusion part 650, which may be described below. An upper end of the confining protrusion part 650 may be exposed toward the inside of the lower storage chamber 3 while the confining protrusion part 650 may be accommodated in the protrusion passing hole 513. The confining protrusion part 650 may be described below in a description about rack gear assemblies 601 and 602.

An open/close sensing part 514 (or sensing device) may be provided at a bottom in the storage chamber and the drawer that is opposed thereto to sense opening and closing of the drawer 200 (referring to FIGS. 4 and 5). That is, as the open/close sensing part 514 is provided, it may accurately check whether the drawer 200 is fully closed or partially opened.

The open/close sensing part 514 may include a sensor 514*a* and a sensing member 514*b*. The sensor 514*a* may be a hall sensor, and the sensing member 514*b* may be a magnet that is sensed by the hall sensor. The open/close sensing part 514 may be provided in various structures such as an optical sensor, a switch, and so on.

The sensor 514*a* (of the open/close sensing part 514) may be provided at the bottom in the lower storage chamber 3, and the sensing member 514*b* may be provided at the lower surface of the storage bin 220 (constituting the drawer 200). Although not shown, the sensing member 514*b* may be provided at the bottom in the lower storage chamber 3, and the sensor 514*a* may be provided at the lower surface of the storage bin 220, or the sensor 514*a* may be provided at any one side wall surface in the lower storage chamber 3 and the sensing member 514*b* may be provided at a wall surface of the storage bin 220, where the wall surface of the storage bin faces the sensor.

The sensor 514*a* may be provided at the cover plate 510 positioned at the bottom in the lower storage chamber 3, so that maintenance of the cover plate 510 can be performed through removal thereof.

Further, in an end of a lower surface of a rack gear assembly 600, a separate sensing member 514*c* may be provided so that the sensor 514*a* senses the full opening of the drawer 200 when the rack gear assembly 600 is fully pushed out.

The open/close sensing part 514 may be configured to influence operation control of the driving part 400.

That is, when the open/close sensing part 514 senses closing of the drawer 200, the open/close sensing part 514 is configured so that the driving motor 420 performs additional operation from the sensing time by a predetermined time or a predetermined number of rotations, and then deactivates the operation.

When the open/close sensing part 514 senses the closing of the drawer 200, the driving motor 420 is programmed to perform additional drive by at least one pitch of a rack gear 611 of a first rack member 610, and then to deactivate the driving.

When left and right sides of the drawer 200 are moved obliquely instead of parallel so that any one side of the drawer 200 reaches a closing position thereof earlier than the other side, although the other side is not closed, the sensor 514*a* (of the open/close sensing part 514) may determine that the drawer 200 is closed.

That is, even when one side of the drawer 200 is closed earlier than the other side, the other side may moved further by a distance of at least one pitch of the rack gear 611 from this time, so that the opposite sides of the drawer 200 may be closed.

The pinion 410 may rotate additionally by only two rotations or less. More preferably, the pinion 410 may rotate additionally by only one rotation. This may prevent damage to the pinion 410 or the rack gear 611 caused when the pinion 410 is excessively rotated more than necessary.

Even when the pinion 410 is rotated one or two rotations, the pinion 410 or the rack gear 611 may be damaged.

However, considering that a packing member is provided between contact surfaces of the drawer 200 and the cabinet 100, even when the pinion 410 is rotated additionally by a buffering distance of the packing member, the pinion 410 and the rack gear 611 may not be damaged. When deactivation of the driving motor 420 operating the pinion 410 is performed, as the pinion 410 is reversibly rotated by the additional rotation by a buffering force of the packing member and a movement force by the excessive rotation, the opposite sides of the drawer 200 may be precisely closed without causing gear damage.

The guiding head 520 of the cable guide module 500 is a part coupled to the front panel 210.

An installation hole 212 may be provided on a center lower portion of the rear surface of the front panel 210 (referring to FIG. 10), and the guiding head 520 may pass partially into the installation hole 212 and may be coupled to the rear surface of the front panel 210.

A plurality of connecting members 530 may be provided as a cable housing. Each of the connecting members 530 of the cable guide module 500 connects the swinging connection member 540 and the guiding head 520 to be moveable.

The connecting member 530 may be configured as a hollow tubular body and is connected to another connecting member 530 continuously. The cables may be provided to pass sequentially inside the connecting members 530 in order. The connection structure of the connecting member 530 may be a chain linkage structure.

A connected portion between each of the connecting members 530 may be provided to swing in a horizontal direction. A first end of the connecting member 530 may be connected to the swinging connection member 540 in a swinging manner, and a second end of the connecting member 530 may be connected to the guiding head 520 in a swinging manner. Through the structure, when the drawer 200 is moved forward and rearward, the connecting members 530 may move in conjunction with movement of the drawer 200 to move the cables.

The swinging connection member 540 (of the cable guide module 500) may be rotatably connected to the cover plate 510.

A cable through-hole 515 may be provided on the cover plate 510 so that the cables pass therethrough, and the swinging connection member 540 may have a pipe structure and one end thereof is in close contact with an upper surface of the cover plate 510. On the end of the swinging connection member 540, an extension end 541 may be a dome structure extending gradually toward the end.

An extension hole 516 may be provided at a predetermined position on a circumference of the cable through-hole 515. On a circumference of the extension end 541 constituting the swinging connection member 540, a confining protrusion 542 may protrude outwards and pass through the extension hole 516.

The extension hole 516 may be provided to have a width through which only the confining protrusion 542 may pass. That is, as the confining protrusion 542 passes through the extension hole 516 and then a manipulation in which the swinging connection member 540 is partially rotated is performed, the swinging connection member 540 may be maintained in a state of preventing separation from the cable through-hole 515 of the cover plate 510.

The mounting plate 550 of the cable guide module 500 may be provided to prevent the swinging connection member 540 connected to the cover plate 510 from being separated from the cover plate 510.

The mounting plate 550 may be fixedly coupled to the cover plate 510, and may be provided with a communicating hole 551 and a covering end 552. The communicating hole 551 is provided on a portion corresponding to the cable through-hole 515, and with the covering end 552 protruding from a circumference of the communicating hole 551 to cover the extension end 541 of the swinging connection member 540. An inner surface of the covering end 552 may have the same spherical surface as an outer surface of the extension end 541 so that the covering end 552 and the extension end 541 are in close contact with each other.

The rack gear assemblies 601 and 602 of the refrigerator provided with the drawer may be described.

The rack gear assemblies 601 and 602 may be provided to allow the drawer 200 to be moved forward and rearward by a driving force of the driving part 400 provided in the cabinet 100.

The rack gear assemblies 601 and 602 may be respectively provided on opposite sides of the lower surface of the storage bin 220 (constituting the drawer 200). As the rack gear assemblies 601 and 602 have rack gears 611 and 621 on lower surfaces thereof, the rack gear assemblies 600 may engage with the pinions 410 (such as first and second pinions) that are exposed to the inside of the lower storage chamber 3.

The rack gears 611 and 621 (of the rack gear assemblies 601 and 602) may extend from a front side of the lower surface of the storage bin 220 to a rear side thereof. Thus, the drawer 200 provided with the rack gear assemblies 601 and 602 may push out and push in from the lower storage chamber 3 while being moved forward and rearward by rotation movement of the pinions 410.

The pinions 410 and the rack gear assemblies 601 and 602 may be respectively made in pairs of at least three pinions and at least three rack gear assemblies.

As an automatic pushing-out distance of the storage bin 220 is increased, usability of the drawer 200 may improve.

That is, as a storage space in the storage bin 220 is maximally moved in the opposite direction from the lower storage chamber 3, the drawer 200 may be provided such that it is easy to store the container 240 in the storage bin 220, or to store items and food in the storage space.

The container 240 may be automatically raised by the raising/lowering module 300 when the drawer 200 is opened. Thus, the storage bin 220 may be maximally separated from the lower storage chamber 3.

For that, the two pinions 410 may be positioned on a portion of the front side of the lower storage chamber 3, and lengths of the rack gears 611 and 621 may be maximally long.

As the two pinions 410 are positioned close to a portion of the front side of the lower storage chamber 3 and the rack gears 611 and 621 have the long lengths, the pushing-out distance of the storage bin 220 may increase.

However, a front to rear length of the lower surface of the storage bin 220 may be formed shorter than an open upper surface of the storage bin 220. In view of that, the rack gears 611 and 621 may have limited lengths.

Accordingly, the rack gear assemblies 600 may be configured to extend in lengths thereof, thereby increasing the pushing-out distance of the storage bin 220.

That is, even when the front to rear length of the storage bin 220 is short, the lengths of the rack gear assemblies 601 and 602 extend, thereby allowing the storage bin 220 to be pushed further out.

Therefore, each of the rack gear assemblies 601 and 602 may include a first rack member 610 (a first rack) and a second rack member 620 (a second rack), a first rack cover 614, a second rack cover 624, the idle gear 630, the confining protrusion part 650, and a confining module 670 that are pushed out while being moved forward in order.

The rack gear assembly 601 and 602 may be described in detail by each part as follows.

The first rack member 610 (or first rack) may perform forward and rearward movement of the storage bin 220 by rotation of the pinion 410, and the first rack member 610 may have a rack gear 611.

The first rack member 610 may be provided such that an upper surface thereof is fixed to the lower surface of the storage bin 220 while being in close contact thereto. A plurality of coupling holes 612 may be provided on the first rack member 610, and the first rack member 610 may be attached to the storage bin 220 by screw fastening through the coupling holes 612.

The second rack member 620 may be at a lower surface of the first rack member 610, and thus the first rack member 610 may have a movement guiding groove 613 that is formed in a depressed manner and may support sliding movement of the second rack member 620.

The movement guiding groove 613 may be provided in the depressed manner from a front end portion of the first rack member 610 and formed by penetrating through a rear surface of the first rack member 610. That is, the second rack member 620 received at the movement guiding groove 613 may be exposed to the rear of the movement guiding groove 613.

The rack gear 611 of the first rack member 610 may be provided on any one side (one side in the opposite direction between two rack gear assemblies) of the movement guiding groove 613 along a longitudinal direction of the first rack member 610 in which the rack gear 611 is included.

The rack gear 611 may be be further forward than the movement guiding groove 613.

The first rack member 610 may include a first rack cover 614.

The movement guiding groove 613 provided in the first rack member 610 may have an inside portion that is open vertically so that a holder 672 and a locking member 673, which are included in the confining module 670, may pass through the movement guiding groove 613. The first rack cover 614 may cover the upper surface of the first rack member 610 by being coupled thereto, so that a lower surface of the first rack cover 614 covers an open portion of the movement guiding groove 613 provided on the first rack member 610 and is provided as an upper surface in the movement guiding groove 613.

The first rack cover 614 may be formed of a metal plate to reinforce insufficient strength of the first rack member 610.

The lower surface (upper surface in the movement guiding groove) of the first rack cover 614 may include receiving grooves **614*a* and 614*b* in which the holder 672 and the locking member 673 (of the confining module 670**) are respectively received.

The receiving grooves **614*a* and 614*b* may include a first receiving groove 614*a* for receiving the holder 672 and a second receiving groove 614*b* for receiving the locking member 673. The two receiving grooves 614*a* and 614*b* are spaced apart from each other in a moving direction of the first rack member 610. A spaced distance between a rear surface of the first receiving groove 614*a* and a rear surface of the second receiving groove 614*b* is longer than a spaced distance between a rear surface of the holder 672 and a rear surface of the locking member 673**.

The receiving grooves **614*a* and 614*b* are configured such that the holder 672 is firstly received into the first receiving groove 614*a* and then the locking member 673 is received into the second receiving groove 614*b***.

Unlike the above-described embodiment, the first rack cover 614 and the first rack member 610 may be provided as a single body through an injection molding manner.

However, when the first rack member 610 and the first rack cover 614 are configured as the single body, it may be difficult for the injection molding thereof. That is, the first rack member 610 and the first rack cover 614 may be different in shapes and directions at uneven portions thereof, so that the injection molding thereof is difficult.

Accordingly, as shown in the embodiment, the first rack member 610 and the first rack cover 614 may be separately manufactured and then coupled to each other.

The second rack member 620 may perform the forward and rearward movement of the storage bin 220 together with the first rack member 610.

The second rack member 620 may be inserted in the movement guiding groove 613 of the first rack member 610. When the first rack member 610 is moved by a preset distance, the second rack member 620 is moved forward by leading of the first rack member 610 and receiving rotational force of the pinion 410. As the second rack member 620 is continuously moved forward by the rotational force of the pinion 410, the first rack member 610 may be further pushed out even when the rack gear 611 of the first rack member 610 is separated from the pinion 410.

The first rack member 610 may lead the second rack member 620 through a linkage part 680 so that the second rack member 620 is moved.

The linkage part 680 may include a linkage protrusion 681 and a linkage step 682, the linkage protrusion 681 being provided on the lower surface (lower surface in the movement guiding groove) of the first rack cover 614 and the linkage step 682 being provided on an upper surface of the second rack member 620. When the first rack member 610 is moved forward by the preset distance, the linkage protrusion 681 and the linkage step 682 are in contact with each other to perform forward movement of the second rack member 620.

The linkage protrusion 681 may be provided on the first rack member 610. The linkage protrusion 681 may be provided on the upper surface of the second rack member 620 and the linkage step 682 may be provided on a lower surface of the first rack member 610.

When the second rack member 620 is fully inserted into the movement guiding groove 613 of the first rack member 610, a spaced distance between the linkage protrusion 681 and the linkage step 682 may be a distance that is set such that the first rack member 610 is moved forward without affecting the second rack member 620. The preset distance may be determined based on a size or a total pushing-out distance of the storage bin 220.

The second rack member 620 may be provided with a rack gear 621. The rack gear 621 is formed alongside a side portion of the rack gear 611 of the first rack member 610. A front end of the rack gear 621 is provided to be further rearward than a front end of the rack gear 611 of the first rack member 610, and a rear side end thereof is provided to further extend to the rear side than a rear side end of the rack gear 611 of the first rack member 610.

The rack gears 611 and 621 of the first rack member 610 and the second rack member 620 may easily receive the driving force of the pinions 410, respectively. That is, since the pinions 410 have the width that is a size of adding a width of the rack gear 611 (of the first rack member 610) and the rack gear 621 (of the second rack member 620), each of the rack gears 611 and 621 may efficiently receive the driving force of the pinions 410.

A motion groove 622 may be provided on a front lower surface of the second rack member 620 in a depressed manner. The motion groove 622 may provide a motion space in which a stopper member 671 of the confining module 670 is moved forward and rearward in a mounted state.

The motion groove 622 may be provided with a plurality of through holes 622*a* and 622*b* in an upward penetrating manner. The through holes 622*a* and 622*b* may include a first through hole 622*a* through which the holder 672 passes and a second through hole 622*b* through which the locking member 673 passes. The holder 672 and the locking member 673 are part of the confining module 670 and may be described below.

The second through hole 622*b* may be a horizontally long hole so that forward and rearward movement of the locking member 673 may be performed.

A second rack cover 624 may be provided at a lower surface of the second rack member 620. The second rack cover 624 may cover the lower surface of the second rack member 620.

The second rack cover 624 may prevent the stopper member 671, mounted to the motion groove 622 of the second rack member 620, from being separated to the outside.

The second rack cover 624 may be formed of a metal plate and may cover the lower surface of the second rack member 620. Thus, deformation such as torsion or bending of the second rack member 620 may be prevented. The second rack cover 624 may be provided with a partially open portion for reducing the weight thereof.

The second rack cover 624 may be provided with folded ends 624*a* in a folded manner on opposite side surfaces and a rear surface thereof. The folded ends 624*a* may cover parts of the opposite side surfaces and the rear surfaces of the second rack member 620 to prevent flexural deformation of the second rack member 620.

The second rack cover 624 may include a stopper exposure hole 624*b* on a front end portion thereof, and the stopper member 671 may be partially exposed through the stopper exposure hole 624*b*.

The idle gear 630 may be provided so that opposite sides of the drawer 200 are fully closed even when the drawer 200 is closed obliquely, rather than horizontally.

The idle gear 630 may include a gear to engage with the pinion 410 and to allow the pinion 410 to be idle. The idle gear 630 may be provided at any one rack gear assembly of the rack gear assemblies 601 and 602.

In an embodiment of the present disclosure, the idle gear 630 may be provided only in the rack gear assembly 602 (hereafter referred to as the release rack gear assembly) that is positioned on a right side when the drawer 200 is viewed from the bottom.

Although not shown, the idle gear 630 may be provided at a left side rack gear assembly 601 (hereafter referred to as general rack gear assembly).

However, considering that the driving motor 420 (constituting the driving part 400) is operated such that the rack gear assembly is further moved by a predetermined distance when closing of the drawer 200 is sensed, even when the idle gear 630 is provided at either one of the sides, and the opposite sides of the drawer 200 may be closed horizontally.

Figure 11:
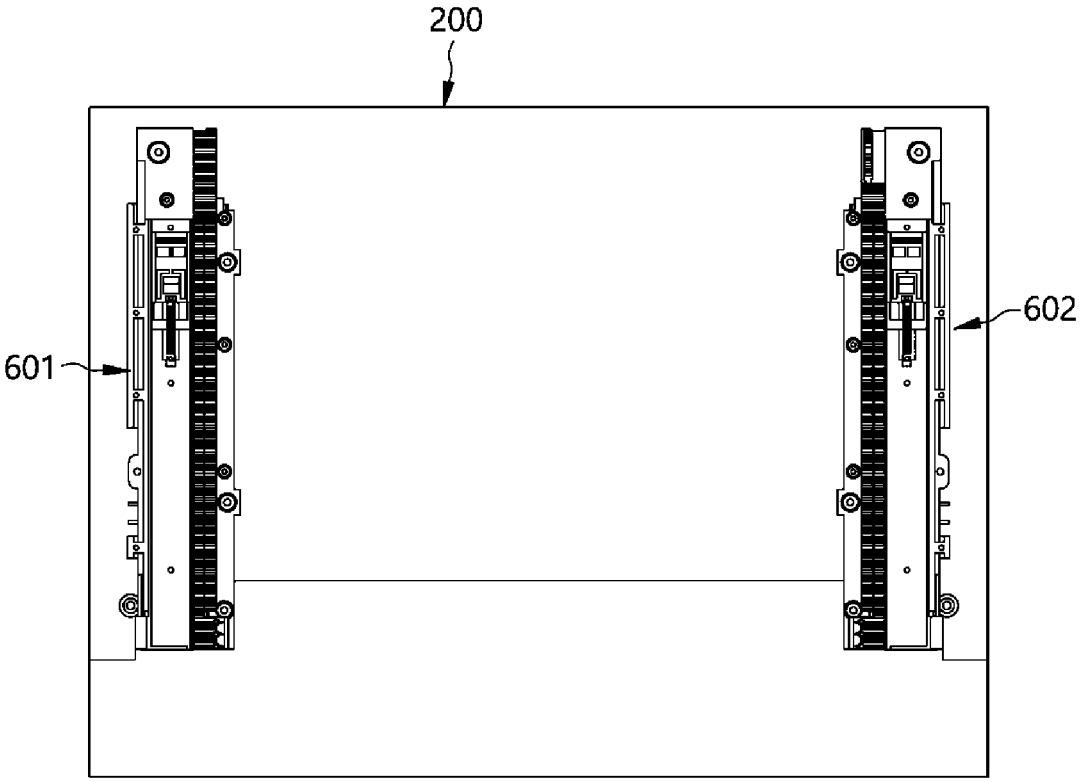
FIG. 11 is a bottom view of the refrigerator having the drawer showing a state in which a rack gear assembly is installed therein.
Figure 12:
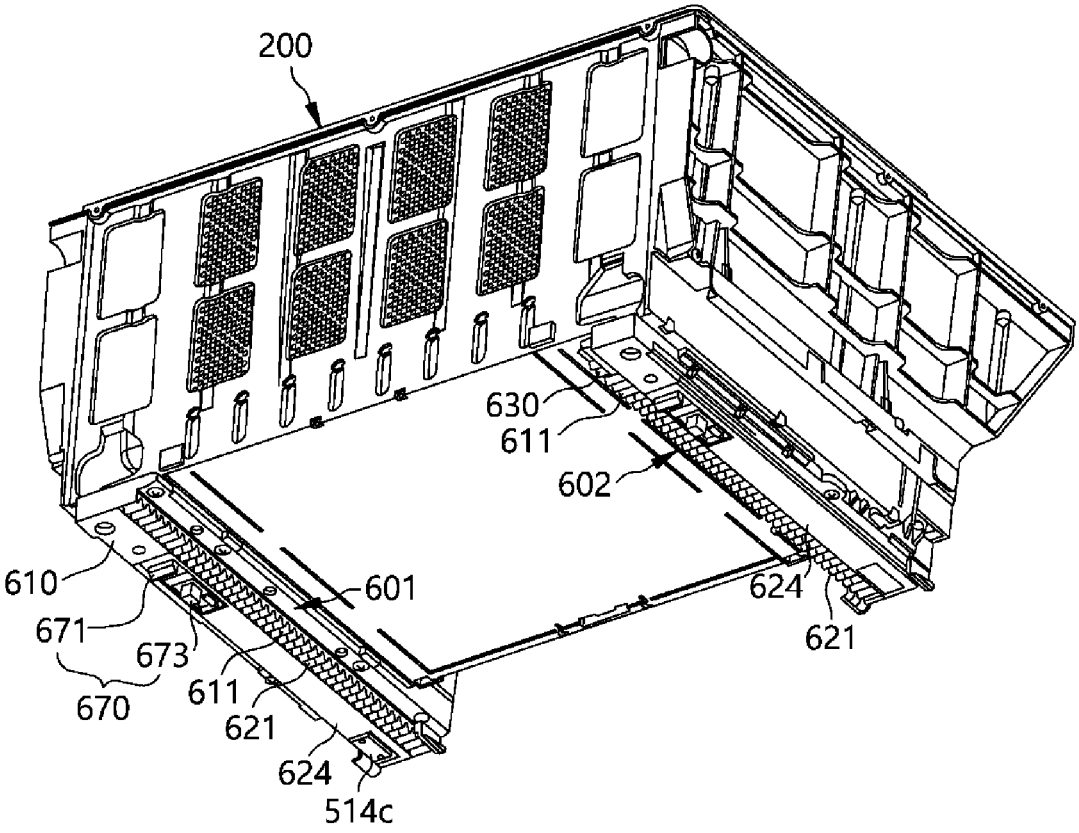
FIG. 12 is a perspective view showing the rack gear assembly according to an embodiment of the present disclosure is installed in the refrigerator having the drawer, the view being taken at a lower portion thereof.
Figure 13:
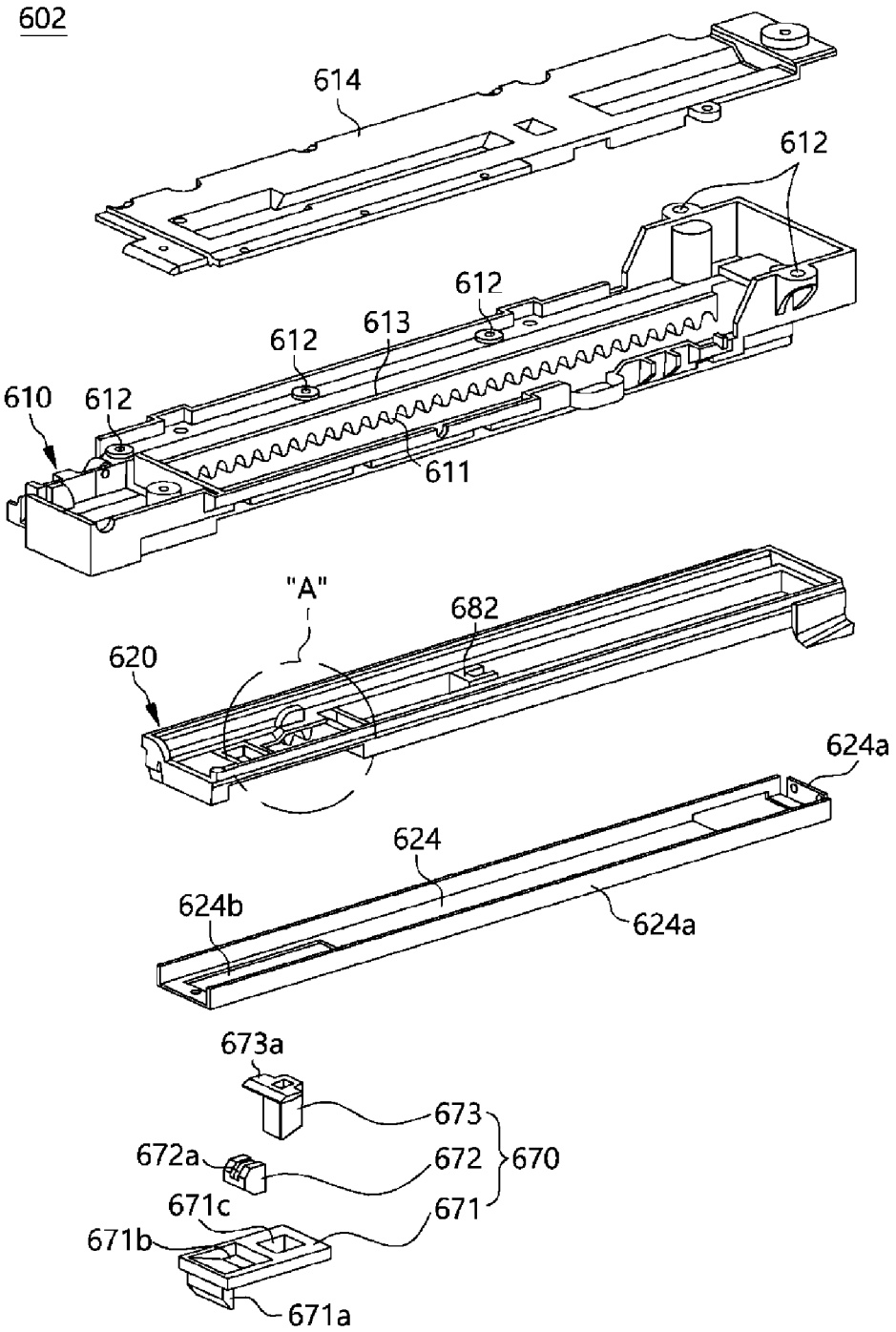
FIG. 13 is an exploded-perspective view showing the rack gear assembly of the refrigerator having the drawer according to an embodiment of the present disclosure from above.
Figure 14:
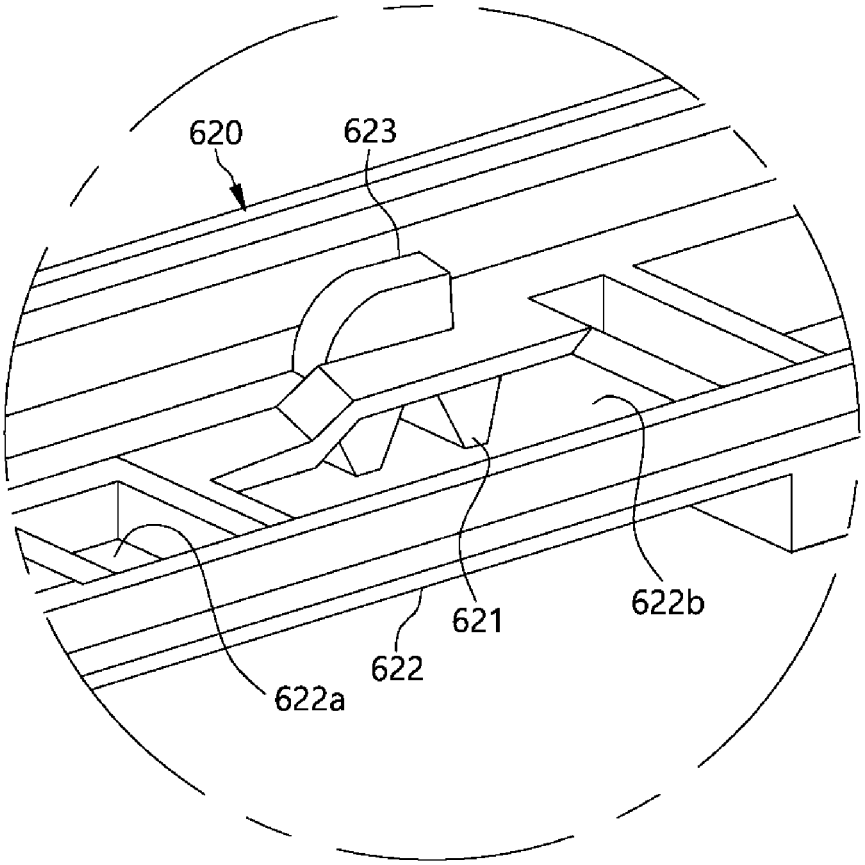
FIG. 14 is an enlarged view of "A" part in FIG. 13.
Figure 15:
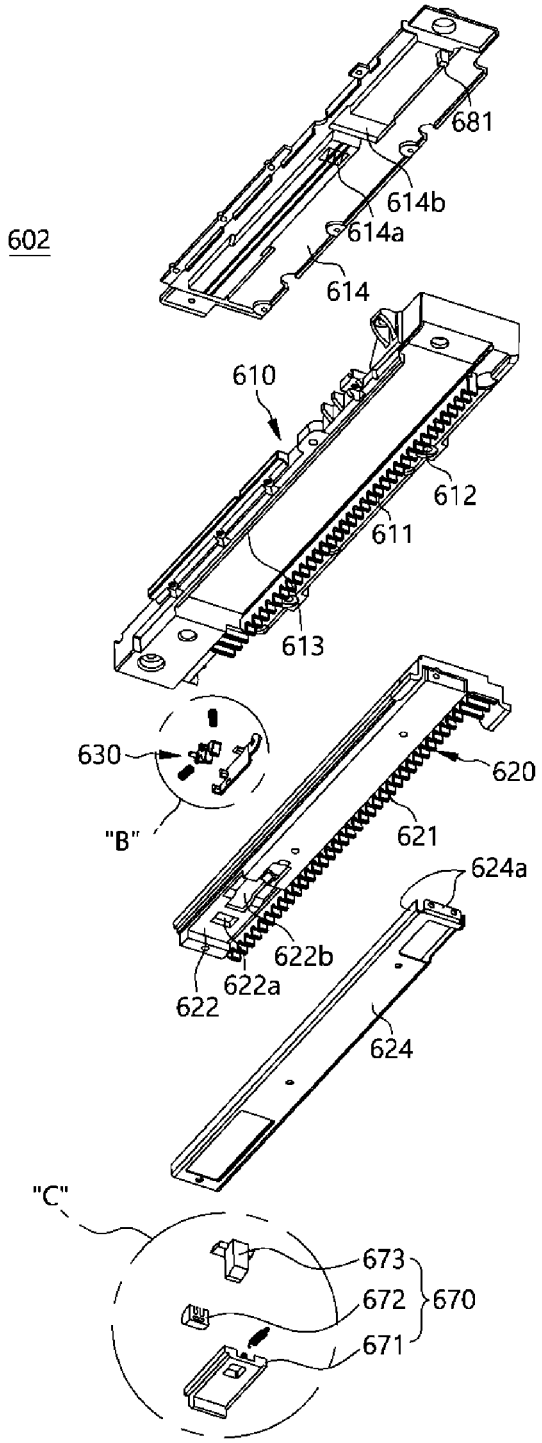
FIG. 15 is an exploded-perspective view from the bottom, the view showing the rack gear assembly of the refrigerator having the drawer according to an embodiment of the present disclosure.
Figure 16:
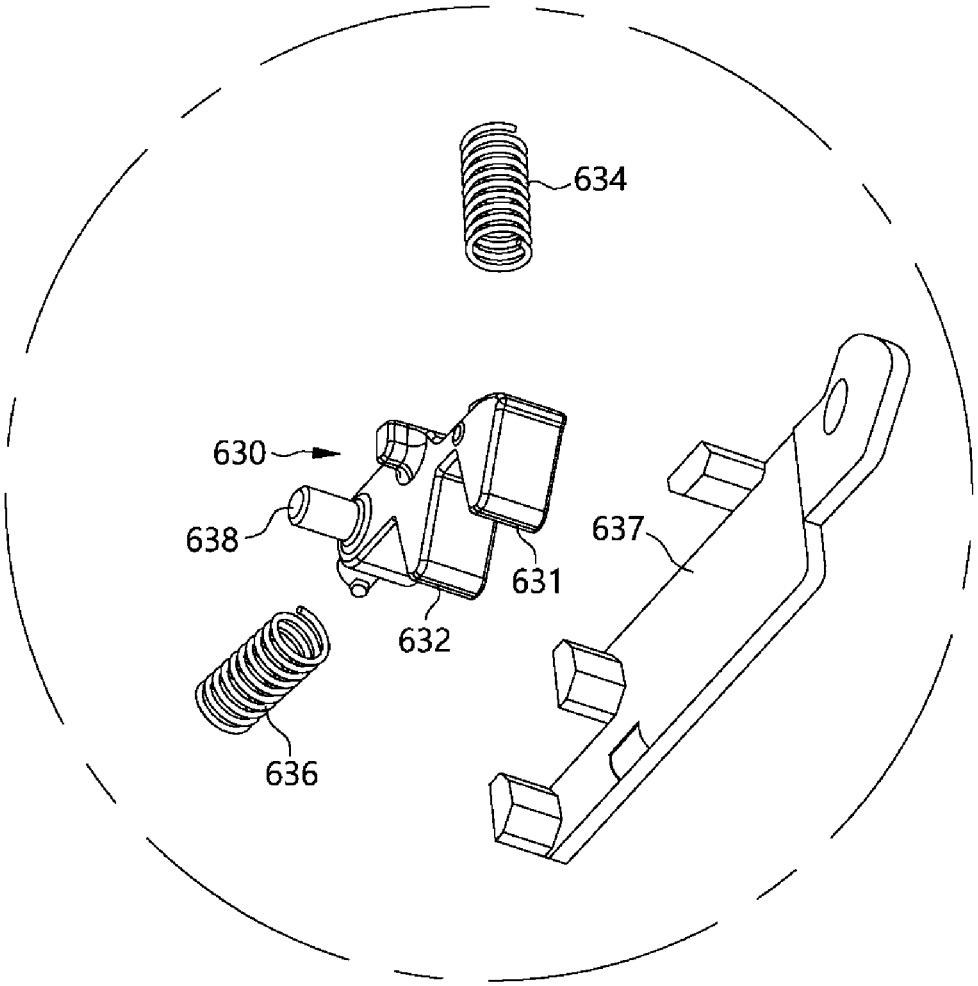
FIG. 16 is an enlarged view of "B" part in FIG. 15 for showing an idle gear of the refrigerator having the drawer according to an embodiment of the present disclosure.
Figure 17:
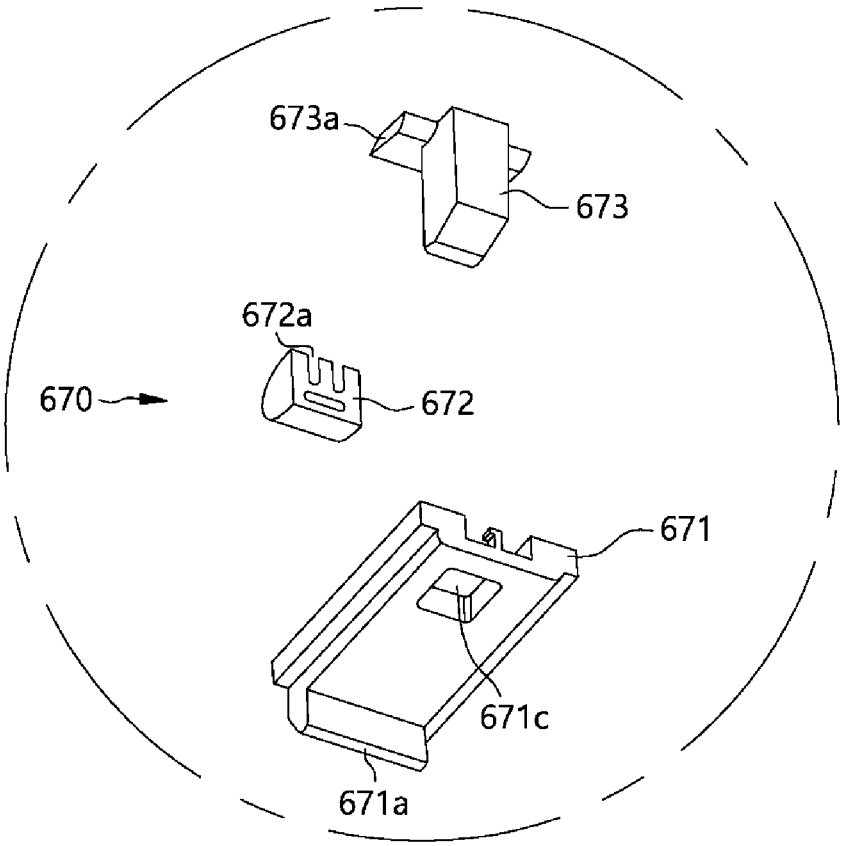
FIG. 17 is an enlarged view of "C" part in FIG. 15, the view showing a confining module of the refrigerator having the drawer according to an embodiment of the present disclosure.
Figure 18:
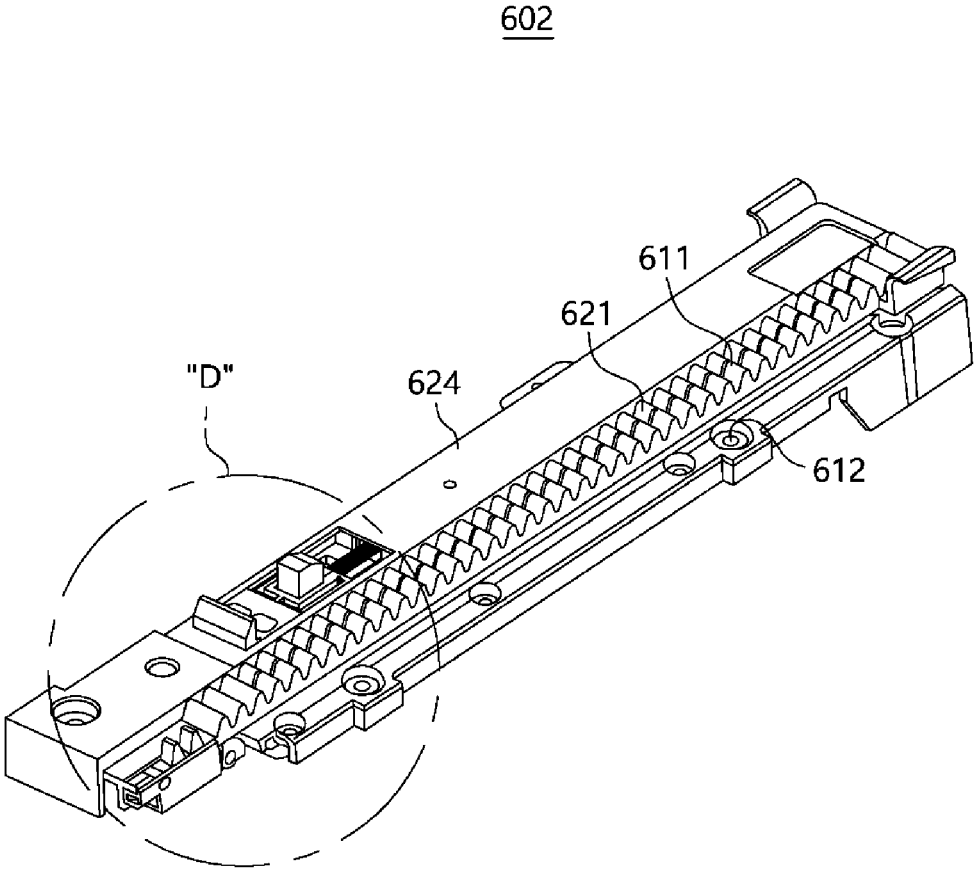
FIG. 18 is a perspective view showing the rack gear assembly of the refrigerator having the drawer according to an embodiment of the present disclosure, the rack gear assembly being overturned for showing a lower surface side structure thereof.
Figure 19:
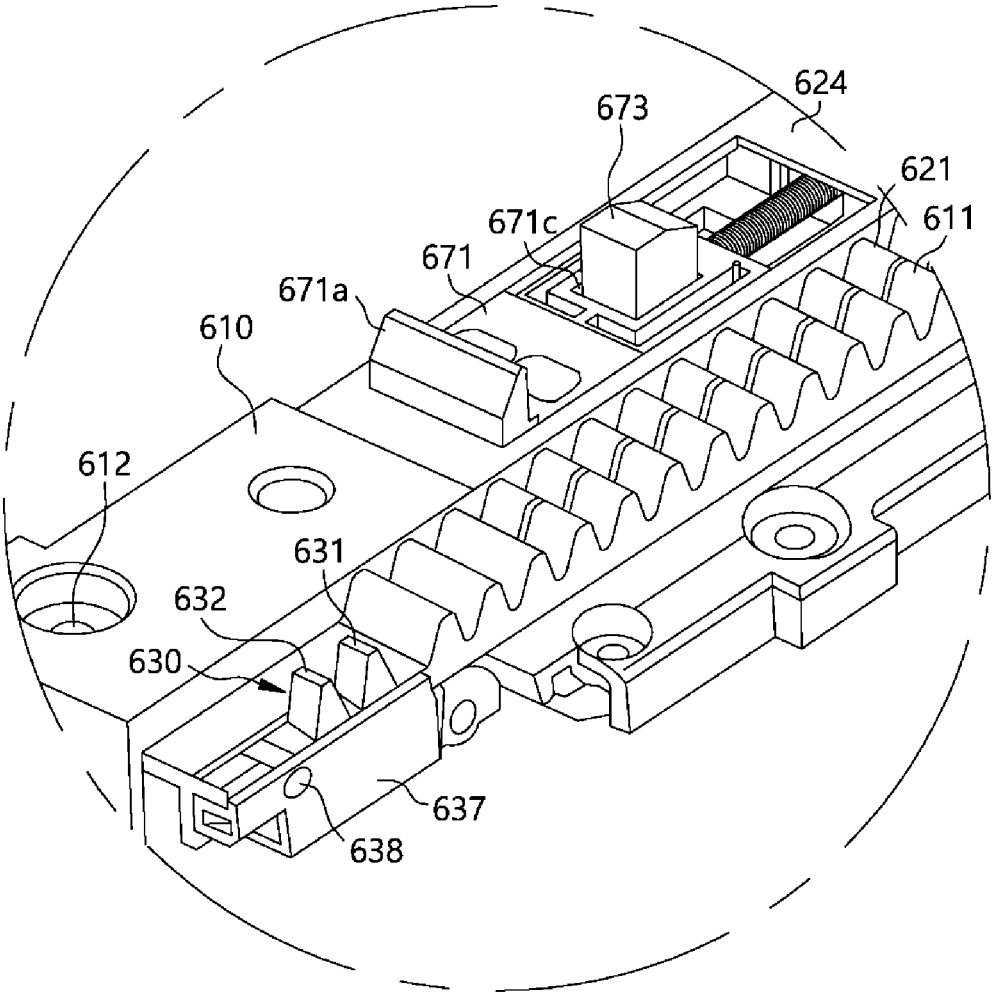
FIG. 19 is an enlarged view of "D" part in FIG. 18.
Figure 20:
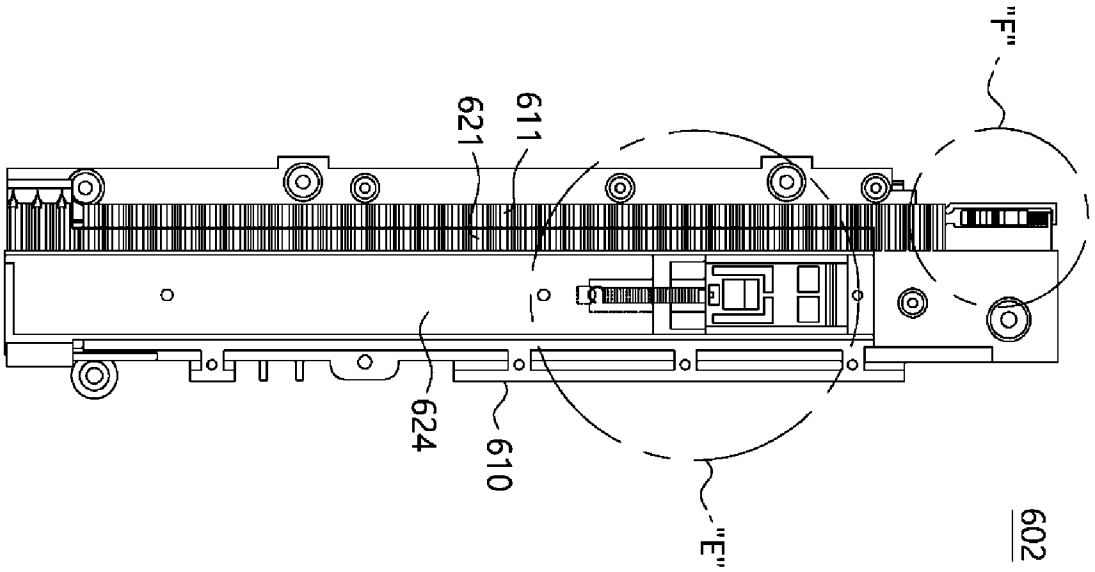
FIG. 20 is a bottom view showing the lower surface side structure of the rack gear assembly of the refrigerator having the drawer according to an embodiment of the present disclosure.
Figure 21:
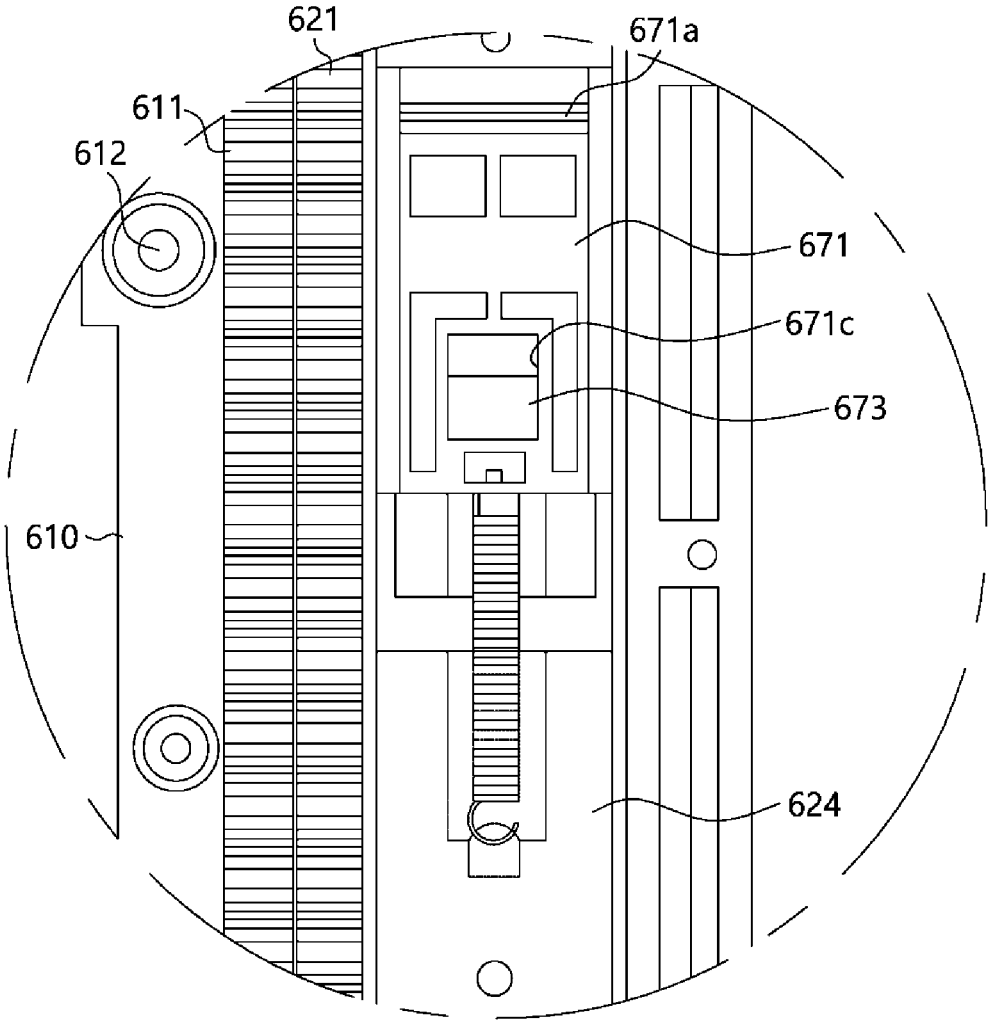
FIG. 21 is an enlarged view of "E" part in FIG. 20.
Figure 22:
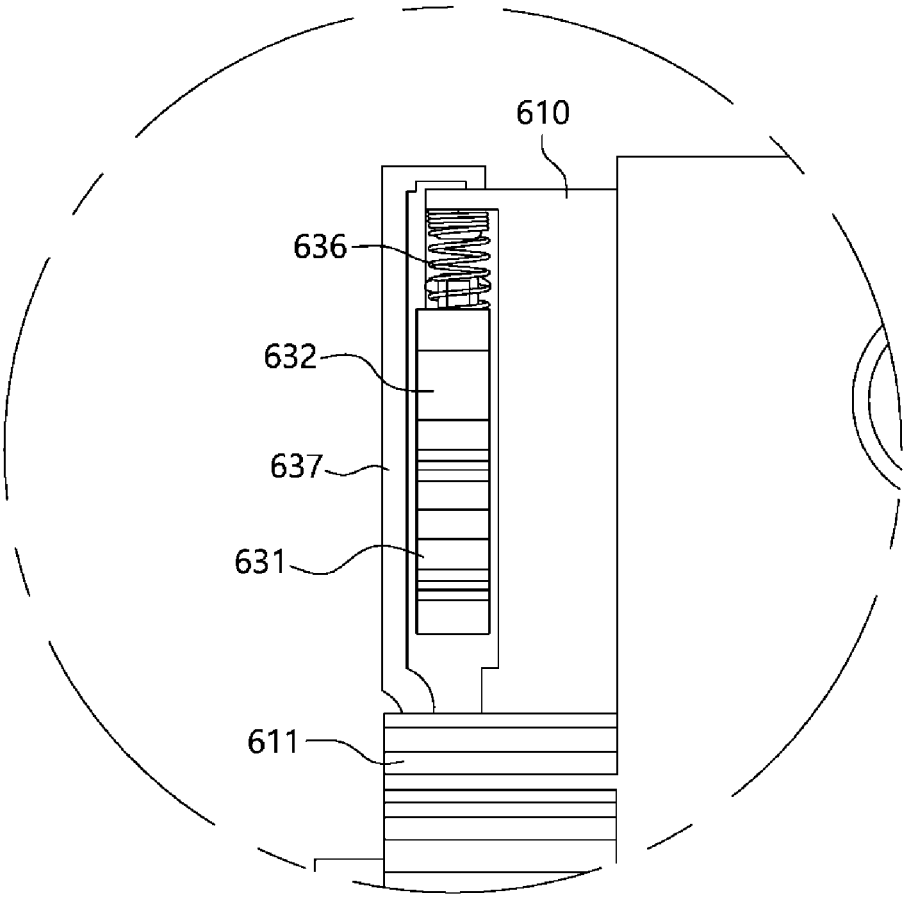
FIG. 22 is an enlarged view of "F" part in FIG. 20.
Figure 23:
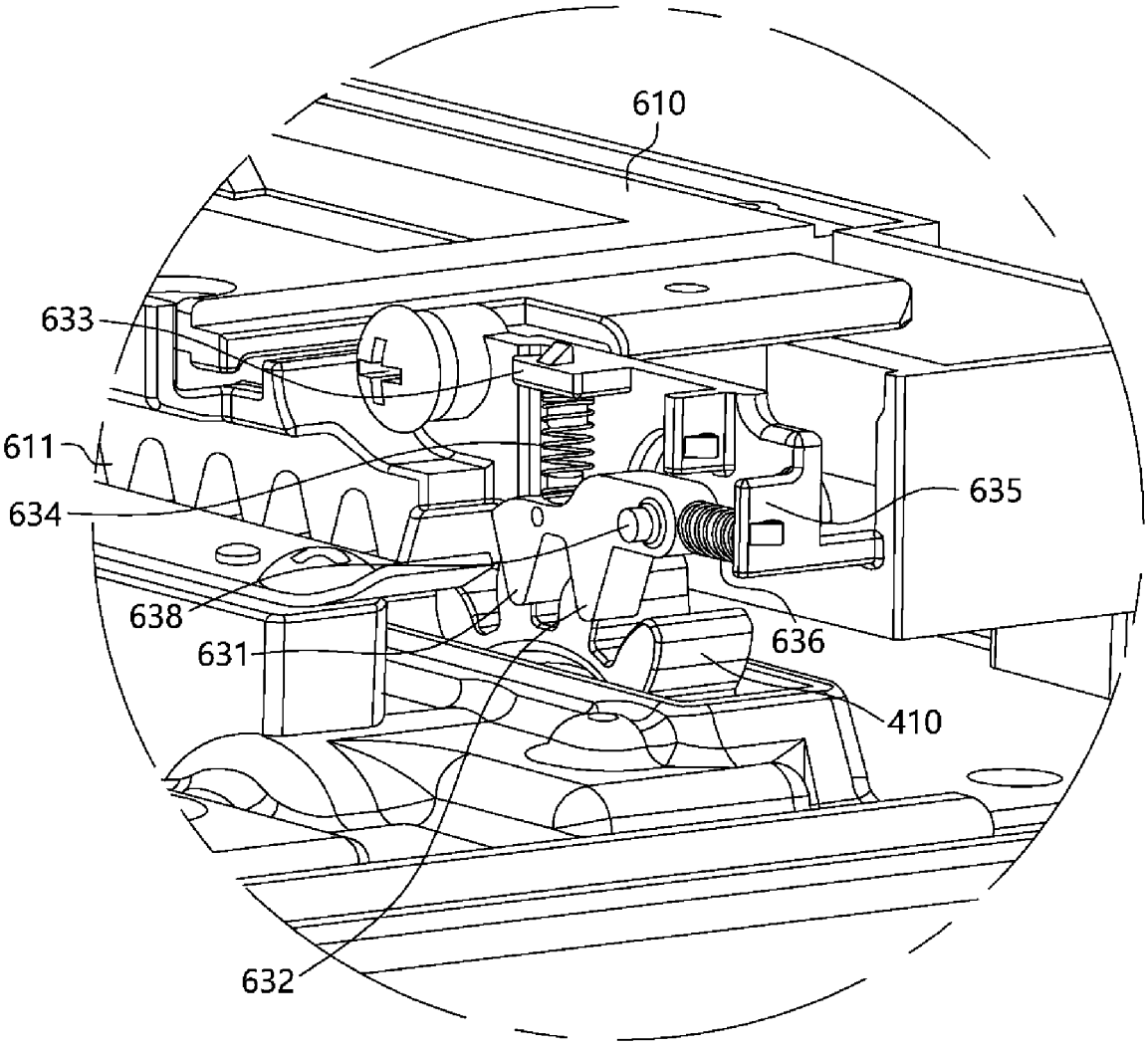
FIG. 23 is a main part perspective view showing installation of the idle gear of the refrigerator having the drawer according to an embodiment of the present disclosure.
Figure 24:
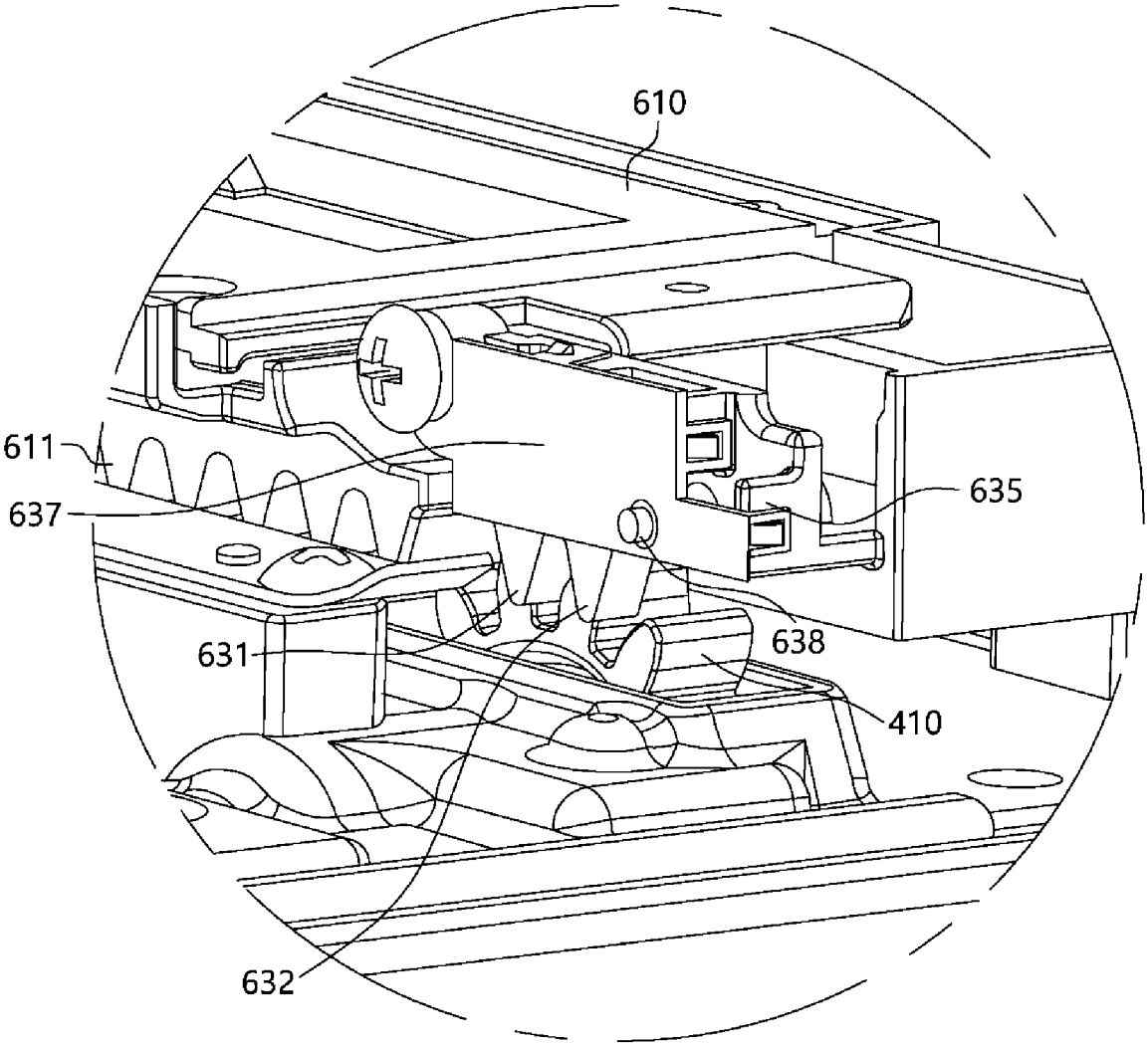
FIG. 24 is a main part perspective view showing installation of a cover body in FIG. 23.
Figure 25:
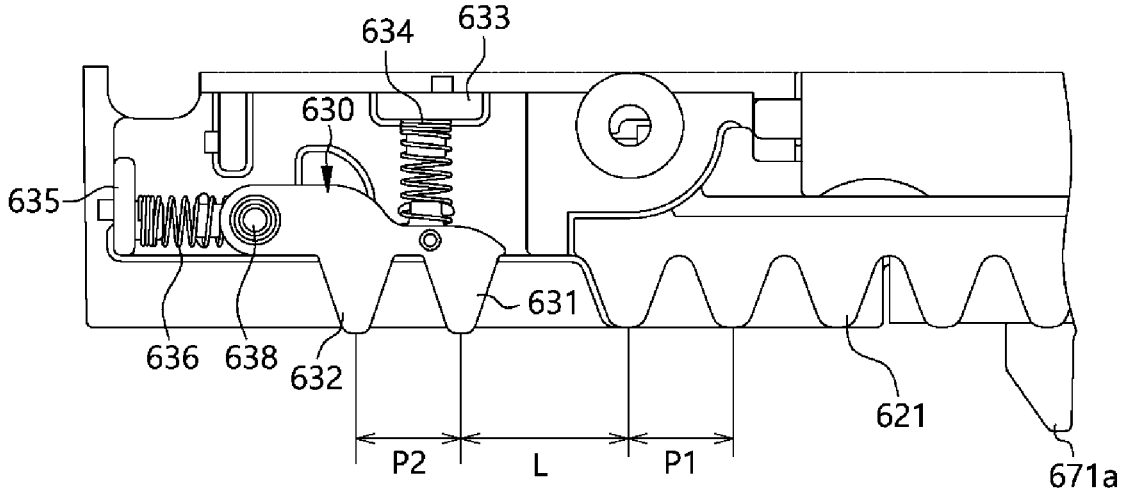
FIG. 25 is a main part side view showing installation of the idle gear of the refrigerator having the drawer according to an embodiment of the present disclosure.
Figure 26:
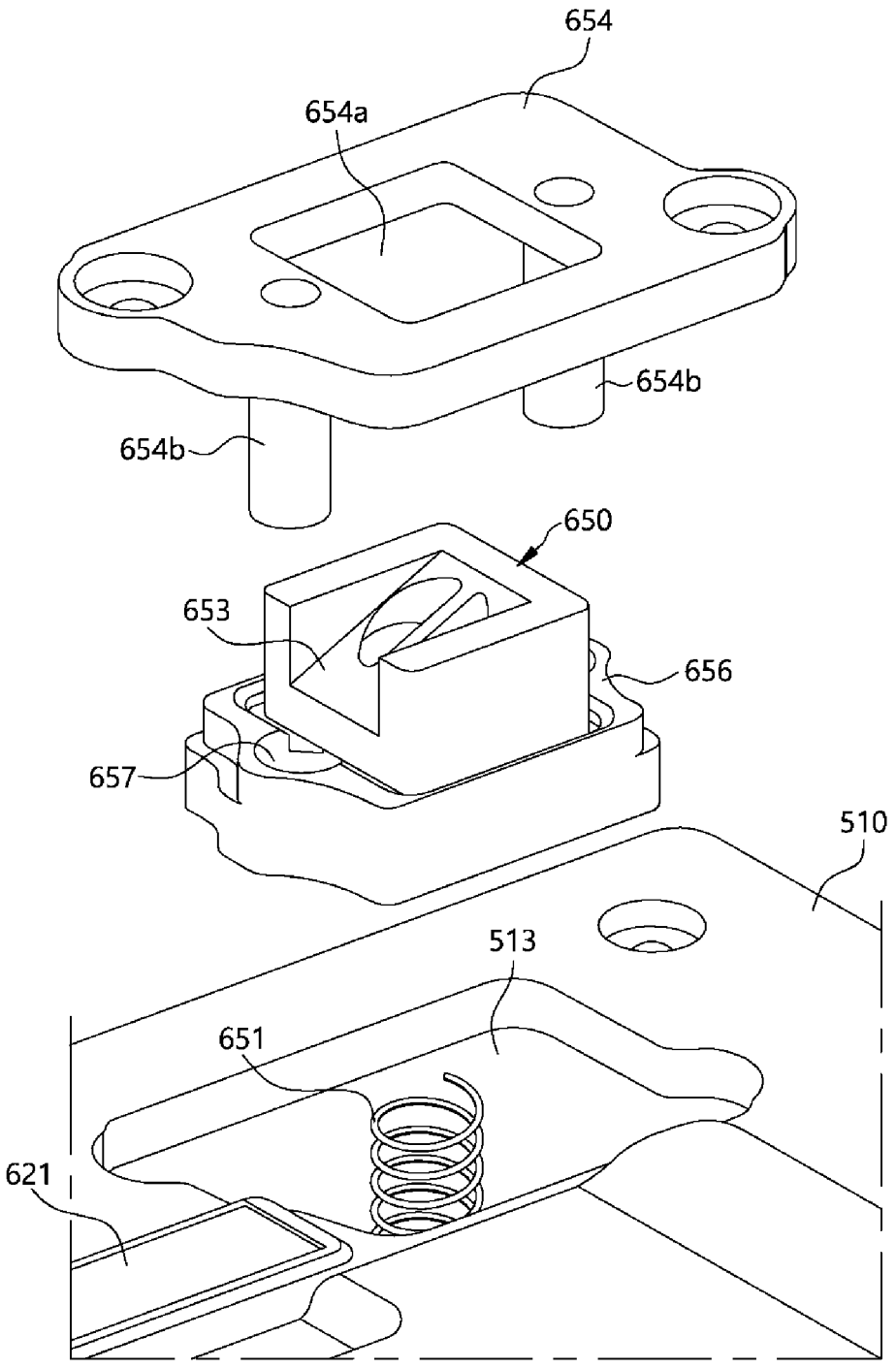
FIG. 26 is an exploded-perspective view showing a confining protrusion part of the refrigerator having the drawer according to an embodiment of the present disclosure.
Figure 27:
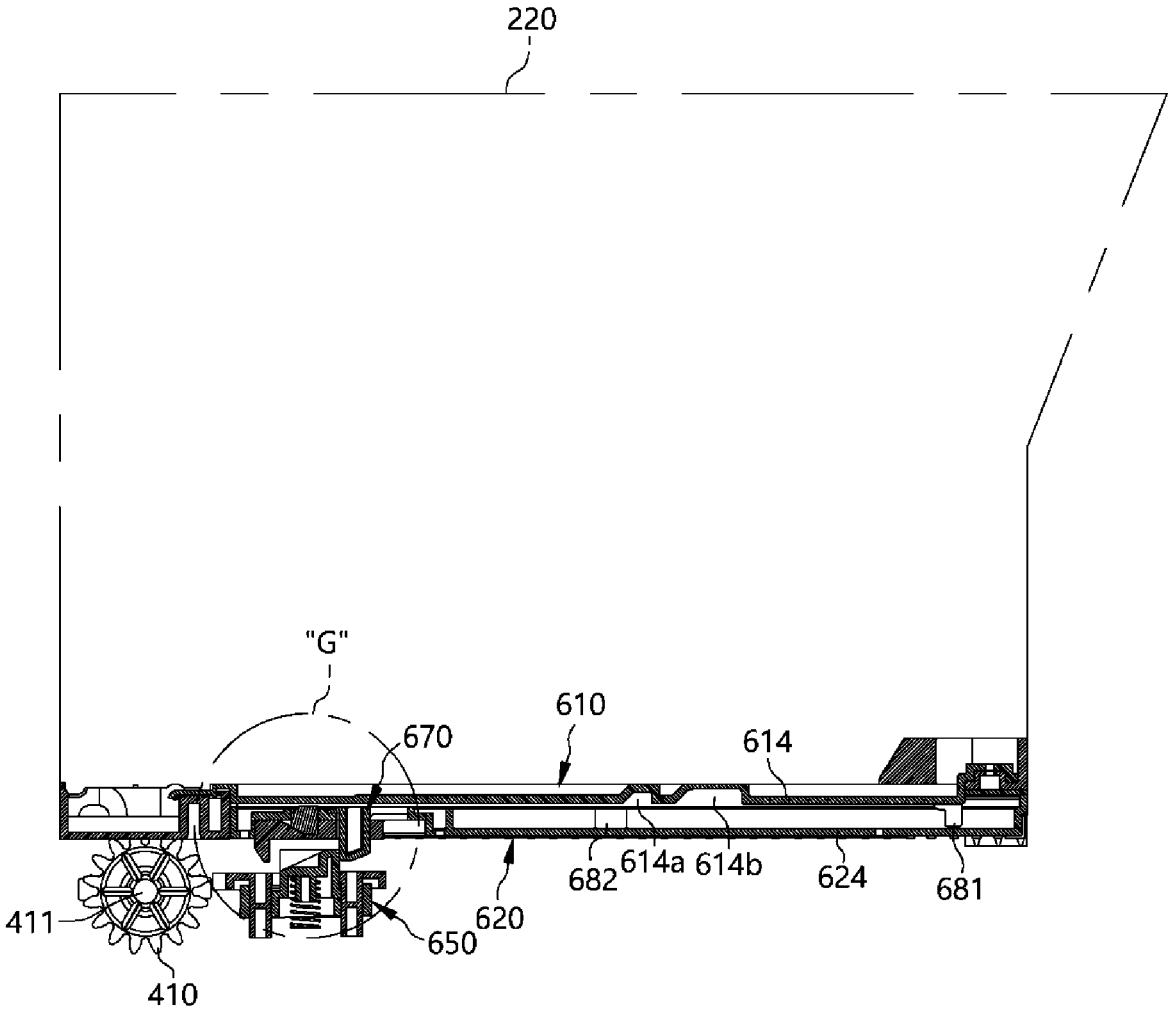
FIGS. 27, 29, 31, and 33 are views showing operational states of the rack gear assembly during a process of opening a storage bin of the refrigerator having the drawer according to an embodiment of the present disclosure.
Figure 28:
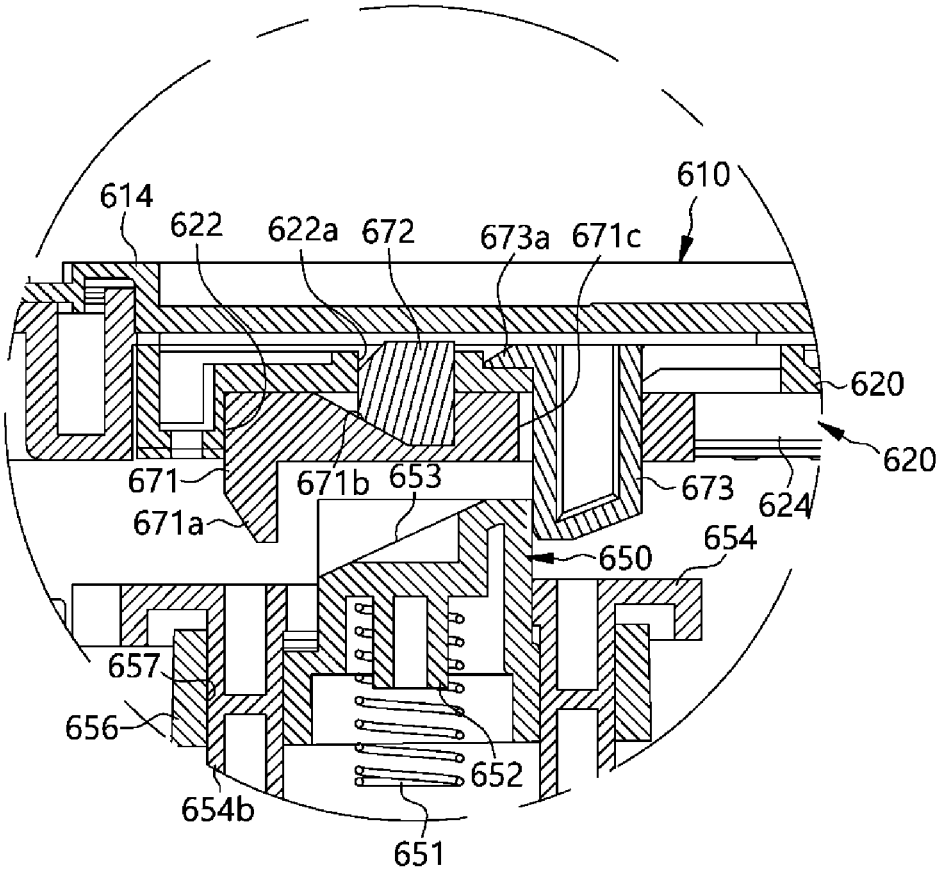
FIG. 28 is an enlarged view of "G" part in FIG. 27.
Figure 29:
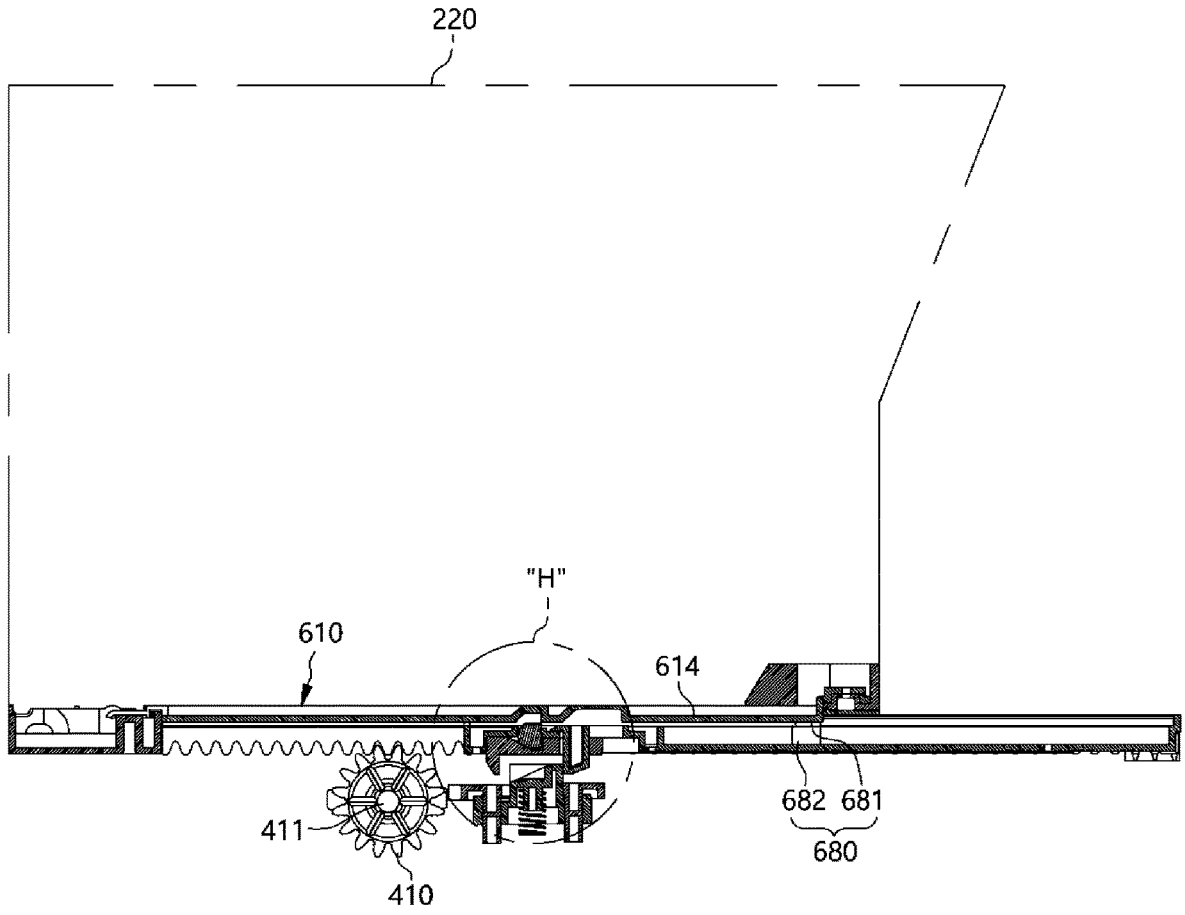
Figure 30:
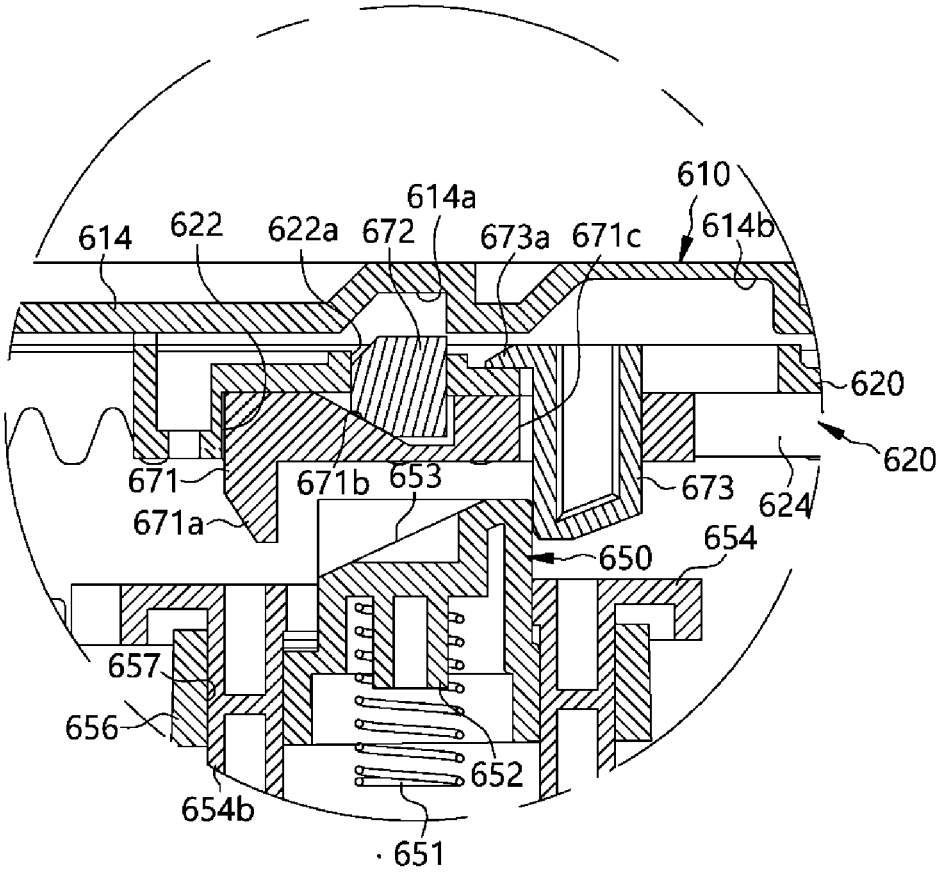
FIG. 30 is an enlarged view of "H" part in FIG. 29.
Figure 31:
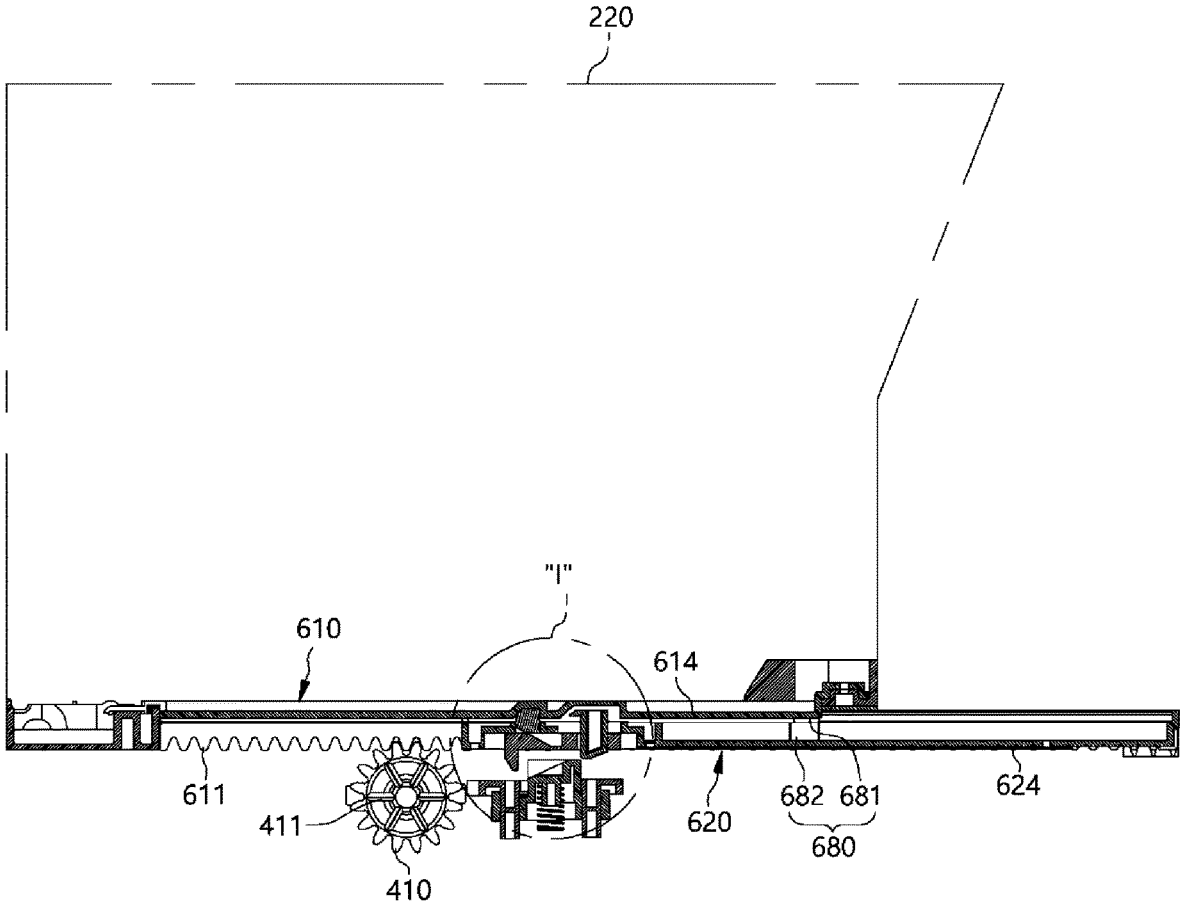
Figure 32:
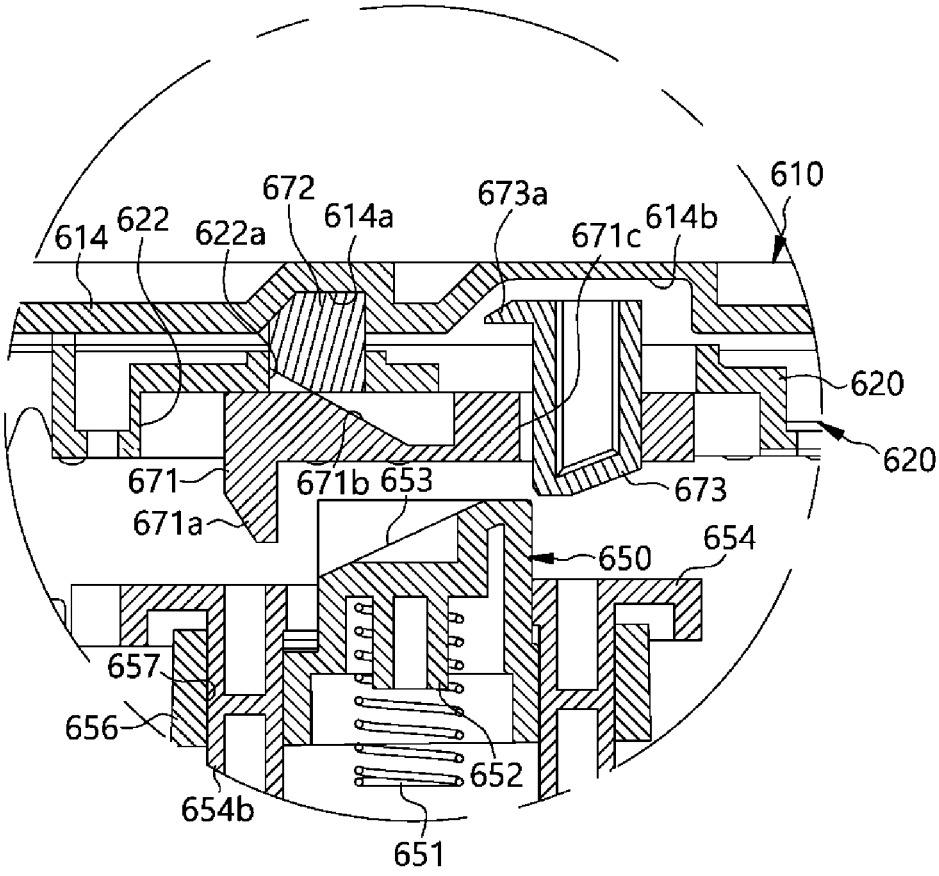
FIG. 32 is an enlarged view of "I" part in FIG. 31.
Figure 33:
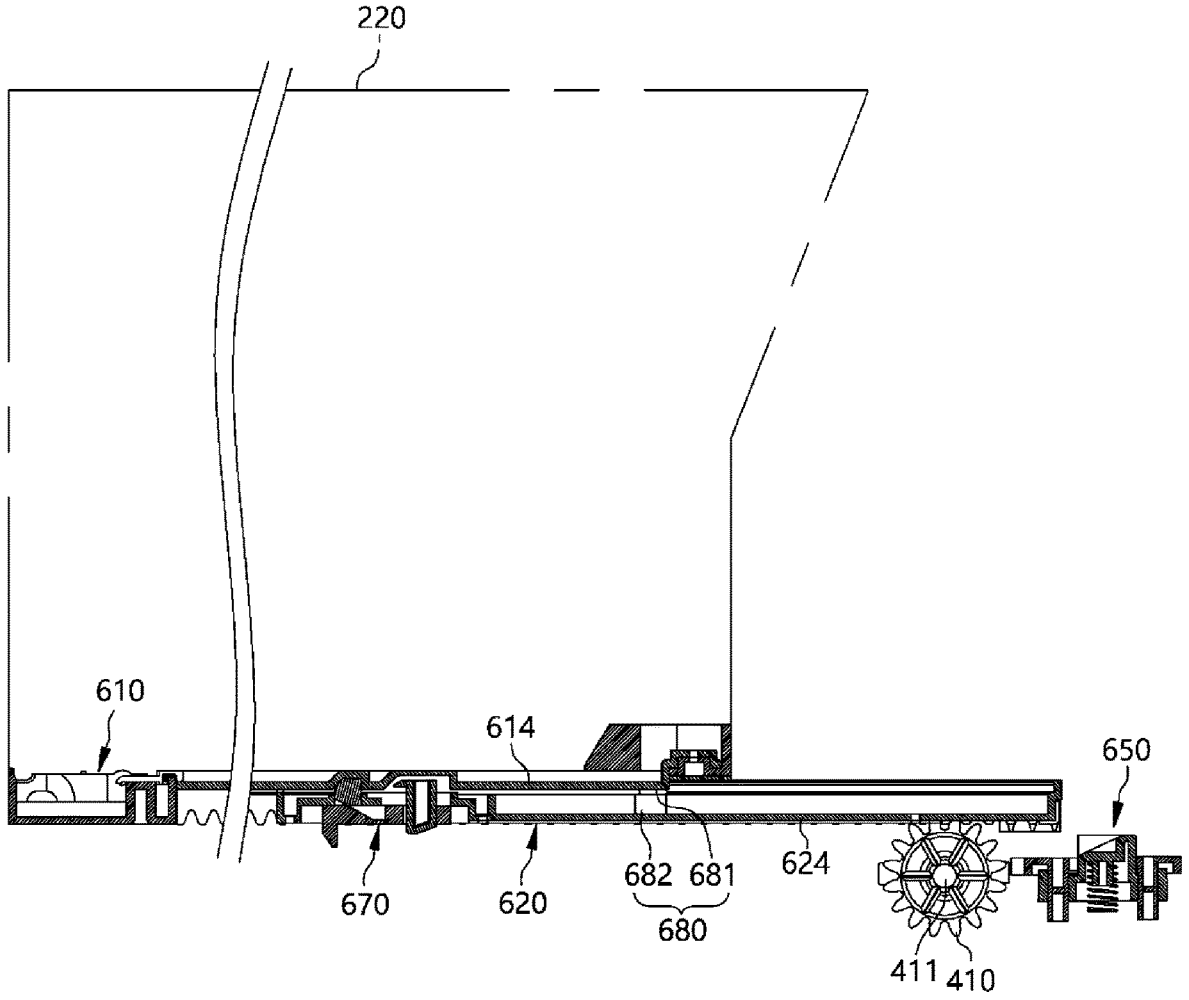
Figure 34:
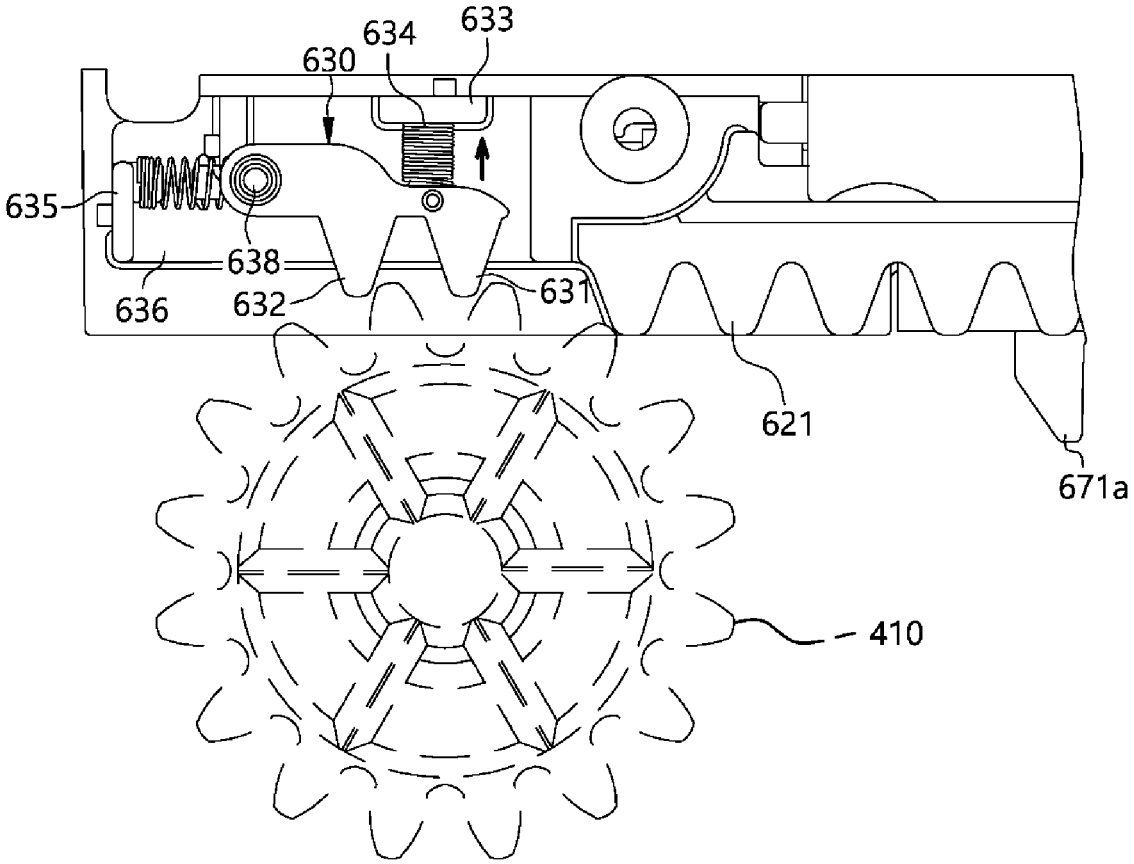
FIG. 34 is a view showing schematically position compensation by the idle gear when the drawer of the refrigerator is closed.

The two rack gear assemblies 601 and 602 may be configured as follows. In the general rack gear assembly (first rack gear assembly 601) provided at a portion where the open/close sensing part 514 (or sensing part) is positioned, a rack gear 611 of the first rack member 610 is formed continuously to a front end of the first rack member 610. On the other side, in the release rack gear assembly (second rack gear assembly 602), a rack gear 611 of the first rack member 610 is not formed to a front end of the first rack member 610 and is formed relatively shorter than the rack gear 611 of the general rack gear assembly, and the idle gear 630 is provided in front of the release rack gear assembly (second rack gear assembly 602), as shown in FIG. 11.

The idle gear 630 may be provided at a position where the idle gear 630 is engaged with the pinion 410 when the drawer 200 is in the closed state.

The idle gear 630 may have at least one gear tooth 631 and 632 (shown at FIGS. 16, 19, and 22-25), and the gear tooth may engage with the gear teeth of the pinion 410.

The idle gear 630 may have two gear teeth 631 and 632, and the two gear teeth 631 and 632 has a pitch p2 same as the pitch P1 of the rack gear 611. That is, the idle gear 630 may be formed in the substantially same structure as the rack gear 611 of the first rack member 610 and may be engaged with the pinion 410.

A spaced distance L between the rack gear 611 and a rear side gear tooth 631, which is positioned close to the rack gear 611, of the two gear teeth 631 and 632 (of the idle gear 630) is formed longer than a pitch of each gear tooth (i.e., the pitch between gear teeth of the idle gear or the pitch between gear teeth of the rack gear).

Through the structure, even when the release rack gear assembly (second rack gear assembly 602) provided with the idle gear 630 is pushed into the storage chamber relatively less than the general rack gear assembly (first gear rack assembly 601) of the other side (normally one pitch), the gear teeth 631 and 632 of the idle gear 630 are engaged with the pinion 410, thereby being pulled by the distance difference. Thus, the release rack gear assembly may be positioned alongside the general rack gear assembly while performing the forced forward movement thereof.

When the spaced distance L between the gear teeth 631 and 632 of the idle gear 630 and the rack gear 611 is excessively far from each other, the pinion 410 may not be engaged with the gear teeth 631 and 632 of the idle gear 630. Accordingly, the spaced distance L between the gear teeth 631 and 632 of the idle gear 630 and the rack gear 611 may be formed longer than the one pitch (1*P1 or 1*P2) and formed shorter than a distance between three gear teeth of the rack gear 611 (two pitch, 2*P1). That is, the pinion 410 may engage with the idle gear 630 at a moment when the rack gear 611 of the first rack member 610 passes over the pinion 410.

The idle gear 630 may be elastically moveable up and down. Thus, although the release rack gear assembly may no longer move rearward, the idle gear 630 may eliminate a rotation force of the pinion 410 by being elastically moved up and down even when the pinion 410 is rotated. That is, the pinion 410 may idle and may not transmit power.

For up and down movement of the idle gear 630, in the rack member 610, a first seating step 633 may be provided at an upper side of the idle gear 630, and an elastic member for up and down movement 634 may be provided between opposed surfaces on the first seating step 633 and the idle gear 630. This may be shown in FIG. 23.

The elastic member for up and down movement 634 may be positioned at a portion of an upper surface of the idle gear 630, where the portion being the upper side between the two gear teeth 631 and 632 or the upper side of a rear side gear tooth 631. That is, the elastic member for up and down movement 634 may pressurize the portion so that the idle gear 630 is prevented from being turned front to back when the pinion 410 is rotated.

The idle gear 630 may elastically move back and forth. Thus, although the idle gear 630 does not have the same pitch as the rack gear 611 of the first rack member 610, the pinion 410 may precisely engage with the idle gear, and the damage caused when the gear teeth 631 and 632 of the idle gear 630 are forcibly engaged with the pinion 410 may be prevented.

For back and forth movement of the idle gear 630, in the first rack member 610, a second seating step 635 may be provided at a position blocking the front of the idle gear 630, and an elastic member for back and forth movement 636 may be provided between opposed surfaces on the second seating step 635 and the idle gear 630.

The first rack member 610 may be provided with a cover body 637 that surrounds the exterior of the idle gear 630. That is, the cover body 637 may prevent various foreign materials from entering the idle gear 630, thereby preventing malfunction of the idle gear 630 due to foreign materials.

The cover body 637 may also prevent a problem in that the idle gear 630 is displaced to the side.

A supporting protrusion 638 may be provided at a side wall of the idle gear 630, and the supporting protrusion 638 may be configured to support by passing through the cover body 637. This may be shown in FIG. 24.

Lower ends of the two gear teeth 631 and 632 (constituting the idle gear 630) may be positioned lower than a lower end of the rack gear 611.

Since the idle gear 630 is elastically moveable up and down, the idle gear 630 may be positioned lower than the rack gear 611 so that initial engagement between the idle gear 630 and the pinion 410 may be precisely and stably performed.

The confining protrusion part 650 may confine the second rack member 620.

The confining protrusion part 650 may be a single body in which an upper surface is close and a lower surface is open, and the confining protrusion part 650 is provided on a front upper surface (bottom surface in storage chamber) of the bottom 120 constituting the cabinet 100.

The confining protrusion part 650 may be inserted in the protrusion passing hole 513 formed through the cover plate 510. When the cover plate 510 is not provided, the protrusion passing hole 513 may be formed through the upper surface (bottom surface in storage chamber) of the bottom 120 of the cabinet 100 so that the confining protrusion part 650 is provided therein.

An inner width of the protrusion passing hole 513 is larger than an outer width of the confining protrusion part 650, and a confining holder 654 is provided to prevent outward exposure of a gap between the protrusion passing hole 513 and the confining protrusion part 650, the gap being generated by width difference between the protrusion passing hole 513 and the confining protrusion part 650. This may be shown in FIG. 26.

The confining holder 654 may be coupled to the upper surface (e.g., upper surface of bottom) of the cover plate 510. The confining holder 654 is configured of a protrusion through hole 654*a* at the center thereof and a circumference portion. The protrusion through hole 654*a* is provided so that the confining protrusion part 650 passes therethrough and the circumference portion of the confining holder 654 blocks the gap between the protrusion passing hole 513 and the confining protrusion part 650 and is coupled to the cover plate 510.

A coupling end 656 may protrude outwards from a circumferential surface of the confining protrusion part 650. A raising guide 654*b* may protrude from a lower surface of the confining holder 654 to pass through the coupling end 656 from the top to the bottom. Coupling ends 656 are respectively formed by protruding from opposite sides of the confining protrusion part 650, and raising guides 654*b* are formed at opposite sides of the confining holder 654 to pass through the coupling ends 656, respectively.

The raising guide 654*b* may support up and down movement of the confining protrusion part 650.

The confining protrusion part 650 may elastically move up and down in the protrusion passing hole 513 by an elastic member 651.

That is, when pressure is applied to the confining protrusion part 650, the confining protrusion part 650 may move downward into the protrusion passing hole 513, and when the confining protrusion part 650 is not under pressure, the confining protrusion part 650 may move upward from the protrusion passing hole 513 so that a part thereof is exposed (protrude) to the inside of the lower storage chamber 3.

The elastic member 651 may be a coil spring, and a spring engagement protrusion 652 may protrude downward from the inside of the confining protrusion part 650. The elastic member 651 is configured such that an upper end thereof passes through a lower surface of the confining protrusion part 650 and then engages with the spring engagement protrusion 652 of the confining protrusion part 650.

The confining protrusion part 650 may be in rear of the pinion 410, and may be provided to be as close as possible to the pinion 410.

At a center portion of an upper surface of the confining protrusion part 650, a slope 653 is inclined upward such that the front is low and the rear is high. As the locking member 673 of the confining module 670 is moved backward along the slope 653, the confining protrusion part 650 is moved backward.

The confining module 670 may confine the second rack member 620 before the first rack member 610 is fully pushed out.

The confining module 670 may include the confining protrusion part 650, the stopper member 671, the holder 672, and the locking member 673.

The stopper member 671 may be installed in the motion groove 622 of the second rack member 620, and may function to restrict the rearward movement of the second rack member 620. A length (from the front to the rear) of the stopper member 671 is shorter than a length (from the front to the rear) of the motion groove 622, so that the stopper member 671 is moveable in forward and rearward directions within the motion groove 622.

The stopper member 671 (or stopper) may be provided with a confining hook 671*a* at a lower surface of a front end thereof, and the confining hook 671*a* may protrude downward. When the drawer 200 is closed to enter the preset distance, the confining hook 671*a* is to hit a front surface of the confining protrusion part 650 to prevent the stopper member 671 and the first rack member 610 from being moved backward.

A holder groove 671*b* may be provided on a front upper surface of the stopper member 671, and a locking member through hole 671*c* may be provided on a rear side portion of the stopper member 671.

The holder groove 671*b* is gradually inclined downward such that the front is high and the rear is low. Therefore, when the holder 672 received inside the holder groove 671*b* is moved forward, the holder 672 may be easily separated from the holder groove 671*b*.

The holder 672 is to restrict the forward and rearward movement of the stopper member 671.

A lower end of the holder 672 is received in the holder groove 671*b* (of the stopper member 671), and an upper end of the holder 672 is installed to pass through a first through hole 622*a* (of the second rack member). Thus, the first rack member 610 is pushed out by the preset distance to lead the second rack member 620, the holder 672 moved forward with the second rack member 620 is separated from the holder groove 671*b* and is received in the first receiving groove 614*a* of the first rack cover 614.

The holder 672 has inclined front upper and lower edges, and a front lower edge of the holder 672 is inclined at the same slope as the holder groove 671*b*. Thus, the holder 672 may be easily separated from the holder groove 671*b*.

The holder 672 has a cut groove 672*a* that is cut in forward and rearward direction on an upper surface of the holder 672, and an insert protrusion 633 received in the cut groove 672*a* is provided on a lower surface of the first rack cover 614, the lower surface thereof facing the upper surface of the holder 672, the insert protrusion 633 is formed from a front end of the first rack cover 614 to the first receiving groove 614*a*. That is, due to a structure between the cut groove 672*a* and the insert protrusion 633, during movement of the first rack member 610, the holder 672 is prevented from being moved laterally so as to be precisely received in the first receiving groove 614*a*. The cut groove 672*a* and the insert protrusion 633 may be provided in plural.

The locking member 673 may prevent the forward movement of the second rack member 620 by being locked in a position of the rear of the confining protrusion part 650 until the first rack member 610 is pushed out by the preset distance.

The locking member 673 may move upward when the first rack member 610 and the first rack cover 614 are pushed out by the preset distance and move with the second rack member 620 and the second rack cover 624. Then, the locking member 673 is inserted in the second receiving groove 614*b* of the first rack cover 614 positioned above the locking member to release the engagement with the confining protrusion part 650.

An extending step 673*a* is provided at an upper end of the locking member 673 in a shape of extending laterally, and a raising guide step 623 is provided on opposite side portions of the second through hole 622*b* at a front upper surface of the second rack member 620. The raising guide step 623 is formed in a rounded shape (or inclined shape) so as to raise the extended step 673*a* when the first rack member 610 and the first rack cover 614 are pushed out by the preset distance and moved with the second rack member 620 and the second rack cover 624.

When the first rack member 610 and the first rack cover 614 are pushed out by the preset distance and moved with the second rack member 620 and the second rack cover 624, the raising guide step 623 provided on the second rack member 62 raises the extended step 673*a* of the locking member 673, thus the locking member 673 rises up to a height where the locking member 673 is not hit from the confining protrusion part 650.

The raising guide step 623 may be rounded or inclined upward such that the front is low and the rear is high. The raising guide step 623 may be gradually inclined upward such that the front (at the center of the opposite side portions of second through hole 622*b*) is low and the rear is high. That is, the raising guide step 623 is provided so that the locking member 673 is not affected by the raising guide step 623 when it is positioned in the front of second through hole 622*b*, and is gradually moved upward by affecting by the raising guide step 623 when the locking member 673 is moved to the rear of the second through hole 622*b* by the forward movement of the second rack member 620.

The extended step 673*a* of the locking member 673 may be rounded or inclined like the raising guide step 623.

A lower surface of the locking member 673 may be inclined upward such that the front is low and the rear is high. A slope of the lower surface of the locking member 673 may be the same as the slope 653 formed at the center of the upper surface of the confining protrusion part 650.

According to an example embodiment of the present disclosure, operation of the refrigerator may be described with reference to FIGS. 27 to 34.

The drawer 200 may be maintained in a closed state unless otherwise manipulated. This may be shown in FIGS. 27 and 28.

In the closed state, when a manipulation is performed to open the drawer 200 at the user's need, the driving motor 420 is operated while power is supplied to the driving part 400.

The manipulation for opening the drawer 200 may be a manipulation of a button 6 (touch or pressure type) or an operation control of a control program that senses proximity of the user.

When the driving motor 420 is operated by the manipulation, the two pinions 410 may be simultaneously rotated, and thus the drawer 200 may be forwardly opened while the rack gears 611 and 621 of the two rack gear assemblies 601 and 602 engaged with the pinions 410 are operated.

More specifically, the first rack member 610 and the first rack cover 614 may be pushed out while being operating simultaneously and then the second rack member 620 and the second rack cover 624 may be subsequently pushed out.

While the first rack member 610 and the first rack cover 614 are simultaneously operated and pushed out, the locking member 673 may be maintained in a confined state to the confining protrusion part 650, so that the second rack member 620 and the second rack cover 624 are maintained in an initial position.

When the first rack member 610 and the first rack cover 614 are pushed out by the preset first distance and the linkage protrusion 681 comes into contact with the linkage step 682, the second rack member 620 and the second rack cover 624 are also moved forward with the first rack member 610 from the contact point. This may be shown in FIGS. 29 and 30.

However, at this time, the locking member 673 may be confined to the confining protrusion part 650, so the stopper member 671 through which the locking member 673 passes is maintained in place while the second rack member 620 is moved forward. As the extended step 673*a* of the locking member 673 gradually climbs to the raising guide step 623 provided in the second rack member 620, the locking member 673 is moved upward and is separated from the confining protrusion part 650. This may be shown in FIGS. 31 and 32.

After that, the stopper member 671 is moved forward with the second rack member 620 while contacting with a rear surface in the motion groove 622 and passes the confining protrusion part 650.

Subsequently, while the second rack member 620 and the second rack cover 624 are moved following the first rack member 610 and the first rack cover 614, the rack gear 621 of the second rack member 620 is engaged with the pinion 410 just before the rack gear 611 of the first rack member 610 is separated from the pinion 410. As the rack gear 611 of the first rack member 610 is separated from the pinion 410 by the rotation of the pinion 410 and at the same time only the rack gear 621 of the second rack member 620 is moved by being engaged with the pinion 410, the drawer 200 is further moved forward. This may be shown in FIG. 33.

After movement of the second rack member 620 is finished, the storage bin 200 of the drawer 200 is in a maximum opened state. When the maximum opened state of the storage bin 220 is checked (for example, the maximum opened state is sensed by open/close sensing part), the raising/lowering module 300 is operated to raise up the container 240 in the storage bin 220.

Accordingly, the user may take the container 240 out, take out storage items from the container 240, and/or easily put items into the container 240.

When closing operation of the drawer 200 is performed as the user completes use thereof, the driving motor 420 (constituting the driving part 400) drives so that the pinion 410 is reversibly rotated, and thus the rack gear 621 (of the second rack member 620), the rack gear 621 being engaged with the pinion 410, is operated so that the second rack member 620 is moved backward.

The first rack member 610 may move rearward with the second rack member 620 by being moved in conjunction with the second rack member 620 by the linkage part 680.

After that, when a front end of the rack gear 621 (of the second rack member 620) is positioned to be engaged with the pinion 410, a rear end of the rack gear 611 (of the first rack member 610) is also positioned to be engaged with the pinion 410. The rack gear 621 (of the second rack member 620) is separated from the pinion 410, and only the first rack member 610 is moved rearward by the rack gear 611 thereof.

Specifically, when just before the second rack member 620 is fully moved rearward, the confining hook 671*a* of the stopper member 671 is blocked by the confining protrusion part 650, thereby no longer being moved rearward. Even though the stopper member 671 is hit, as the second rack member 620 is further moved by a moveable distance provided in the motion groove 622, the extended step 673*a* of the locking member 673 is separated from the locking member 673 so that the locking member 673 is moved downward.

After that, the second rack member 620 is no longer moved backward by the stopper member 671, and the confining protrusion part 650 is positioned between the confining hook 671*a* of the stopper member 671 and the locking member 673 and confines the second rack member 620.

Accordingly, only the first rack member 610 is further moved rearward and returned to an initial position (position where the storage bin is fully pushed in). When completion of the return movement is sensed, the driving of the driving motor 420 is stopped and closing movement of the drawer ends.

Meanwhile, when opening and closing operation of the drawer 200 is performed, the drawer 200 may be closed obliquely such that the opposite sides thereof are not in a horizontal state, but rather one side is further forward than the other side.

That is, although a rack gear of any one rack gear assembly of the rack gear assemblies 601 and 602 is engaged with the pinion 410 the one pitch later than the rack gear of the other rack gear assembly by user carelessness, when the two pinions 410 are rotated at the same time by operation of the driving motor 420, the drawer 200 is inserted into the lower storage chamber 3 with oblique opposite sides.

In this process, when any one side (for example, the side where the open/close sensing part is provided) of the drawer 200 is closed before the other side of the drawer, the open/close sensing part 514 senses the closing and then the additional operation of the driving motor 420 is controlled.

That is, the driving motor 420 is controlled to further operate by the predetermined time or the predetermined number of rotations from when the closing of the drawer 200 is sensed. Therefore, the release rack gear assembly (second rack gear assembly 602), which is relatively less closed among the rack gear assemblies 601 and 602 that are engaged with the pinion 410, may be engaged with the pinion 410 to the portion where the idle gear 630 is provided.

The idle gear 630 is provided with a pulling force by the pinion 410 by the spaced distance (higher than one pitch and less than two pitch) from the rack gear 611, whereby the release rack gear assembly may be easily moved.

The engagement between the pinion 410 and the idle gear 630 may be stably and precisely performed by the elastic members 634 and 636.

On the other hand, when the other side (for example, side opposite to side where the open/close sensing part is provided) of the drawer 200 is closed before the one side, the two pinions 410 may rotate continuously until the open/close sensing part 514 senses the closing of any one side of the drawer 200.

At this point, since the idle gear 630 provided in the release rack gear assembly that is closed before the other rack gear assembly is engaged with the pinion 410, and the idle gear 630 receives a horizontal movement force by the rotational force of the pinion 410 and performs additional rearward movement of the release rack gear assembly.

Since the drawer 200 has the packing member on the contact surface between the front panel 210 and cabinet 100, a side of the drawer 200 where the release rack gear assembly is provided may be further moved rearward by a compressive force of the packing member.

However, when the drawer 200 is moved until the packing member is in a maximum compressed state, the idle gear 630 engaged with the pinion 410 is moved upward (referring to FIG. 34) and is temporarily released from engagement with the pinion 410, whereby the pinion 410 idles.

The other pinion 410 may continuously move the general rack gear assembly rearward while being engaged with the rack gear 611 of the general rack gear assembly, so that the side, which corresponds to the other pinion, of the drawer is closed later.

When the closing of the drawer door is sensed, the driving motor 420 is controlled from this time to perform the additional operation by the predetermined time or the predetermined number of rotations, and then the operation is deactivated.

Accordingly, even when any one side of the drawer 200 is closed before the other side, the opposite sides of the drawer 200 may be fully closed by the additional operation of the driving motor 420 and providing the idle gear 630.

Embodiments of a refrigerator of the present disclosure is not limited to the above described structure.

That is, the rack gear assemblies 601 and 602 may be provided only with the first rack member 610. In this example, the idle gear 630 is installed in front of the rack gear 611 of the first rack member 610, and an installation structure thereof may also be provided to be capable of back and forth elastic movement and up and down elastic movement same as the above-described embodiment.

Additionally, the rack gear assemblies 601 and 602 may be formed by including at least three rack members. In this example, the idle gear 630 is provided in front of the rack gear 611 of a rack member that is positioned at the front of the rack members based on the movement direction of the drawer 200, and an installation thereof may be provided to be capable of back and forth elastic movement and up and down elastic movement same as the above-described embodiment.

The idle gear 630 constituting the refrigerator of the present disclosure may be embodied in various shapes.

The refrigerator of the present disclosure is provided with the rack gear assembly 601 including the idle gear 630, the idle gear 630 idling the pinion 410 by being engaged with the gear teeth of the pinion 410, so that the drawer 200 can be fully closed even when opposite sides of the drawer 200 are not moved parallel.

Additionally, in the refrigerator of the present disclosure, the driving motor 420 of the driving part 400 is configured to perform the additional operation from when the closing of the drawer 200 is sensed and then to deactivate the operation, so that the drawer 200 can be fully closed even when the opposite sides of the drawer 200 are not moved in a parallel manner.

In the refrigerator of the present disclosure, the open/close sensing part 514 is provided at the opposed surfaces on the drawer 200 and the cabinet 100 to sense opening and closing of the drawer 200, so that operational control of the driving motor 420 can be precisely performed.

In the refrigerator of the present disclosure, the open/close sensing part 514 is provided with the sensor 514*a* and the sensing member 514*b*, and the sensor 514*a* and the sensing member 514*b* are respectively provided at the opposed portions between the inside of the storage chamber 3 and the drawer 200, so that opening and closing of the drawer 200 can be accurately sensed.

In refrigerator of the present disclosure, the sensor 514*a* is provided at the bottom in the storage chamber 3, and the sensing member 514*b* is provided at the lower surface of the storage bin 220 (constituting the drawer 200), so that installation and maintenance thereof can be easily performed.

In the refrigerator of the present disclosure, the sensor 514*a* is the hall sensor, and the sensing member 514*b* is a magnet, so that the user can accurately recognize opening and closing of the drawer 200.

In the refrigerator of the present disclosure, the rack gear 611 is operated to be further moveable by at least one pitch from when closing of the drawer 200 is sensed, and the drawer 200 can be accurately closed.

In the refrigerator of the present disclosure, the pinion 410 is provided to be rotated only two rotations or less from when closing of the drawer 200 is sensed, so that damage to the pinion 410 or the rack gear 611 can be prevented.

In the refrigerator of the present disclosure, the idle gear 630 is provided in at least any one of the rack gear assemblies 601 and 602, so that damage to the rack gear 611 and the pinion 410 can be prevented even when the one side where the rack gear assembly with the idle gear is provided of the drawer 200 is closed before the other side.

In the refrigerator of the present disclosure, the idle gear 630 is provided in front of the rack gear 611 of the first rack member 610, so that the idle gear 630 can engage with the pinion 410 only when the drawer 200 is closed.

In the refrigerator of the present disclosure, the idle gear 630 is provided with at least one gear tooth, so that the idle gear 630 can engage with the pinion 410.

In the refrigerator of the present disclosure, the idle gear 630 is provided with the two gear teeth 631 and 632 and formed to have the same pitch as the rack gear 611, so that the idle gear 630 can be precisely engaged with the pinion 410.

In the refrigerator of the present disclosure, the distance L between the idle gear 630 and the rack gear 611 is longer than the pitch P1 of the rack gear 611, so that the idle gear 630 can be provided with the pulling force by the pinion 410 for easily forced movement.

In the refrigerator of the present disclosure, the distance L between the idle gear 630 and the rack gear 611 is shorter than the distance between the three rack teeth of the rack gear 611, so that engagement between the idle gear 630 and the pinion 410 can be precisely performed.

In the refrigerator of the present disclosure, the lower ends of the two gear teeth 631 and 632 included in the idle gear 630 is positioned lower than the lower end of the rack gear 611, so that engagement between the idle gear 630 and the pinion 410 can be precisely performed.

In the refrigerator of the present disclosure, the idle gear 630 is elastically moveable up and down, so that the idle gear 630 can be released from engagement with the pinion 410 when the drawer 200 is closed and the opposite sides of the drawer 200 can be fully closed.

In the refrigerator of the present disclosure, the idle gear 630 is elastically moveable back and forth, so that the idle gear 630 can be stably engaged with the pinion 410 and can be efficiently provided with the pulling force by the pinion 410.

In the refrigerator of the present disclosure, the idle gear 630 is elastically moveable up and down by the elastic member for up and down movement 634, so that the idle gear 630 can engage with the pinion 410 or be easily released from engagement with the pinion.

In the refrigerator of the present disclosure, the elastic member for up and down movement 634 is positioned at the portion of the upper surface of the idle gear 630, the portion being the upper side between the two gear teeth 631 and 632 or the upper side of the gear tooth close to the rack gear 611, so that malfunction such as overturning of the idle gear 630 may be prevented.

In the refrigerator of the present disclosure, the idle gear 630 is elastically moveable back and forth by the elastic member for back and forth movement 636, so that back and forth movement of the idle gear 630 may be performed.

In the refrigerator of the present disclosure, the first rack member 610 is further provided with the cover body 637 for surrounding the exterior of the idle gear 630, so that malfunction due to damage to the idle gear or entering of foreign material may be prevented or minimized.

Figure 35:
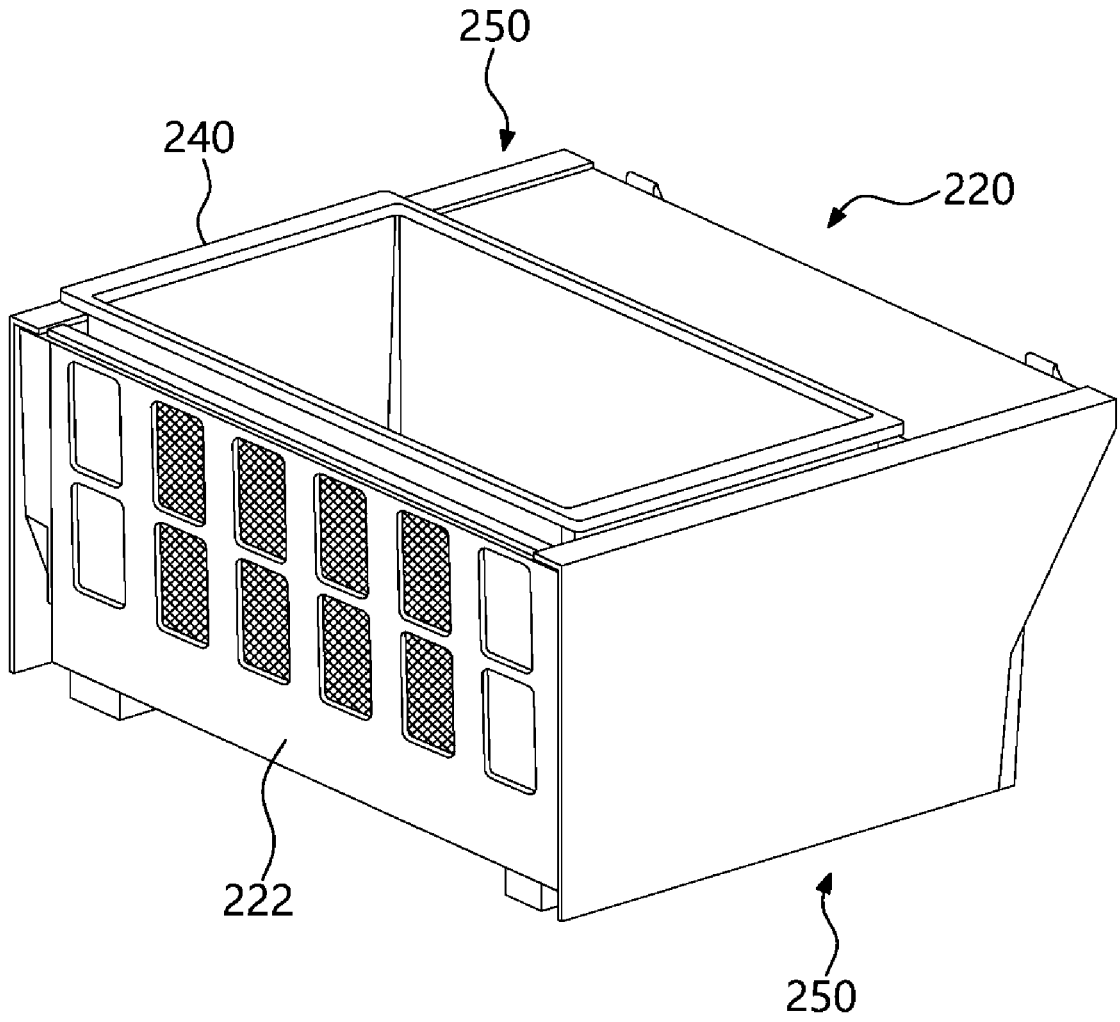
FIG. 35 is a perspective view showing a structure of the storage bin according to an example embodiment of the present disclosure.
Figure 36:
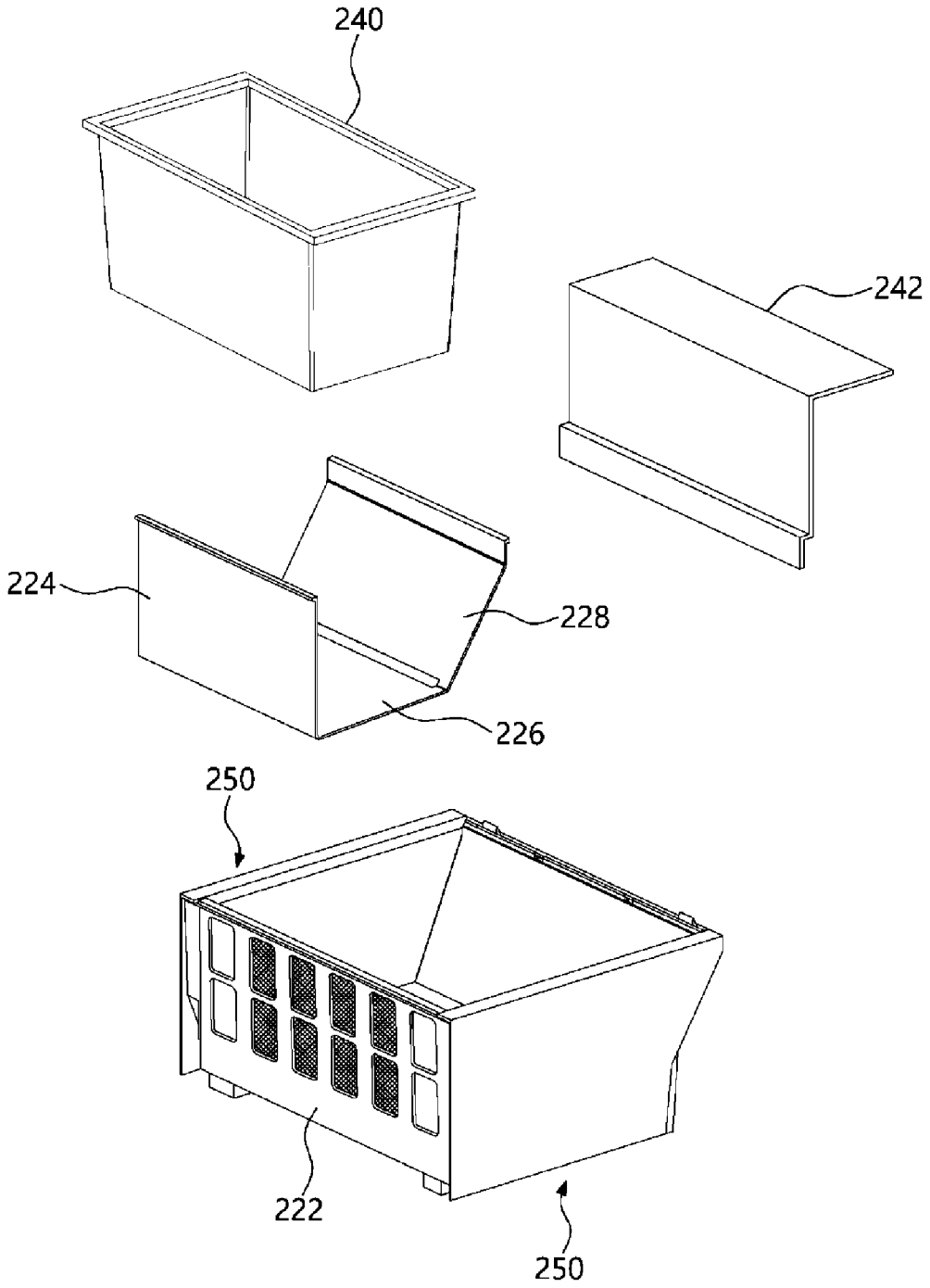
FIG. 36 is an exploded-perspective view showing the structure of the storage bin according to an example embodiment of the present disclosure.
Figure 37:
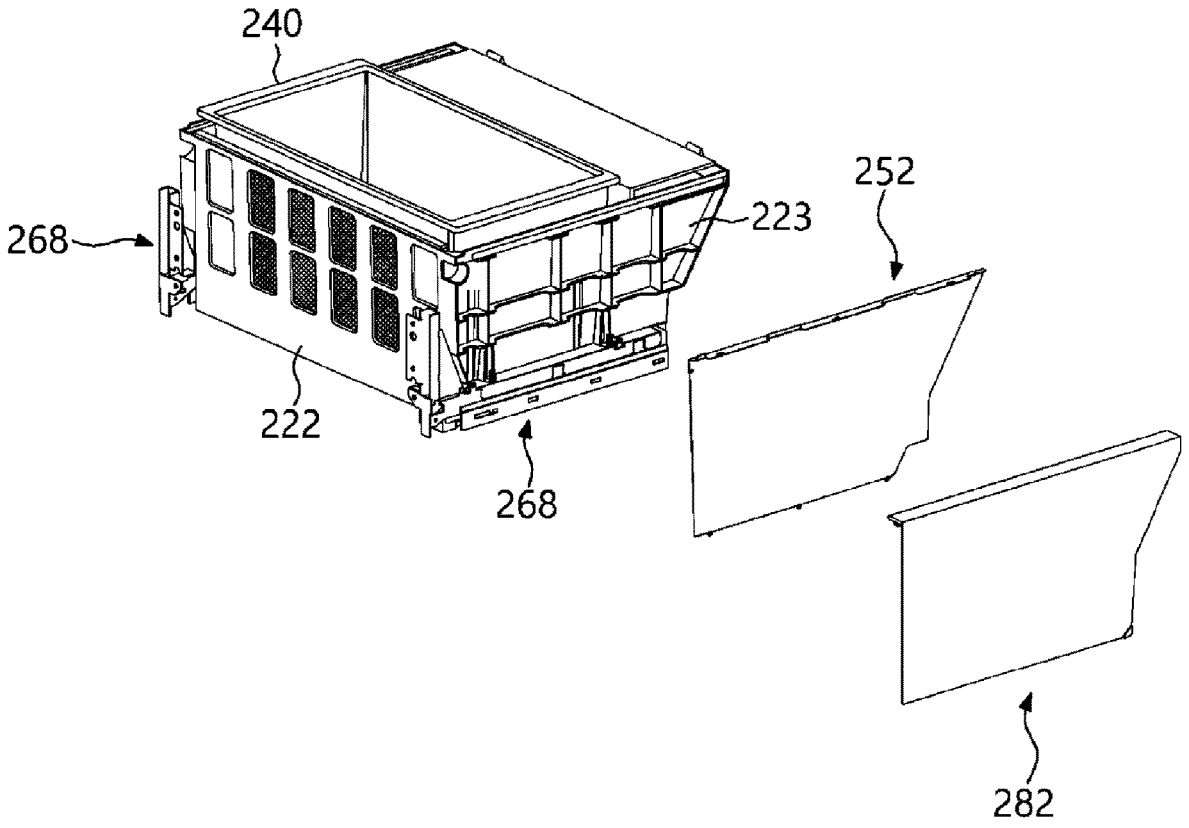
FIG. 37 is an exploded-perspective view showing a structure of a storage body and a side cover module according to an example embodiment of the present disclosure.
Figure 38:
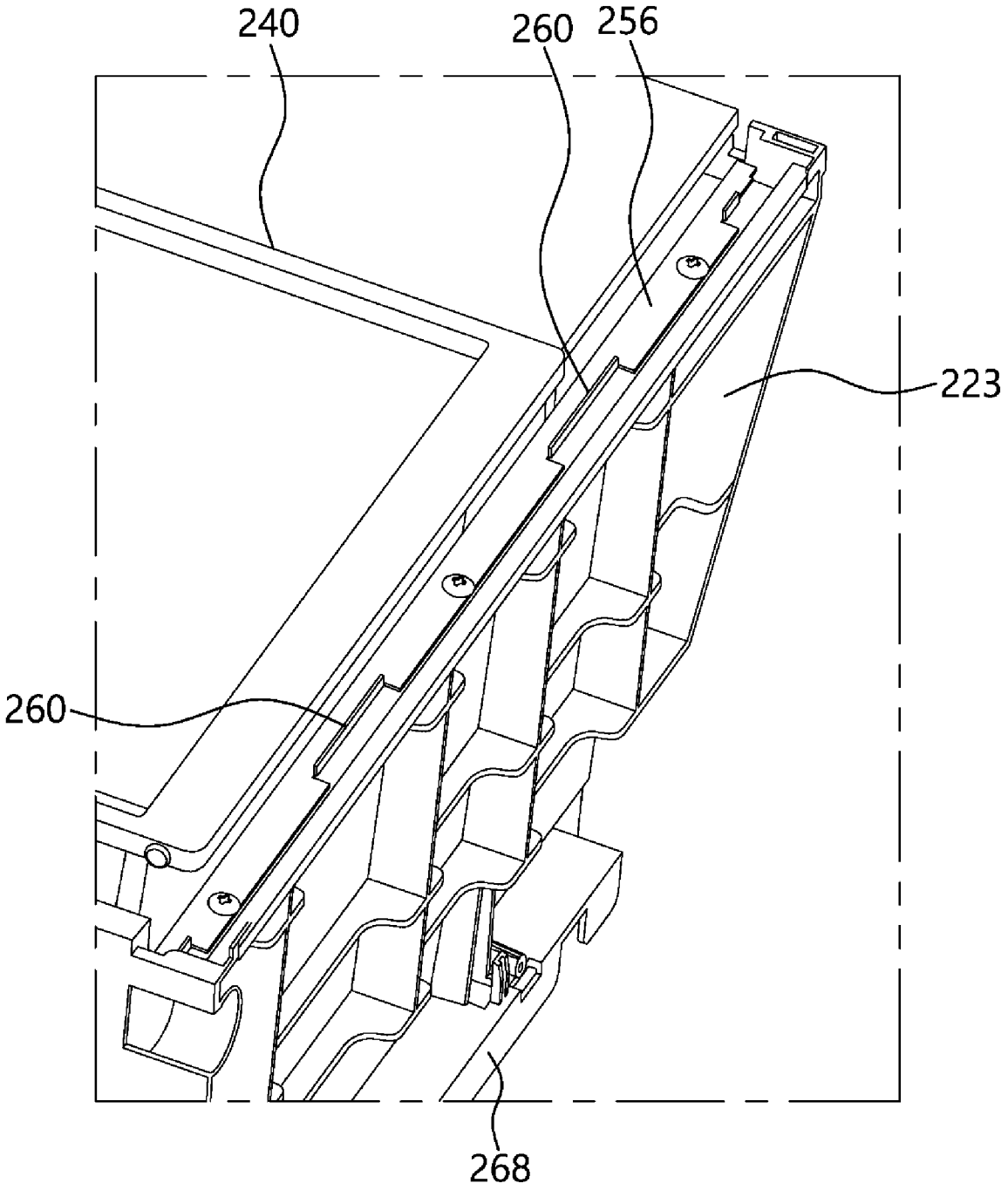
FIG. 38 is an enlarged-perspective view showing an inside cover that is mounted to an inside surface of the storage body according to an example embodiment of the present disclosure.
Figure 39:
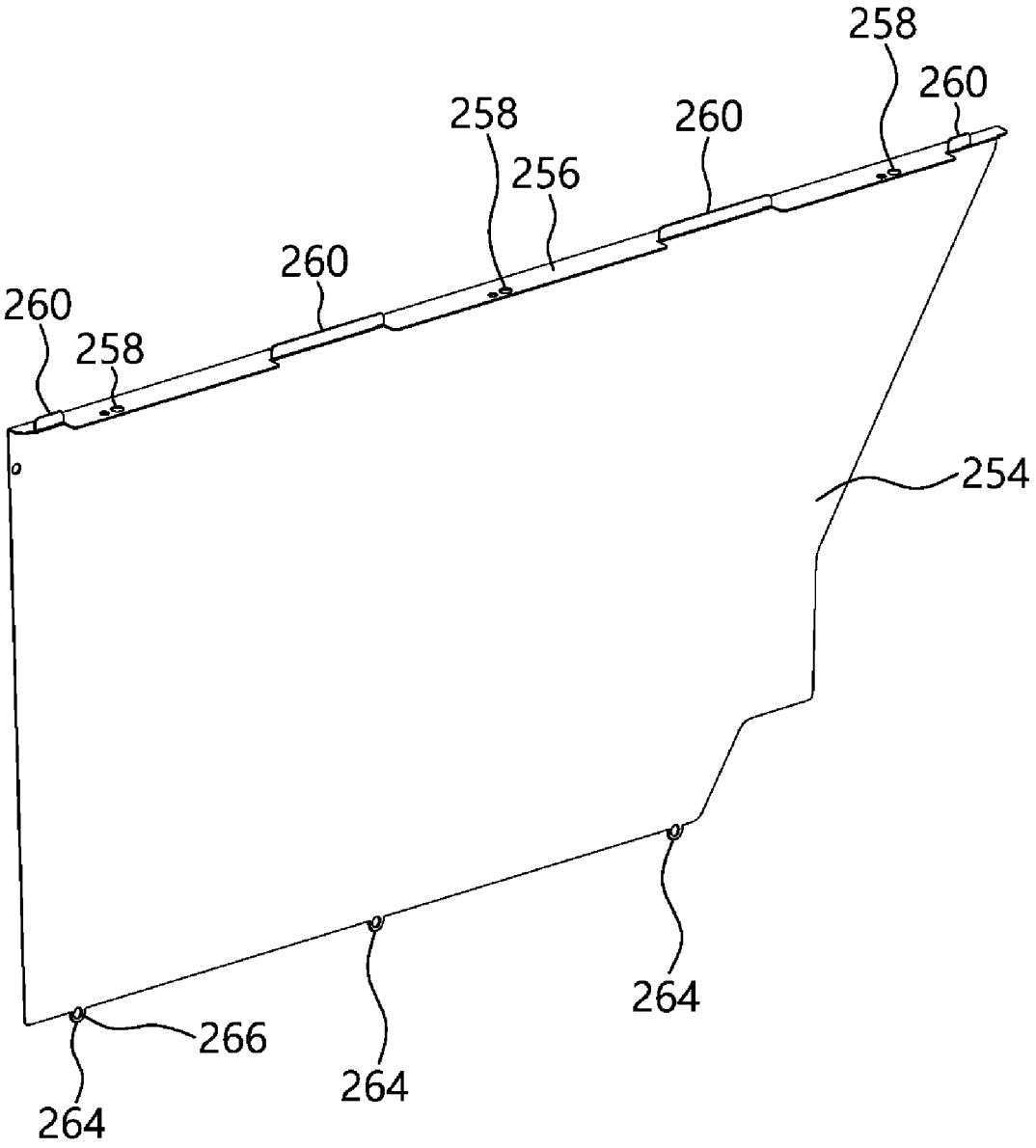
FIG. 39 is a perspective view showing a structure of an inside cover according to an example embodiment of the present disclosure.
Figure 40:
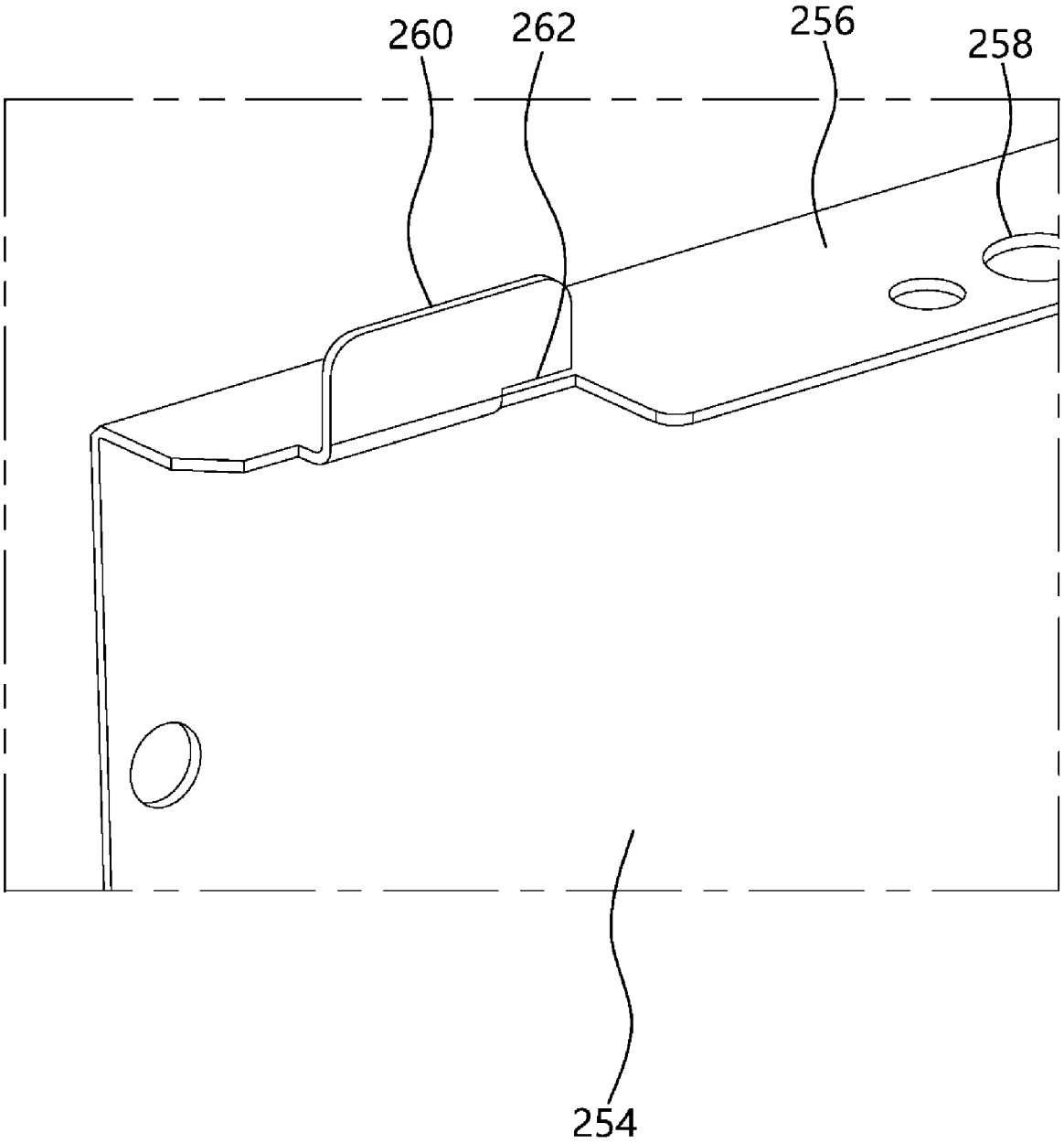
FIG. 40 is an enlarged-perspective view showing a structure of a fixing end according to an example embodiment of the present disclosure.

FIG. 35 is a perspective view showing a structure of the storage bin according to an example embodiment of the present disclosure. FIG. 36 is an exploded-perspective view showing the structure of the storage bin according to an example embodiment of the present disclosure. FIG. 37 is an exploded-perspective view showing a structure of a storage body and a side cover module according to an example embodiment of the present disclosure. FIG. 38 is an enlarged-perspective view showing an inside cover that is mounted to an inside surface of the storage body according to an example embodiment of the present disclosure. FIG. 39 is a perspective view showing a structure of an inside cover according to an example embodiment of the present disclosure. FIG. 40 is an enlarged-perspective view showing a structure of a fixing end according to an example embodiment of the present disclosure.

The storage bin 220 may include a storage body 222, a front surface cover 224, a bottom surface cover 226, a rear surface cover 228, and a side cover module 250.

The storage body 222 may be in a box shape being open upwardly, and fixed to a rear side of the front panel 210. The storage body 222 is fixed to the front panel 210 and forms a space in which food or the container 240 is stored.

On an inside surface of the storage body 222, the front surface cover 224, the bottom surface cover 226, and the rear surface cover 228 are provided. The front surface cover 224, the bottom surface cover 226, and the rear surface cover 228 are formed of a metal material (such as stainless steel), and formed in plate shapes corresponding to an inside front surface, a bottom surface, and an inside rear surface of the storage body 222. The front surface cover 224, the bottom surface cover 226, and the rear surface cover 228 may be formed of a metal material (such as stainless steel), and the covers 224, 226, and 228 are respectively provided at a front surface, a bottom surface, and a rear surface based on the inside surface of the storage body 222, thereby forming an inside appearance of the storage body 222.

The inside of the storage body 222 may be divided into a front space S1 and a rear space S2. The front space S1 may receive the raising/lowering module 300 (or lift module) and the container 240 therein, and the raising/lowering module 300 may be folded and unfolded in a vertical direction to raise and lower food or the container 240 seated on the raising/lowering module 300 together.

The raising/lowering module 300 may be provided below the container 240, and the raising/lowering module 300 may be covered by the container 240 when the container 240 is installed in the storage bin. Accordingly, the raising/lowering module 300 is not exposed to the outside.

The rear space S2 may be provided with a separate storage cover 242. The front space S1 and the rear space S2 may be partitioned from each other by the storage cover 242. When the storage cover 242 is installed therein, a front surface and an upper surface of the rear space S2 are shielded so that unused space thereof is not exposed to the outside.

By mounting of the storage cover 242, when the front panel 210 is pushed out, the storage cover 242 may cover the rear space S2 and only the front space S1 may be exposed to the outside in this state of pushing out the front panel 210, thus a more neat appearance may be provided.

The storage cover 242 may cover the remaining space except for the space in which the raising/lowering module 300 and the container 240 are installed to prevent problems such as food falling or items caught in a gap during raising.

At opposite surfaces of the storage body 222, the side cover modules 250 may be installed. The side cover modules 250 are respectively installed at left and right surfaces of the storage body 222, and may provide an appearance of an inside surface of the storage body 222.

Since the side cover modules 250 installed at the left and right surfaces of the storage body 222 have the same structure, hereinafter, the side cover modules 250 may be described in detail based on a side cover module 250 at the right surface of the storage body 222.

The side cover module 250 may include an inside cover 252 and an outside cover 282. The inside cover 252 is fixed to an inside surface of the storage body 222 and may protect the inside surface of the storage body 222. The outside cover 282 may be fixed to an outside surface of the storage body 222 and may cover the outside surface of the storage body 222.

The inside cover 252 may include an inside plate 254, an upper plate 256, and the fixing end 260. The inside plate 254 may be a plate corresponding to the inside surface of the storage body 222 and attached thereto. The inside plate 254 is installed at the inside surface of the storage body 222 and forms appearance of the inside surface of the storage body 222.

The upper plate 256 is provided at an upper end of the inside plate 254. The upper plate 256 protrudes from the front to the rear along the upper end of the inside plate 254. The upper plate 256 is formed by being bent leftwards or rightwards along the upper end of the inside plate 254 and is coupled to an upper surface of a side surface 223 of the storage body 222. An upper surface of the upper plate 256 is a part where the outside cover 282 is fixedly installed.

A fastening hole 258 is provided at the upper surface of the upper plate 256. A plurality of fastening holes 258 are provided along the upper plate 256 at a regular interval, and are provided by penetrating the upper surface of the upper plate 256. A fastening screw (or other coupling member) may be coupled into the fastening hole 258 so that the upper plate 256 is firmly fixed on the upper end of the side surface 223 of the storage body 222.

The fixing end 260 is provided on the upper surface of the upper plate 256. A plurality of fixing ends 260 protrude along the upper surface of the upper plate 256 at a regular interval, as shown in FIG. 39.

The fixing end 260 is formed such that a part of the upper plate 256 is bent perpendicularly, and protrudes in a front to rear long shape on the upper surface of the upper plate 256. One side of the fixing end 260 is where a locking end 292 of the outside cover 282 is coupled.

A fixing groove 262 is at a lower portion of the fixing end 260. The fixing groove 262 is recessed by a predetermined depth from a rear lower side of the fixing end 260, as shown in FIG. 40. The locking end 292 is fixedly inserted into the inside of the fixing groove 262.

A screw fastening rib 264 is at a lower end of the inside plate 254. The screw fastening rib 264 has an arc shape. A plurality of screw fastening ribs 264 protrude along the lower end of the inside plate 254 at a regular interval. The screw fastening rib 264 has a screw fastening hole 266 at a side surface thereof for penetrating from side to side. A fastening screw may be coupled to the screw fastening hole 266 (of the screw fastening rib 264) by screw coupling to firmly fix the inside plate 254 on the inside surface of the storage body 222.

Figure 41:
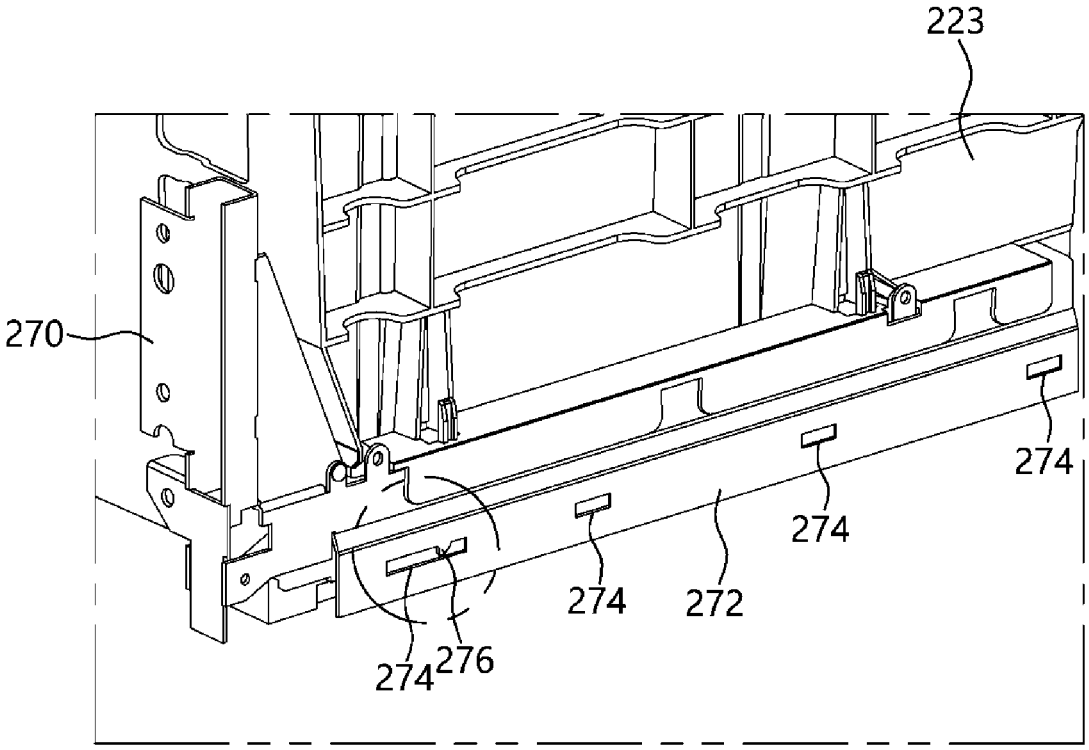
FIG. 41 is a perspective view showing a structure of a door fixing bracket that is provided at a lower end of a side surface of the storage body according to an example embodiment of the present disclosure.
Figure 42:
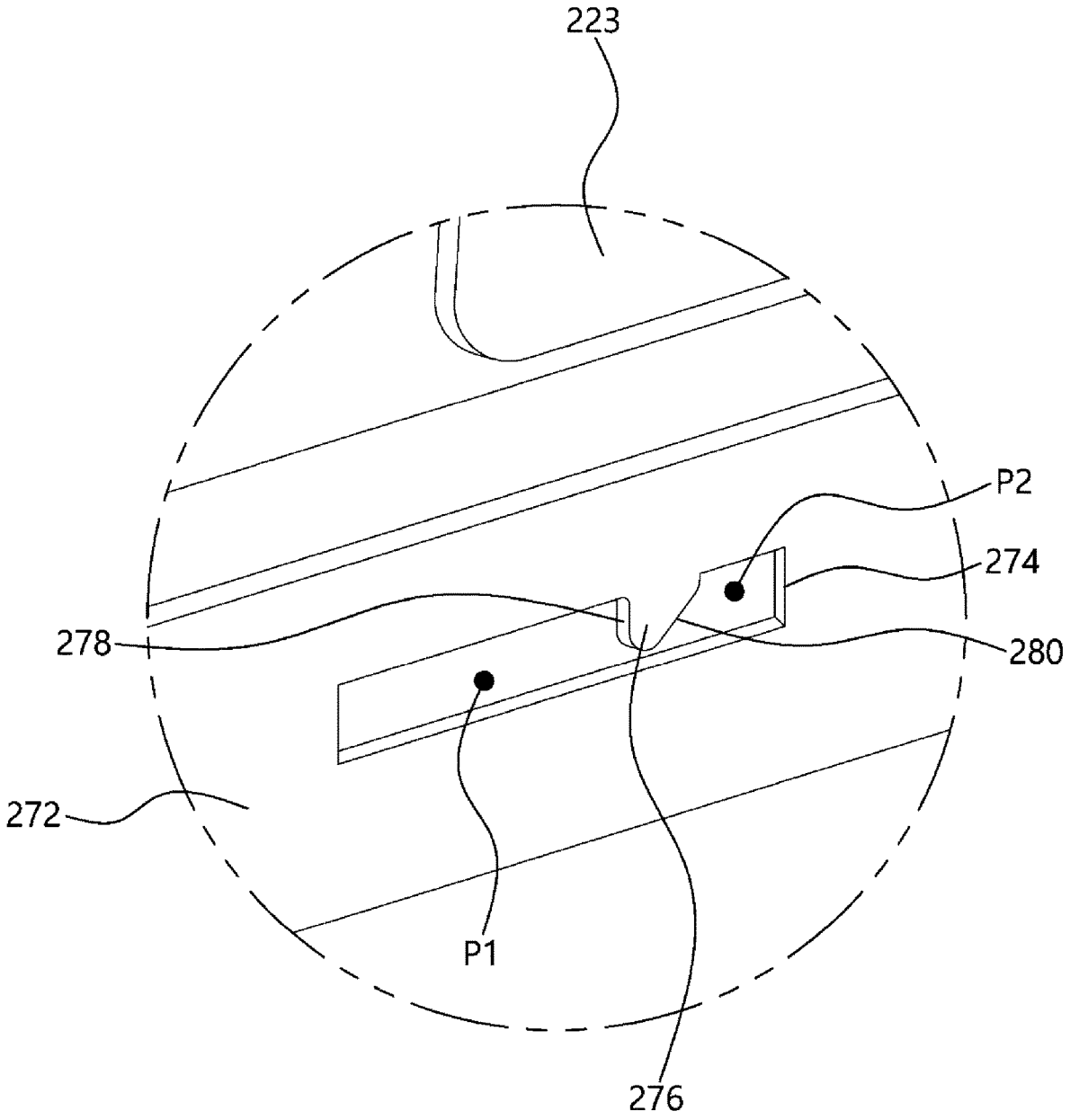
FIG. 42 is an enlarged-perspective view showing a structure of a fixing guide rib provided inside a locking hole according to an example embodiment of the present disclosure.

FIG. 41 is a perspective view showing a structure of a door fixing bracket that is provided at a lower end of the side surface of the storage body according to an example embodiment of the present disclosure. FIG. 42 is an enlarged-perspective view showing a structure of a fixing guide rib provided inside a locking hole according to an example embodiment of the present disclosure.

Door fixing brackets 268 are respectively installed at opposite side surfaces of the storage body 222 (see FIG. 37). The door fixing bracket 268 may include a front frame 270 provided at a front lower portion of the storage body 222 and a side frame 272 provided at a side lower portion of the storage body 222.

The front frame 270 may be made of a metal frame having a vertically long shape, and may be fixedly installed on an edge of a lower portion of a front surface of the storage body 222. The front panel 210 may be fixedly installed at a front surface of the front frame 270.

The side frame 272 is provided in rear of the front frame 270. The side frame 272 may be a metal frame and in the front to rear long shape, and may be fixedly provided at a lower portion of the side surface of the storage body 222. The side frame 272 may be integrally provided with the front frame 270, and may support the lower portion of the side surface of the storage body 222.

That is, when the front frame 270 and the side frame 272 (of the door fixing bracket 268) are fixed to the front surface and the side surface of the storage body 222, as the front panel 210 is fixed to the front frame 270, the front panel 210 and the storage body 222 are firmly fixed to each other.

The locking hole 274 is provided at a side surface of the side frame 272. The locking hole 274 has a rectangular shape and may penetrate the side surface of the side frame 272 from side to side. A plurality of locking holes 274 may be provided at a regular interval along the side surface of the side frame 272. A side hook portion 302 (or side hook) may be locked in the locking hole 274.

A fixing guide rib 276 is provided at any one of locking holes. In an example embodiment, the fixing guide rib 276 is provided inside a locking hole 274 positioned in the foremost of the side frame 272, but the fixing guide rib 276 may be provided in the locking hole 274 in a different position depending on a design condition of a designer, and the plurality of locking holes 274 may each have a fixing guide rib 276.

As shown in FIG. 42, the fixing guide rib 276 may protrude from an inside surface of the locking hole 274. The fixing guide rib 276 may protrude downward from an upper surface thereof based on the inside surface of the locking hole 274. The fixing guide rib 276 may have a right triangular shape and may protrude toward the inside of the locking hole 274.

The fixing guide rib 276 is provided inside the locking hole 274 to partition the inside into an insertion space P1 and a locking space P2.

The fixing guide rib 276 may have a locking surface 278 at the left and a guide surface 280 at the right. The locking surface 278 may protrude vertically from the upper surface based on the inside surface of the locking hole 274. When a side fixing protrusion 304 is positioned in the locking space P2 of the locking hole 274, the locking surface 278 prevents rearward movement of the side fixing protrusion 304 by being in close contact with a side surface of the side fixing protrusion 304.

The guide surface 280 may be inclined such that a front side thereof is further lower than a rear side thereof based on the inside surface of the locking hole 274. When the side fixing protrusion 304 is inserted into the insertion space P1 and then moved forward, the guide surface 280 may guide the side fixing protrusion 304 to the locking space P2 by contacting the side fixing protrusion 304.

The fixing guide rib 276 may protrude toward the inside of the locking hole 274 and function to guide the forward movement of the side fixing protrusion 304 and to prevent the rearward movement thereof.

Figure 43:
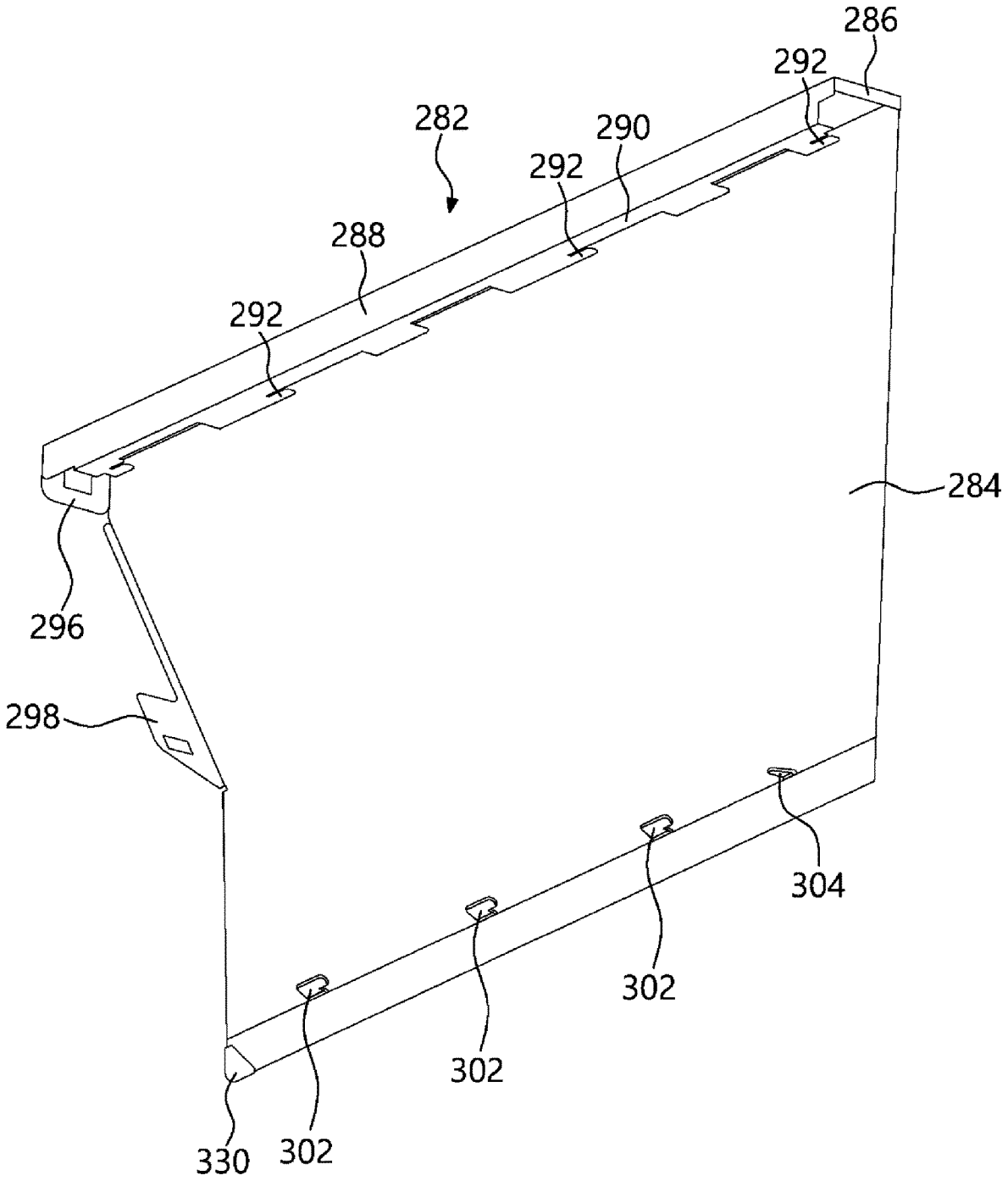
FIG. 43 is a perspective view showing a structure of an outside cover according to an example embodiment of the present disclosure.
Figure 44:
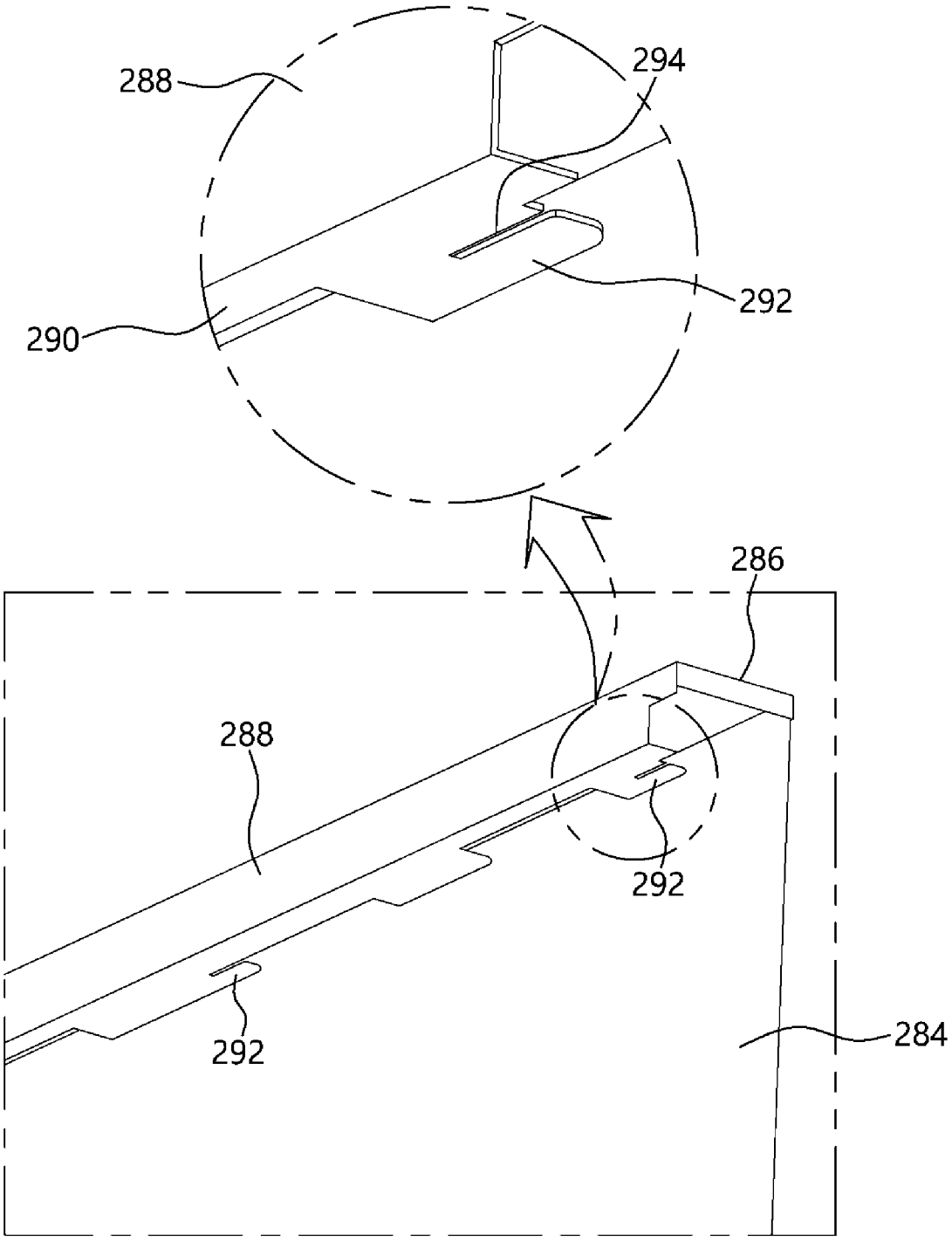
FIG. 44 is an enlarged-perspective view showing a structure of a locking end according to an example embodiment of the present disclosure.
Figure 45:
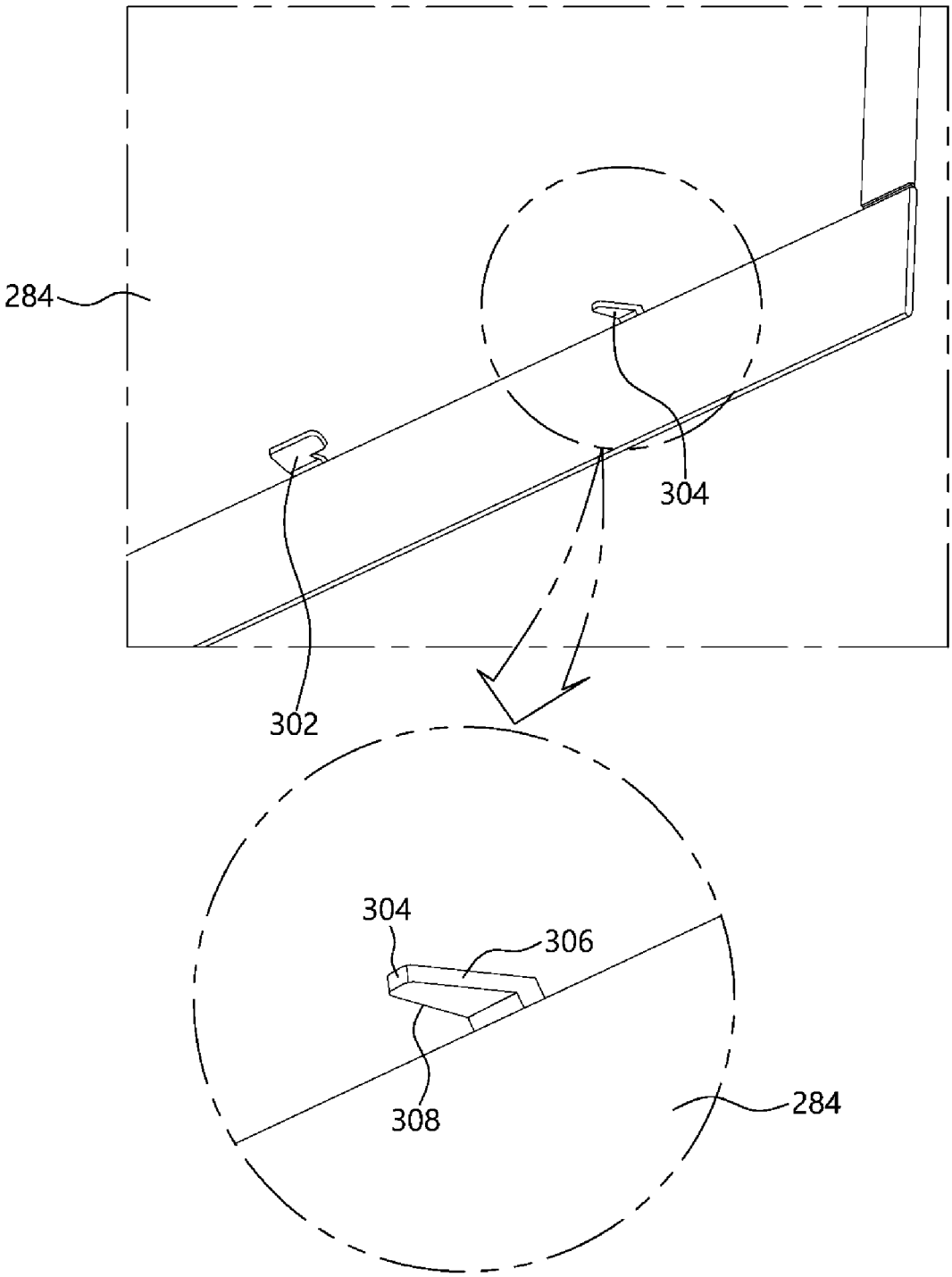
FIG. 45 is an enlarged-perspective view showing a side hook part and a side fixing protrusion according to an example embodiment of the present disclosure.

FIG. 43 is a perspective view showing a structure of an outside cover according to an example embodiment of the present disclosure. FIG. 44 is an enlarged-perspective view showing a structure of the locking end according to an example embodiment of the present disclosure. FIG. 45 is an enlarged-perspective view showing a side hook part and the side fixing protrusion according to an example embodiment of the present disclosure.

In FIGS. 43 to 45, the right side is described as the front and the left side is described as the rear in order to describe the structure of the locking end 292 of the outside cover 282.

The outside cover 282 may include an outside plate 284, a cover plate 286, an extending plate 288, the locking end 292, and so on.

The outside plate 284 may be a plate corresponding to the outside surface of the storage body 222 and may be fixedly installed at the outside surface of the storage body 222. The outside plate 284 may be installed at the outside surface of the storage body 222 to form appearance of the outside surface of the storage body 222.

The cover plate 286 is installed on an upper end of the outside plate 284. The cover plate 286 may protrude in the front to rear long shape along the upper end of the outside plate 284. The cover plate 286 may be bent leftwards or rightwards along the upper end of the outside plate 284 and function to protect the upper end of the side surface of the storage body 222.

The extending plate 288 may be at a left end of the cover plate 286. The extending plate 288 may have the front to rear long shape along a left surface of the cover plate 286. The extending plate 288 may be bent downward from the cover plate 286 and support a fixing plate 290.

The fixing plate 290 may be at a lower end of the extending plate 288. The fixing plate 290 may protrude in the front to rear long shape along the lower end of the extending plate 288. The fixing plate 290 may be bent toward the outside plate 284 and support the locking end 292 described below.

A plurality of locking ends 292 may protrude from a side surface of the fixing plate 290. Each locking end 292 may protrude toward the outside plate 284 along the side surface of the fixing plate 290, as shown in FIG. 43. A locking groove 294 may be provided in the front of the locking end 292. The locking groove 294 may be recessed rearward from the front of the locking end 292 by a predetermined depth. The fixing end 260 may be fixedly inserted into the inside of the locking groove 294.

An upper locking step 296 is provided at a rear end of the cover plate 286. The upper locking step 296 may be bent downward from the rear end of the cover plate 286. The upper locking step 296 may be in close contact with the side surface of the storage body 222, thereby protecting the side surface of the storage body 222 and restricting front movement of the outside cover 282.

A side locking step 298 is provided at a rear surface of the outside plate 284. The side locking step 298 is formed at the center of the rear surface of the outside plate 284 and may be bent toward the storage body 222.

When the outside cover 282 is installed to the storage body 222, the side locking step 298 may restrict the forward movement of the outside cover 282 by being in close contact with the side surface of the storage body 222.

The side hook portion 302 may be provided at a lower portion of a side surface of the outside plate 284. The side hook portion 302 may be in a hook shape and protrude at a regular interval along the side surface of the outside plate 284. The side hook portion 302 may protrude toward the storage body 222 and may be fixedly locked into the locking hole 274 of the door fixing bracket 268.

That is, when the outside cover 282 is installed to the storage body 222, the side hook portion 302 is fixed to the locking hole 274 to allow the side surface of the outside cover 282 to be locked to the side surface of the storage body 222.

The side fixing protrusion 304 is provided in the front of the surface of the outside plate 284. The side fixing protrusion 304 is formed in a right triangular shape and protrudes toward the storage body 222 from a lower portion of the side surface of the outside plate 284. The side fixing protrusion 304 may be inserted into the locking hole 274 and moved forward along the inside of the locking hole 274 and fixedly locked by the fixing guide rib 276.

The side fixing protrusion 304 may have a guide surface 306 and a locking surface 308 at front and rear surfaces thereof, respectively. The guide surface 306 may be inclined by a predetermined angle from the front to the rear. The guide surface 306 is in close contact with the guide surface 280 of the fixing guide rib 276, and at the same time, is moved in downward inclined manner along the guide surface 280, thereby guiding the side fixing protrusion 304 to the locking space P2 of the locking hole 274.

The locking surface 308 may protrude perpendicularly toward the storage body 222. The locking surface 308 is locked to the locking surface 278 of the fixing guide rib 276 and may prevent the side fixing protrusion 304 being moved from the locking space P2 to the insertion space P1.

Figure 46:
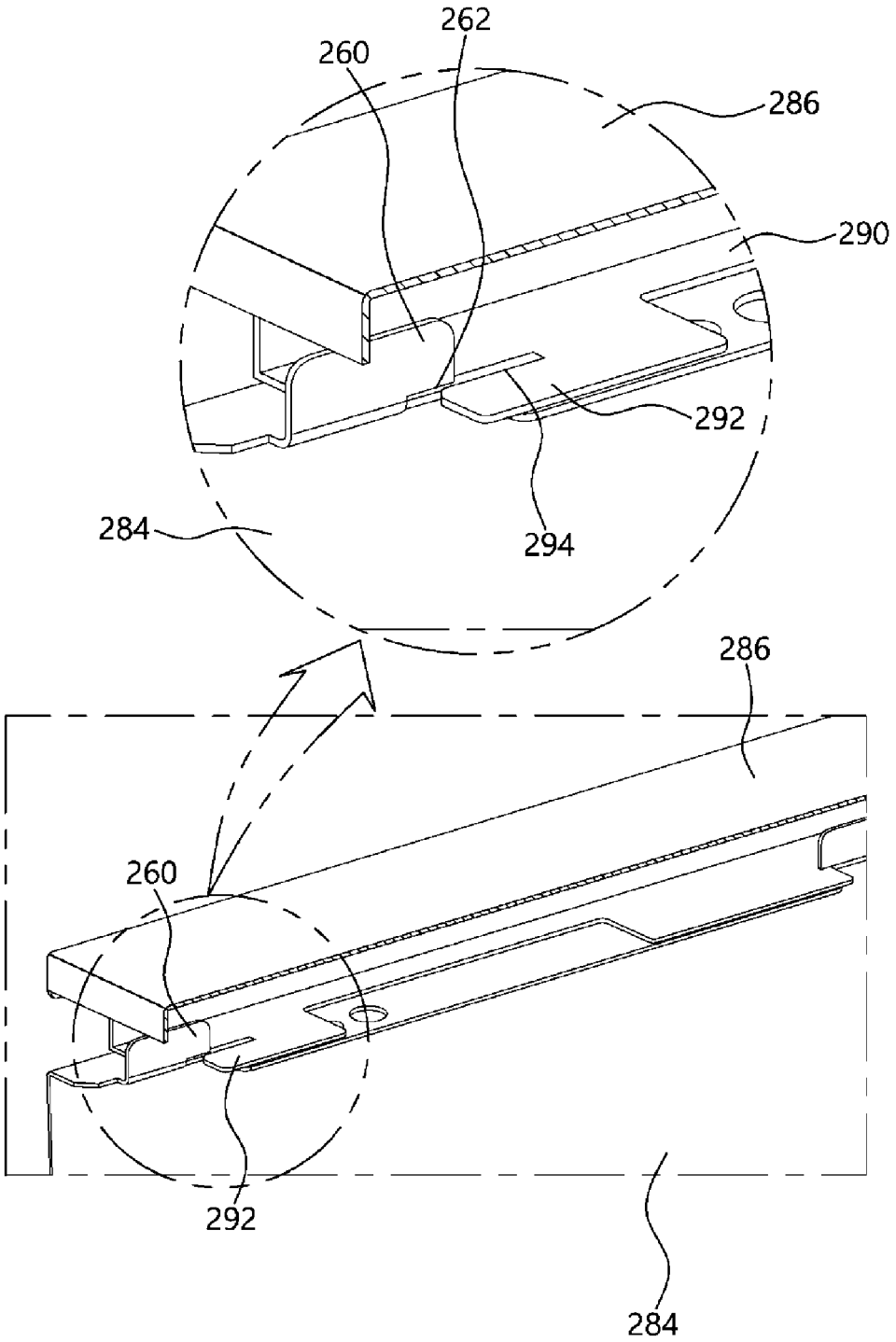
FIG. 46 is an enlarged-perspective view showing a state before the locking end is engaged with the fixing end in a sliding manner according to an example embodiment of the present disclosure.
Figure 47:
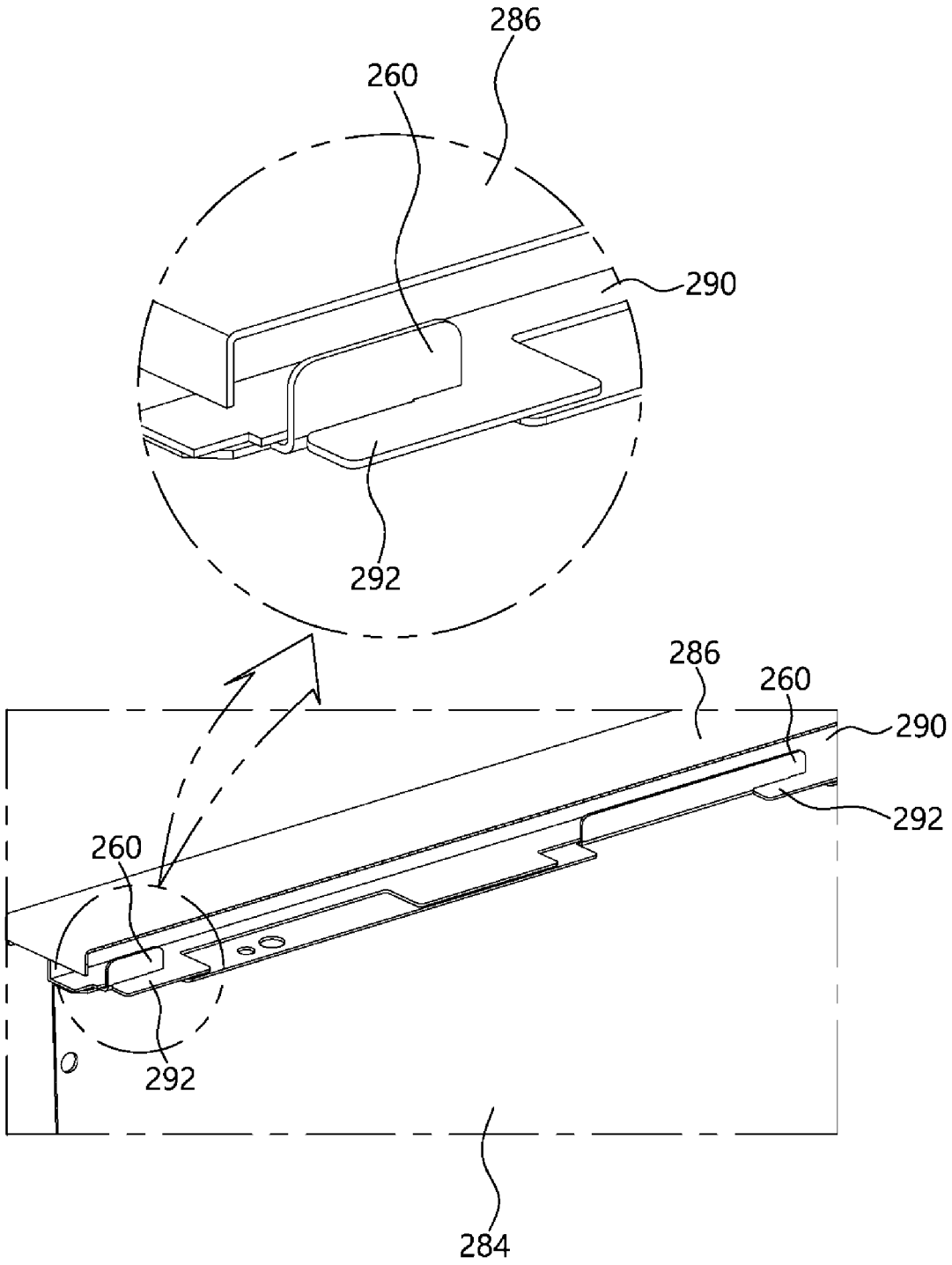
FIG. 47 is an enlarged-perspective view showing a state in which the locking end is engaged with the fixing end in the sliding manner.
Figure 48:
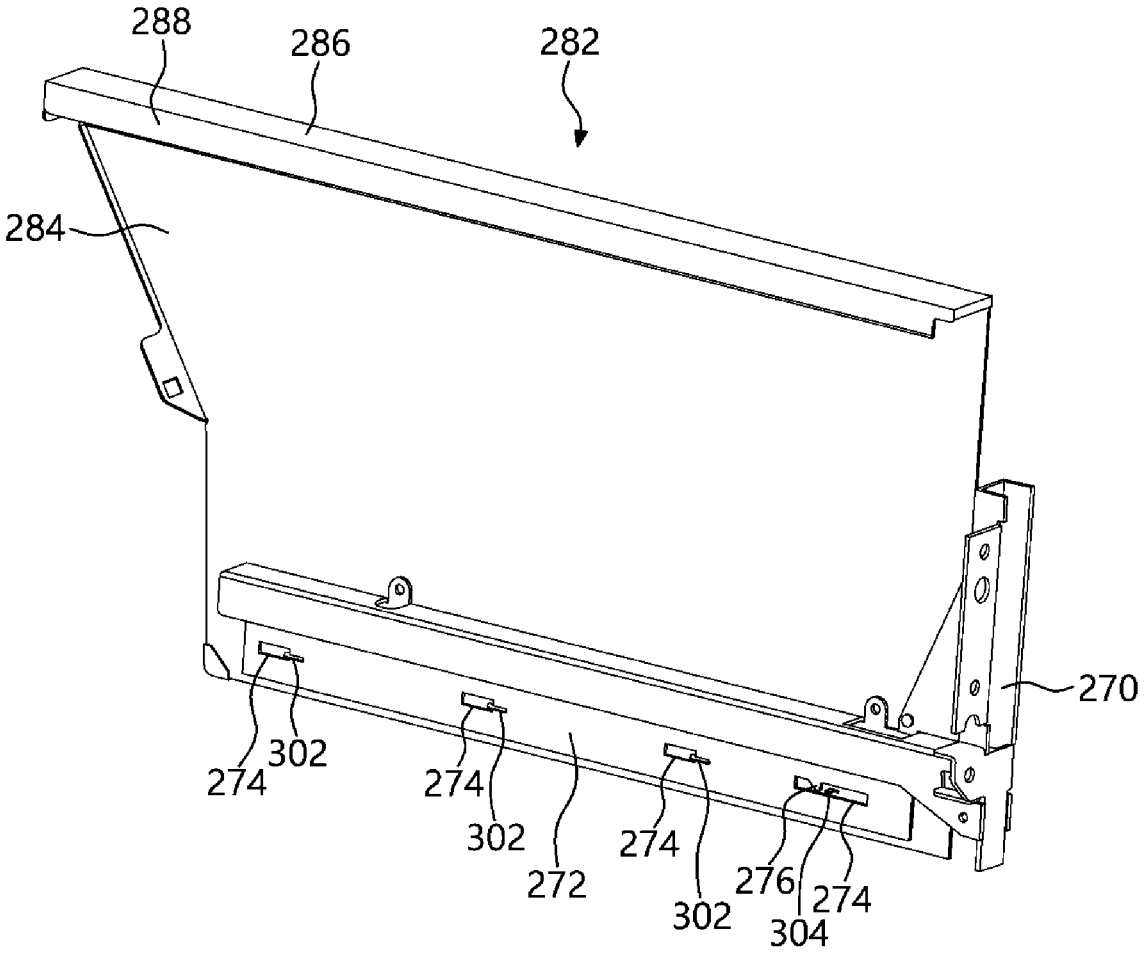
FIG. 48 is a perspective view showing a state in which the side hook part and the side fixing protrusion of the outside cover are locked to the locking hole of the door fixing bracket.
Figure 49:
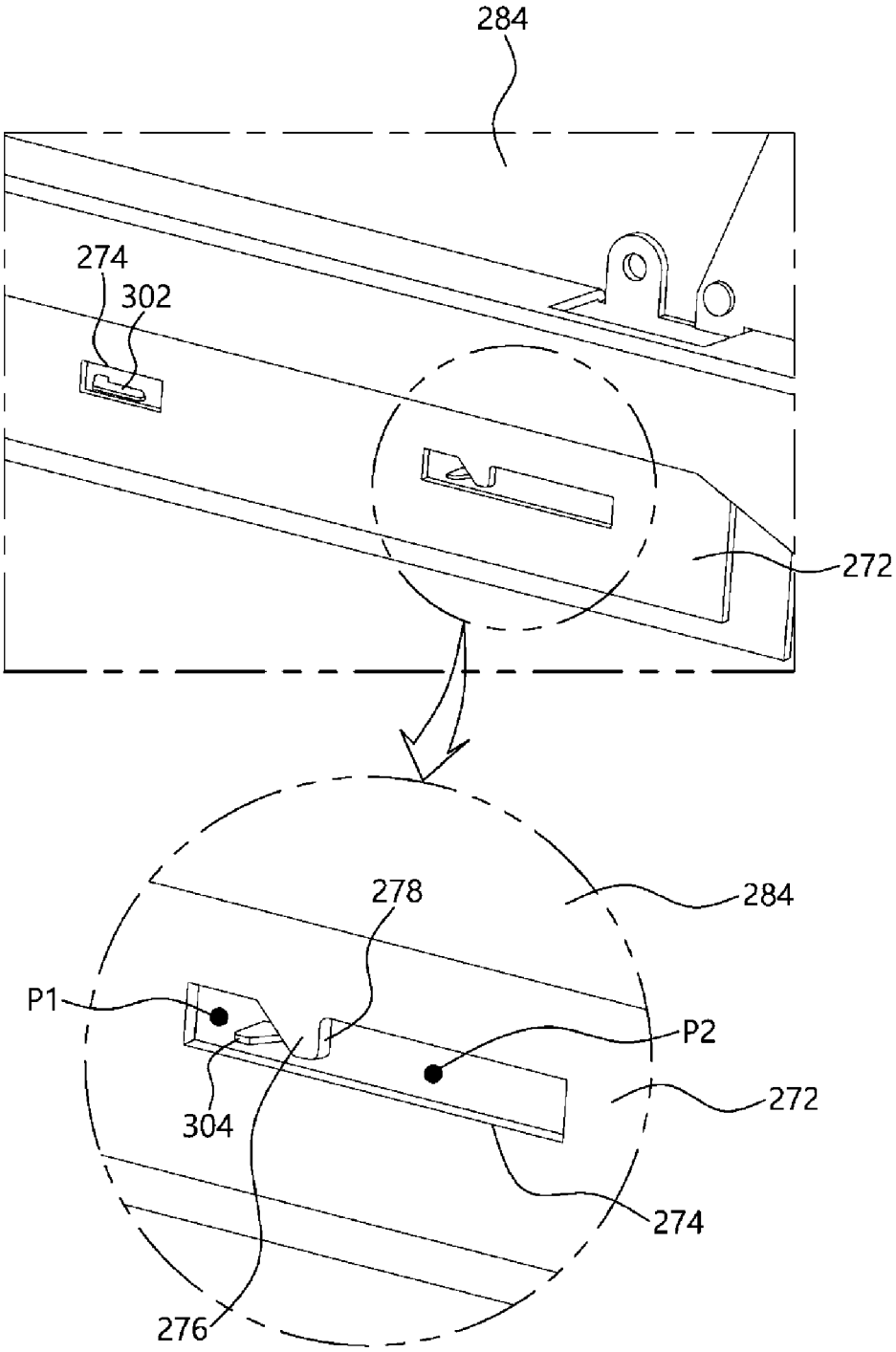
FIG. 49 is an enlarged-perspective view showing a state in which the side fixing protrusion is inserted into an insertion space of the locking hole.
Figure 50:
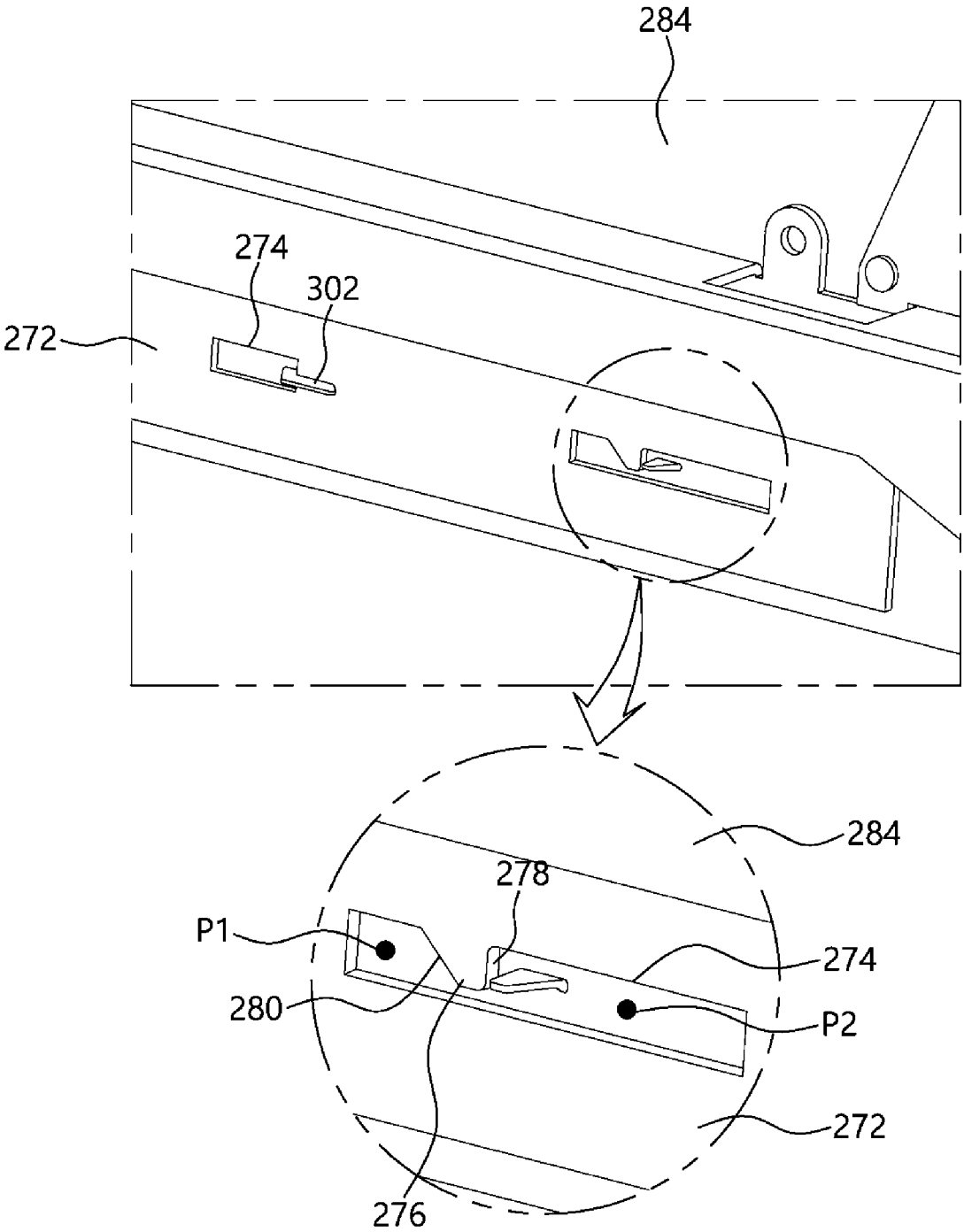
FIG. 50 is an enlarged-perspective view showing a state in which the side fixing protrusion is inserted into a locking space of the locking hole.

FIG. 46 is an enlarged-perspective view showing a state before the locking end is engaged with the fixing end in a sliding manner according to an example embodiment of the present disclosure. FIG. 47 is an enlarged-perspective view showing a state in which the locking end is engaged with the fixing end in the sliding manner. FIG. 48 is a perspective view showing a state in which the side hook part and the side fixing protrusion of the outside cover are locked in the locking hole of the door fixing bracket. FIG. 49 is an enlarged-perspective view showing a state in which the side fixing protrusion is inserted into the insertion space of the locking hole. FIG. 50 is an enlarged-perspective view showing a state in which the side fixing protrusion is inserted into the locking space of the locking hole.

An operation in which the outside cover 282 is coupled to the inside cover 252 in a sliding manner and fixed thereto may be described in detail.

In order to mount the outside cover 282 to the inside cover 252, the locking end 292 of the outside cover 282 is placed on an upper surface of the inside cover 252 fixed to the storage body 222, as shown in FIG. 46.

The locking end 292 (of the outside cover 282) is positioned in rear of the fixing end 260 that protrudes at the regular interval on the upper surface of the inside cover 252.

The side hook portions 302 and the side fixing protrusion 304 are respectively inserted into the locking holes 274 of the door fixing bracket 268 that is fixed to the side surface of the storage body 222.

The outside cover 282 is moved from the rear to the front along the side surface of the storage body 222. Accordingly, as shown in FIG. 47, the locking end 292 is inserted into the fixing groove 262 of the fixing end 260, and the fixing end 260 is inserted into the locking groove 294 of the locking end 292.

Accordingly, as the locking end 292 is fixed to the fixing end 260, the upper end of the outside cover 282 is firmly attached to the upper end of the inside cover 252 that is attached to the storage body 222.

In FIGS. 48 to 50, the right is described as the front and the left is described as the rear.

The side hook portion 302 inserted in the locking hole 274 of the door fixing bracket 268 is locked by a front wall surface of the locking hole 274, as shown in FIG. 50.

The side fixing protrusion 304 may move from the rear to the front inside the locking hole 274. The guide surface 306 of the side fixing protrusion 304 may be guided from the insertion space P1 to the locking space P2 along the guide surface 280 of the fixing guide rib 276.

Accordingly, as the side fixing protrusion 304 move from the insertion space P1 to the locking space P2 in the locking hole 274, the side surface of the outside cover 282 is firmly attached to the side surface of the storage body 222.

When the outside cover 282 is separated from the side surface of the storage body 222, by performing the above process in reverse order, an operator can easily separate the outside cover from the storage body 222.

Figure 51:
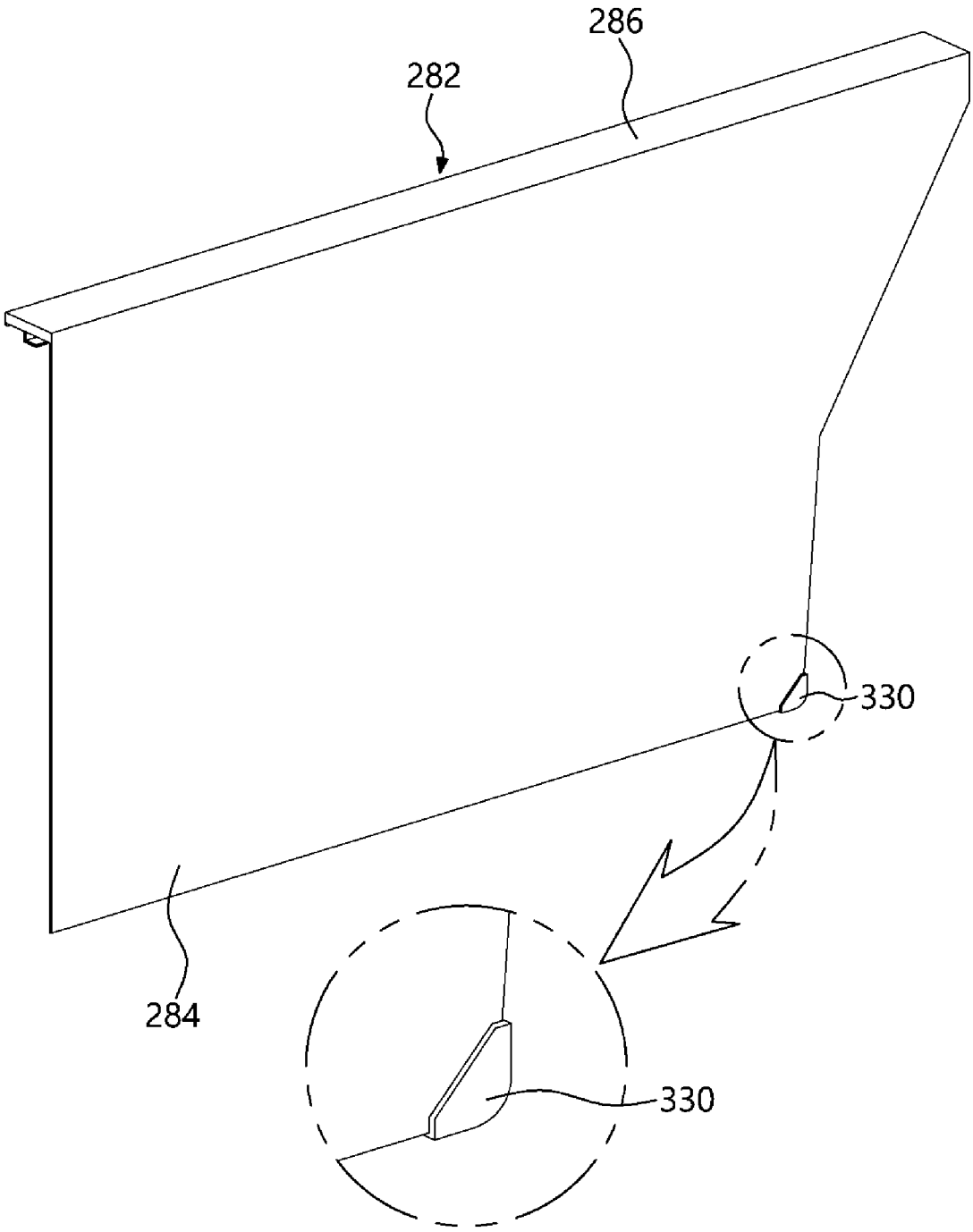
FIG. 51 is a perspective view showing a state in which a scratch prevention member is provided at an edge of the outside cover according to an example embodiment of the present disclosure.
Figure 52:
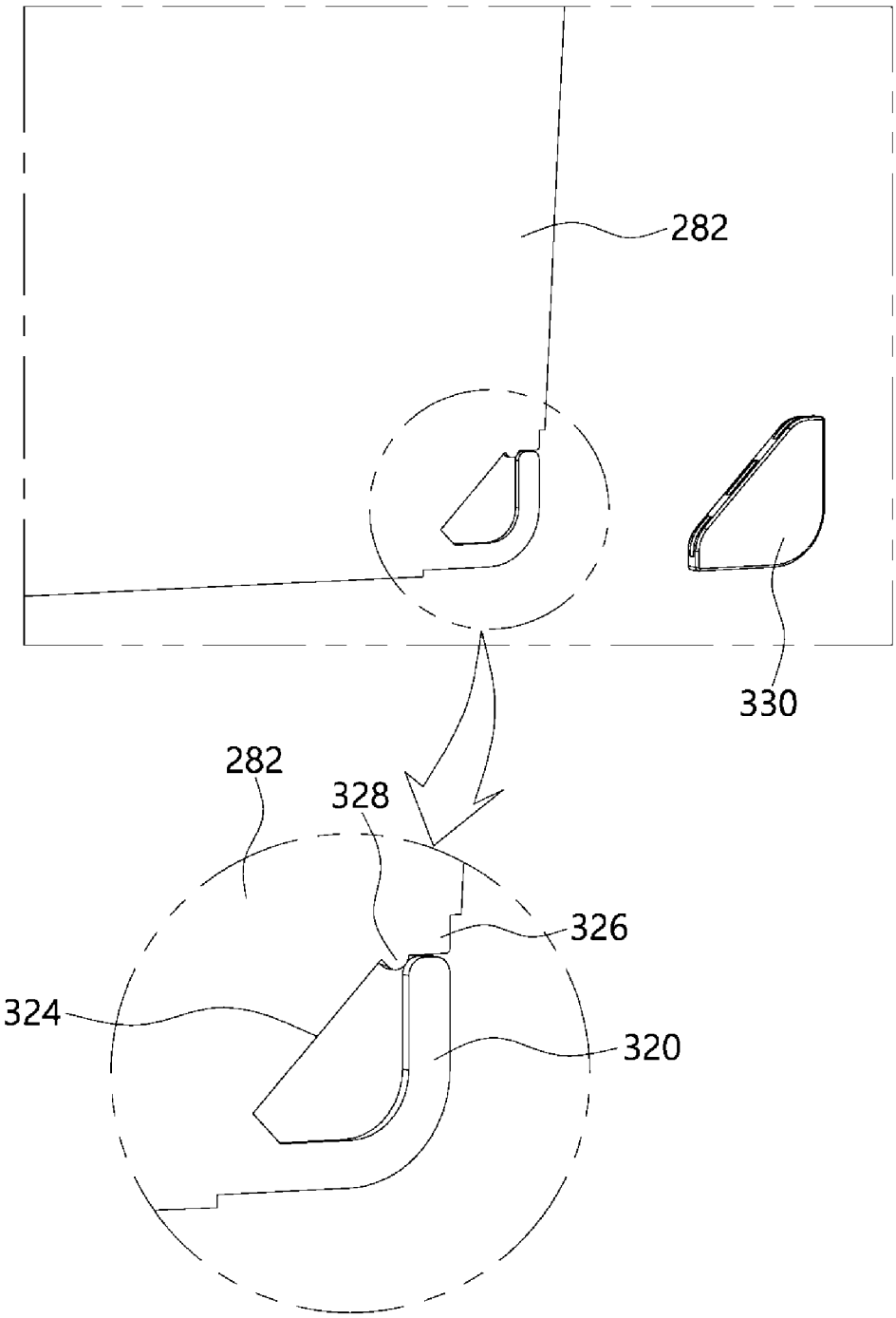
FIG. 52 is an enlarged-perspective view showing a state in which the scratch prevention member is separated from a fixing rib according to an example embodiment of the present disclosure.
Figure 53:
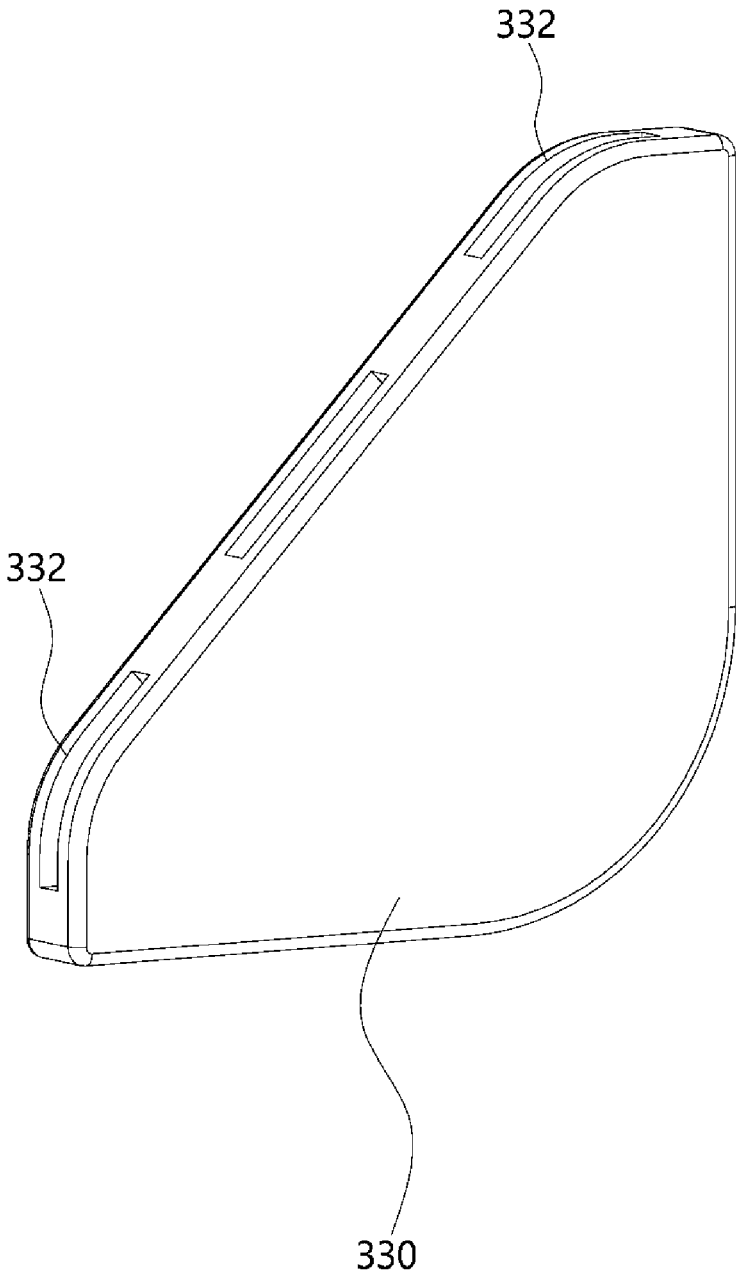
FIG. 53 is a perspective view showing the scratch prevention member according to an example embodiment of the present disclosure.
Figure 54:
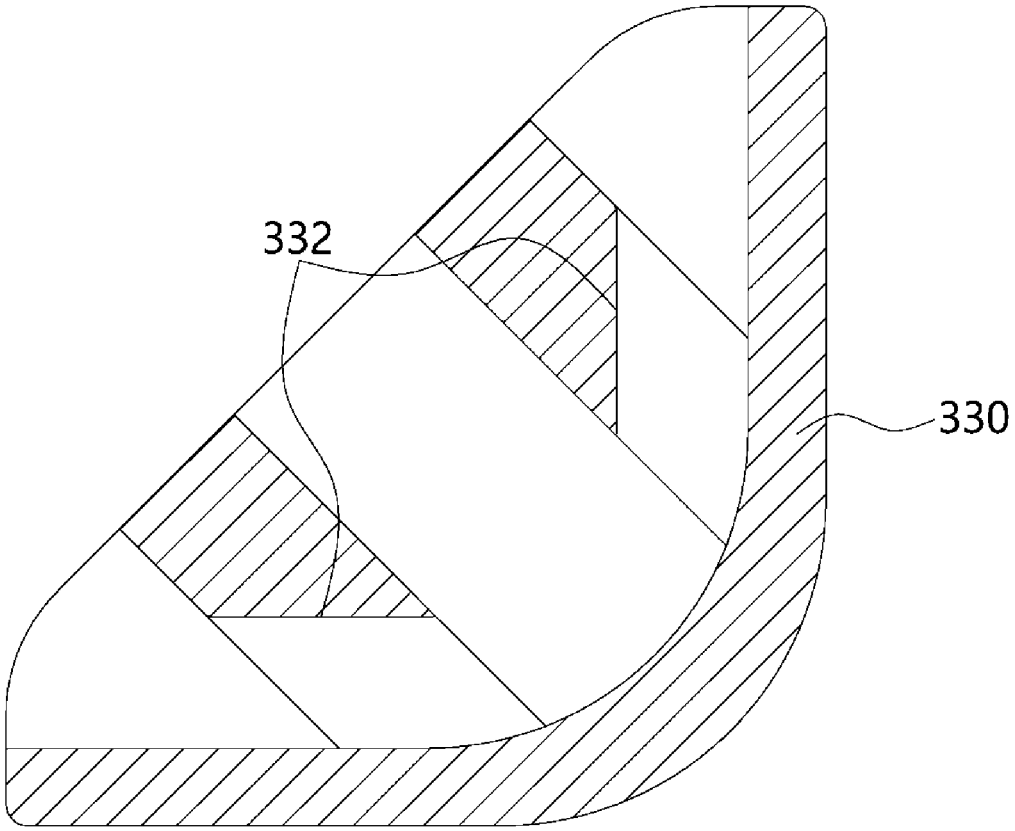
FIG. 54 is a sectional view showing the scratch prevention member according to an example embodiment of the present disclosure.

FIG. 51 is a perspective view showing a state in which a scratch prevention member is provided at an edge of the outside cover according to an example embodiment of the present disclosure. FIG. 52 is an enlarged-perspective view showing a state in which the scratch prevention member is separated from a fixing rib according to an example embodiment of the present disclosure. FIG. 53 is a perspective view showing the scratch prevention member according to an example embodiment of the present disclosure. FIG. 54 is a sectional view showing the scratch prevention member according to an example embodiment of the present disclosure.

The fixing rib 320 is provided at a lower edge of the outside cover 282. The fixing rib 320 is a plate having a predetermined thickness, as shown in FIG. 52, and is formed in a round shape by being bent. The fixing rib 320 may be a metal material and may be integrally formed with the outside cover 282. The fixing rib 320 may be inserted into the inside of the scratch prevention member 330, thereby fixing the scratch prevention member 330 to the edge of the outside cover 282. The scratch prevention member may also be called a scratch preventer.

A cut portion 322 may be provided at an end of the fixing rib 320. The cut portion 322 may be in a shape of cutting the end of the fixing rib 320, so that the fixing rib 320 may be elastically deformed upward and downward.

As the fixing rib 320 is formed in a bent shape that is rounded along the lower edge of the outside cover 282, and has the cut portion 322 at the end thereof, the operator may easily deform the fixing rib 320 in a desired direction of the operator, whereby coupling of the scratch prevention member 330 may be performed.

A mounting groove 324 may be provided at the inside of the fixing rib 320. The mounting groove 324 may be in a rough triangular shape by cutting inside the lower edge of the outside cover 282. A part of the scratch prevention member 330 may be inserted into the mounting groove 324 for fixation.

A fixing protrusion 326 is provided at the end side of the fixing rib 320. The fixing protrusion 326 may protrude from the edge of the outside cover 282. The fixing protrusion 326 may protrude toward the fixing rib 320, and coupled to a fixing rib insertion hole 332 of the scratch prevention member 330. The fixing protrusion 326 is inserted into the scratch prevention member 330 and functions to further fix the scratch prevention member 330 to the outside cover 282.

The deformation preventing protrusion 328 is provided at a left lower surface of the fixing protrusion 326. The deformation preventing protrusion 328 protrudes downward from the left lower surface of the fixing protrusion 326 by a predetermined height, as shown in FIG. 52. The deformation preventing protrusion 328 may protrude toward the fixing rib 320, thereby preventing the fixing rib 320 from being deformed toward the mounting groove 324.

The scratch prevention member 330 is installed outside the fixing rib 320. The scratch prevention member 330 is formed of an elastic material such as rubber or silicon and formed in a shape corresponding to the edge of the outside cover 282. The scratch prevention member 330 is installed to the lower edge of the outside cover 282 to protect the edge of the outside cover 282 and prevent damage due to hitting of to the edge.

The fixing rib insertion hole 332 is provided inside the scratch prevention member 330. The fixing rib insertion hole 332 is formed in a shape corresponding to the fixing rib 320 and is formed in a round bent shape by penetrating from a left lower end of the scratch prevention member 330 to a right upper end thereof.

The fixing rib 320 is mounted in the fixing rib insertion hole 332, whereby the scratch prevention member 330 is fixed to the lower edge of the outside cover 282.

That is, in a state where the fixing rib 320 is deformed from side to side by the cut portion 322, the fixing rib 320 is inserted into the scratch prevention member 330 along the fixing rib insertion hole 332, so that the scratch prevention member 330 may be easily installed to the edge of the outside cover 282.

Additionally, after the fixing rib 320 is mounted into the fixing rib insertion hole 332, the scratch prevention member 330 may be further fixed such that the fixing protrusion 326 is inserted into the fixing rib insertion hole 332.

Accordingly, the present disclosure has been made keeping in mind the above problems occurring in the related art, and the present disclosure is intended to provide a refrigerator having a drawer, wherein the drawer can be easily assembled and disassembled with a simple manipulation as an outside cover is locked to opposite sides of a storage body in a sliding manner.

The present disclosure is intended to provide a refrigerator having a drawer, wherein the outside cover that protects an outside surface of the storage body can be firmly assembled with the storage body without using a separate fixing component such as a screw.

The present disclosure is to provide a refrigerator having a drawer, wherein a scratch prevention member is provided at an edge of the outside cover, to prevent damage such as scratching or chipping to other parts due to the sharp edge during a process of assembling and disassembling the outside cover.

In order to achieve the above object, according to one aspect of the present disclosure, there is provided a refrigerator having a drawer.

In the refrigerator having the drawer, a locking end of an outside cover is cross-inserted into a fixing end of an inside cover to perform detaching and attaching of the outside cover, to easily assemble and disassemble the outside cover to an outside surface of a storage body.

In the refrigerator having the drawer, a plurality of fixing ends is formed by protruding at a regular interval on an upper surface of the inside cover, so that a portion where the outside cover is fixed can be increased.

In the refrigerator having the drawer, a fixing groove is provided at a lower end of the fixing end, so that upward and downward removing of the outside cover installed at the side surface of the storage body can be prevented.

In the refrigerator having the drawer, a locking groove is provided at one side of a side surface of the locking end, so that leftward and rightward removing of the outside cover installed at the side surface of the storage body can be prevented.

In the refrigerator having the drawer, door fixing brackets are respectively installed at opposite sides of the storage body for fixation of the front panel, so that the front panel is firmly fixed to the storage body.

In the refrigerator having the drawer, a plurality of locking holes is provided in the door fixing bracket, so that locking-fixation of a side hook part can be performed when the outside cover is assembled.

In the refrigerator having the drawer, the outside cover includes an outside plate, a cover plate, an extending plate, and the locking end, so that the side surface of the storage body can be protected.

In the refrigerator having the drawer, the outside cover has the side hook part, so that the side surface of the outside cover can be firmly fixed to a side surface of the door fixing bracket.

In the refrigerator having the drawer, a plurality of side hook parts is formed by protruding at a regular interval on the outside cover, so that a portion where the outside cover is fixed to the storage body can be increased.

In the refrigerator having the drawer, a fixing guide rib is provided inside one of the locking holes, so that the inside of the locking hole is divided into an insertion space and a locking space.

In the refrigerator having the drawer, a side fixing protrusion is provided at a lower side surface of the outside cover, so that the outside cover can be fixed to the side surface of the storage body by forward and rearward movement of the side fixing protrusion.

In the refrigerator having the drawer, the fixing guide rib is provided with a locking surface and a guide surface in the locking hole, so that the side fixing protrusion can be guided to be fixed.

In the refrigerator having the drawer, the side fixing protrusion is provided with a guide surface and a locking surface at the lower side surface of the outside cover, so that the side fixing protrusion can be guided to the locking space along the fixing guide rib.

In the refrigerator having the drawer, a scratch prevention member is provided at an edge of the outside cover, so to prevent damage such as scratching or chipping to other parts due to hitting of the edge.

In the refrigerator having the drawer, a fixing rib is provided at the edge of the outside cover, and the fixing rib is inserted into the scratch prevention member, so that the scratch prevention member can be firmly fixed to the edge of the outside cover.

In the refrigerator having the drawer, a cut portion is provided at an end of the fixing rib, and the fixing rib is elastically deformed when the fixing rib is inserted into the scratch prevention member, so that insertion operation of the scratch prevention member can be easily performed.

As described above, the refrigerator having the drawer of the present disclosure is configured such that the outside cover that is fixed to the opposite sides of the storage body in a sliding manner and thus the drawer door can be easily assembled and disassembled by a simple manipulation. Accordingly, assembling and disassembling of the refrigerator can be easily performed.

During assembling of the outside cover protecting the opposite sides of the storage body, a separate fixing component is not required to firmly assemble the outside cover at the side surface of the side surface of the storage body. Accordingly, the time period required to assemble and disassemble the outside cover can be decreased and usability of assembling and disassembling can be improved.

The scratch prevention member is provided at the edge of the outside cover. Accordingly, it is possible to prevent damage to the edge of the outside cover and to prevent damage such as scratching or chipping to other parts due to hitting of the edge during assembling of the outside cover.

The scope of the present disclosure is not limited to the embodiment described above, and those skilled in the art will appreciate that various modifications, additions and substitutions are possible, without departing from the scope and spirit of the disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application is also related to U.S. application Ser. No. 16/583,726 filed Sep. 26, 2019, U.S. application Ser. No. 16/582,647 filed Sep. 25, 2019, U.S. application Ser. No. 16/582,605 filed Sep. 25, 2019, U.S. application Ser. No. 16/582,712 filed Sep. 25, 2019, U.S. application Ser. No. 16/582,756 filed Sep. 25, 2019, U.S. application Ser. No. 16/582,810 filed Sep. 25, 2019, U.S. application Ser. No. 16/582,668 filed Sep. 25, 2019, U.S. application Ser. No. 16/582,755 filed Sep. 25, 2019, U.S. application Ser. No. 16/582,831 filed Sep. 25, 2019, U.S. application Ser. No. 16/585,284 filed Sep. 27, 2019, U.S. application Ser. No. 16/585,301 filed Sep. 27, 2019, and U.S. application Ser. No. 16/585,816 filed Sep. 27, 2019, whose entire disclosures are also hereby incorporated by reference.

What is claimed is:

1. A refrigerator having a drawer, the refrigerator comprising:

a cabinet having an opening to access a storage chamber provided within the cabinet;

the drawer including a front panel and a storage body coupled to a rear of the front panel, the drawer being coupled to the cabinet such that drawer moves between a first position in which the front panel closes the opening of the cabinet and the storage bin is received in the storage chamber, and a second position in which the front panel is spaced away from the opening of the cabinet and at least a portion of the storage bin is positioned outside of the storage chamber; and an inside cover provided at an inside surface of the storage body; and an outside cover provided at an outside surface of the storage body, wherein the inside cover has a fixing end at one side of the inside cover, and the outside cover has a locking end at one side of the outside cover, and the outside cover is attached to and detached from the storage body based on the fixing end and the locking end.

2. The refrigerator of claim 1, wherein the fixing end is to protrude from an upper surface of the inside cover, and a plurality of fixing ends are provided along the upper surface of the inside cover.

3. The refrigerator of claim 1, wherein the inside cover includes a fixing groove to receive the locking end of the outside cover, the fixing groove provided at a lower portion of the fixing end by being recessed from one side of the fixing end.

4. The refrigerator of claim 1, wherein the locking end of the outside cover is along an upper side of the outside cover by protruding toward the inside cover, and a plurality of locking ends are provided along the upper side of the outside cover.

5. The refrigerator of claim 1, wherein the outside cover includes a locking groove to receive the fixing end of the inside cover, the locking groove formed at one side of the locking end by being depressed from the one side of the locking end.

6. The refrigerator of claim 1, further comprising:

a door fixing bracket provided on one side of the storage body to attach the front panel to the storage body; and a plurality of locking holes provided on a side of the door fixing bracket by penetrating a side of the door fixing bracket.

7. The refrigerator of claim 6, wherein the outside cover comprises:

an outside plate provided at an outside surface of the storage body;

a cover plate at an upper surface of the outside plate;

an extending plate bent downward from an end of the cover plate; and the locking end being bent from an end of the extending plate toward the outside plate, and the locking end being inserted into the fixing end of the inside cover.

8. The refrigerator of claim 6, further comprising:

at least one side hook provided at a lower portion of an inside surface of the outside cover, the side hook protruding toward the storage body and fixed to an inside surface of one of the locking holes.

9. The refrigerator of claim 8, wherein the at least one side hook includes a plurality of the side hooks, and the plurality of the side hooks protrude along a side surface of the outside cover.

10. The refrigerator of claim 6, further comprising:

a fixing guide rib to be provided inside one of the locking holes by protruding toward an inside of the locking hole and partitioning the locking hole into an insertion space and a locking space.

11. The refrigerator of claim 10, further comprising:

a side fixing protrusion provided on a side surface of the outside cover, the side fixing protrusion protruding toward the storage body, being inserted into one of the locking holes, and being moved from the insertion space to the locking space of the locking hole to lock the outside cover to the side surface of the storage body when the outside cover is engaged with the storage body by sliding forward along a side surface of the storage body.

12. The refrigerator of claim 11, wherein the fixing guide rib has a fixing surface and a guide surface, the fixing surface forming a front surface of the fixing guide rib, and the guide surface being inclined and forming a rear surface of the fixing guide rib.

13. The refrigerator of claim 12, wherein the side fixing protrusion has a guide surface and a locking surface, the guide surface of the fixing guide rib being inclined and forming a front surface of the side fixing protrusion, and the locking surface forming a rear surface of the side fixing protrusion.

14. The refrigerator of claim 13, wherein the guide surface of the side fixing protrusion is guided, along the guide surface of the fixing guide rib, to the locking space of the locking hole.

15. The refrigerator of claim 1, further comprising:

a scratch preventer provided on an edge of the outside cover, the scratch preventer formed of an elastic material to prevent damage to the edge of the outside cover.

16. The refrigerator of claim 15, further comprising:

a fixing rib provided at the edge of the outside cover, the fixing rib having a rounded shape.

17. The refrigerator of claim 16, further comprising:

a fixing rib insertion hole provided inside the scratch preventer, the fixing rib insertion hole to receive the fixing rib.

18. The refrigerator of claim 17, further comprising:

a fixing protrusion provided at the edge of the outside cover, the fixing protrusion to protrude toward the end of the fixing rib and coupled to the fixing rib insertion hole to further attach the scratch preventer.

19. The refrigerator of claim 18, further comprising:

a deformation preventing protrusion provided on a lower surface of the fixing protrusion, the deformation preventing protrusion to protrude toward the fixing rib and prevent bending deformation of the fixing rib.

20. The refrigerator of claim 15, further comprising:

a cut portion provided at an end of the fixing rib for separating the end of the fixing rib from the outside cover.

* * * * *